US012629575B2

(12) United States Patent
Martell et al.

(10) Patent No.: US 12,629,575 B2
(45) Date of Patent: May 19, 2026

(54) GOLF BAG WITH FOLD OUT CRUSH ZONE

(71) Applicant: KARSTEN MANUFACTURING CORPORATION, Phoenix, AZ (US)

(72) Inventors: James D. Martell, Phoenix, AZ (US); Jason S. Milligan, Cave Creek, AZ (US); Brian J. McGuire, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 49 days.

(21) Appl. No.: 17/502,014

(22) Filed: Oct. 14, 2021

(65) Prior Publication Data

US 2022/0111272 A1 Apr. 14, 2022

Related U.S. Application Data

(60) Provisional application No. 63/198,379, filed on Oct. 14, 2020.

(51) Int. Cl.

| | |
|---|---|
| ***A63B 55/40*** | (2015.01) |
| ***A63B 55/00*** | (2015.01) |
| ***A63B 55/53*** | (2015.01) |

(52) U.S. Cl.

CPC ..... *A63B 55/40* (2015.10); *A63B 55/404* (2015.10); *A63B 55/53* (2015.10)

(58) Field of Classification Search

CPC ..... A63B 55/40; A63B 55/53
USPC ..... 206/315.6
See application file for complete search history.

(56) References Cited

U.S. PATENT DOCUMENTS

| | | | |
|---|---|---|---|
| 5,996,789 | A | 12/1999 | Suggs et al. |
| 6,168,123 | B1 | 1/2001 | Stein et al. |
| 6,315,117 | B1 | 11/2001 | Han |
| 6,412,734 | B2 | 7/2002 | Lin |
| 6,564,937 | B1 | 5/2003 | Cheng |
| 6,682,027 | B1 | 1/2004 | Chang |
| 7,500,560 | B2 | 3/2009 | Fair et al. |

(Continued)

FOREIGN PATENT DOCUMENTS

| | | | | |
|---|---|---|---|---|
| CN | 2543556 | | 3/2002 | |
| GB | 2521039 A | * | 6/2015 | ..... A63B 55/53 |

*Primary Examiner* — Nathan J Jenness
*Assistant Examiner* — Jessica Kavini Tamil

(57) ABSTRACT

Described herein is a golf bag with a deployable stand assembly and anti-tangle features that prevent clubs from tangling within the golf bag, and in particular, prevent golf club grips from crossing over and other and making it difficult to pull out a particular club. Because multiple golf clubs are often placed together in a single golf bag, the golf clubs can get in each other's way. Golf clubs can tangle if their shafts or grips crisscross within the bag. Club tangle is typically caused by movement of the club grips, while the clubs are stored in the bag. When clubs are tangled, it becomes hard to remove a single golf club without either facing resistance or pulling a second club out. Golf clubs are typically placed head-up in a golf bag, resulting in the golf club grips sitting in the base of the bag. During a golf round, fabric portions of the bag can crumple, especially near the base, restricting the available area for the golf clubs. The area restriction can shift the grips and aggravate entanglement. The golf bag described herein comprises features that alleviate club tangle by preserving grip and shaft positions during bag use.

13 Claims, 46 Drawing Sheets

(56) References Cited

U.S. PATENT DOCUMENTS

| | | | | |
|---|---|---|---|---|
| 7,650,990 | B2 | 1/2010 | Tan | |
| 8,123,032 | B2 | 2/2012 | Shiao | |
| 8,365,908 | B2 | 2/2013 | Shiao | |
| 8,887,908 | B2 | 11/2014 | Sugarek et al. | |
| 9,669,273 | B2 | 6/2017 | Lai | |
| 2003/0089629 | A1 | 5/2003 | Tan | |
| 2005/0092631 | A1 | 5/2005 | Campbell et al. | |
| 2009/0308768 | A1* | 12/2009 | Quartarone ..... | A63B 55/00 206/315.7 |
| 2017/0036079 | A1* | 2/2017 | Lai ..... | A63B 55/40 |
| 2020/0215400 | A1* | 7/2020 | Martell ..... | A63B 55/53 |

* cited by examiner

GOLF BAG WITH FOLD OUT CRUSH ZONE

RELATED APPLICATIONS

This claims the benefit of U.S. Provisional Patent Appl. No. 63/198,379, filed on Oct. 14, 2020, which is incorporated herein by reference.

FIELD OF INVENTION

The present disclosure relates generally to golf equipment, and more particularly, to golf bags methods to manufacture golf bags. In particular, the present disclosure is related to a golf bag formed from a plurality of components to reduce the amount of leg tangle that can occur with bag use.

BACKGROUND

A golf bag is a specially designed bag used to transport golf clubs. There are two main classes of golf bags: carry bags and cart bags. Carry bags are used by players to carry their desired number of clubs around a course on foot. Carry bags often comprise straps and a deployable leg assembly. The deployable leg assembly allow the bag to stand in an upright, self-supporting position. This allows easy access to the golf clubs within and ensures the bag can stand freely when not being carried. Cart bags are typically heavier than carry bags and are configured to remain strapped to a golf cart during a round of golf.

The prior art has presented a number of alleged solutions to enable a carry bag to extend its legs into a self-supporting position. When the legs of a carry bag are deployed to support the bag, the bag is leaned towards the legs, placing the golf bag at an angle to the ground plane. Some existing golf bags comprise a rigid base that lifts partially off the ground. In other existing golf bags, the base comprises two halves, which hinge to allow a portion of the base to rise off the ground. Raised base designs can be unstable and aesthetically unpleasing. Therefore, some golf bags comprise a base that remains completely flush against the ground (hereafter called a "ground-flush" base design) when the legs are extended. In these golf bags, the fabric flat of the bag can sometimes bunch up near a portion of the base when the legs are extended. The bunching caused by leg extension can lead to club tangle. Therefore, there is a need in the art for a golf bag with a means of preventing club tangle when the legs are repeatedly extended and retracted.

Described herein is a golf bag with a deployable stand assembly and anti-tangle features that prevent clubs from tangling within the golf bag, and in particular, prevent golf club grips from crossing over and other and making it difficult to pull out a particular club. Because multiple golf clubs are often placed together in a single golf bag, the golf clubs can get in each other's way. Golf clubs can tangle if their shafts or grips crisscross within the bag. Club tangle is typically caused by movement of the club grips, while the clubs are stored in the bag. When clubs are tangled, it becomes hard to remove a single golf club without either facing resistance or pulling a second club out. Golf clubs are typically placed head-up in a golf bag, resulting in the golf club grips sitting in the base of the bag. During a golf round, fabric portions of the bag can crumple, especially near the base, restricting the available area for the golf clubs. The area restriction can shift the grips and aggravate entanglement. The golf bag described herein comprises features that alleviate club tangle by preserving grip and shaft positions during bag use.

Figure 1:
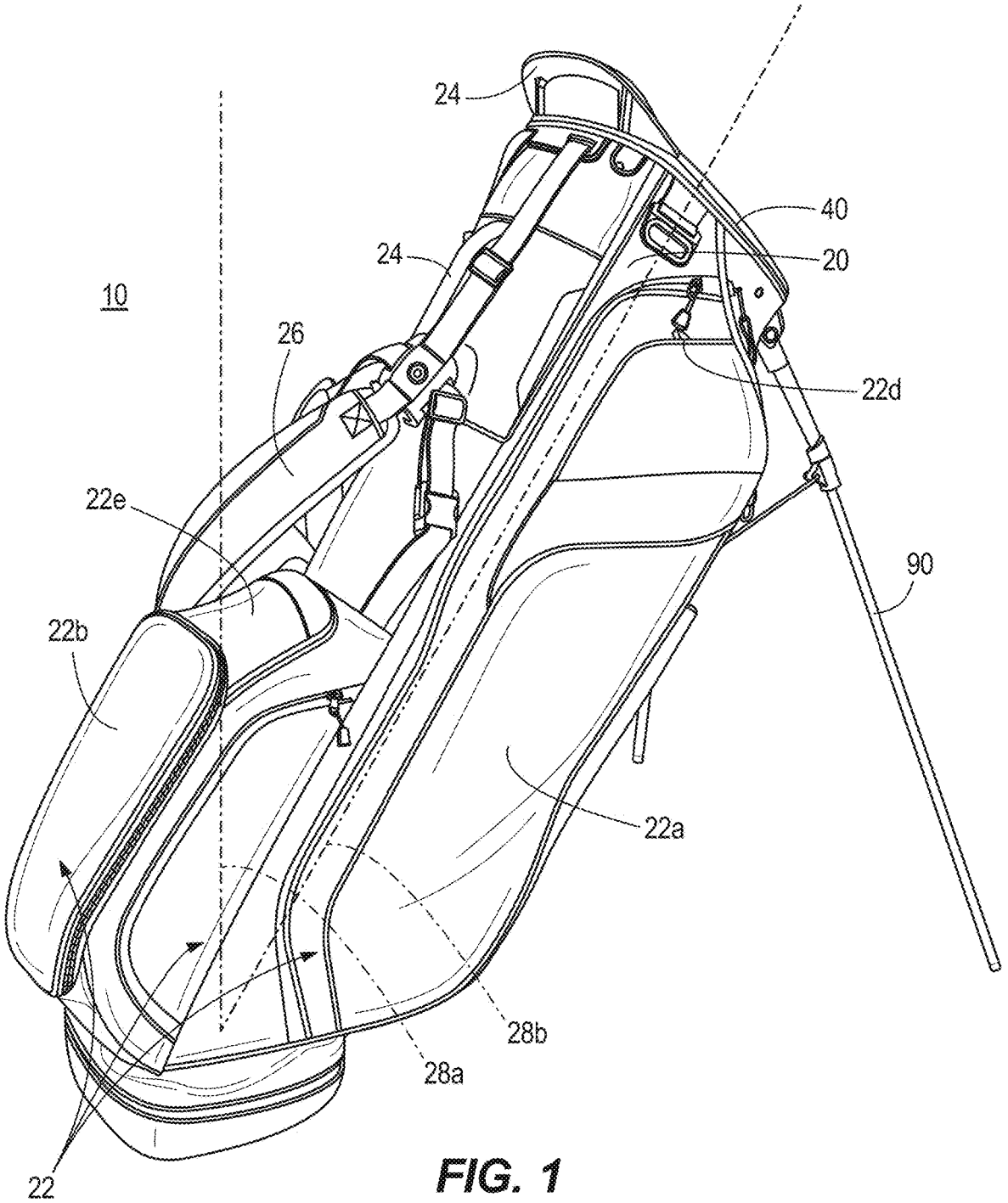
FIG. 1 illustrates a perspective view of a golf carry bag, according to an embodiment.
Figure 2:
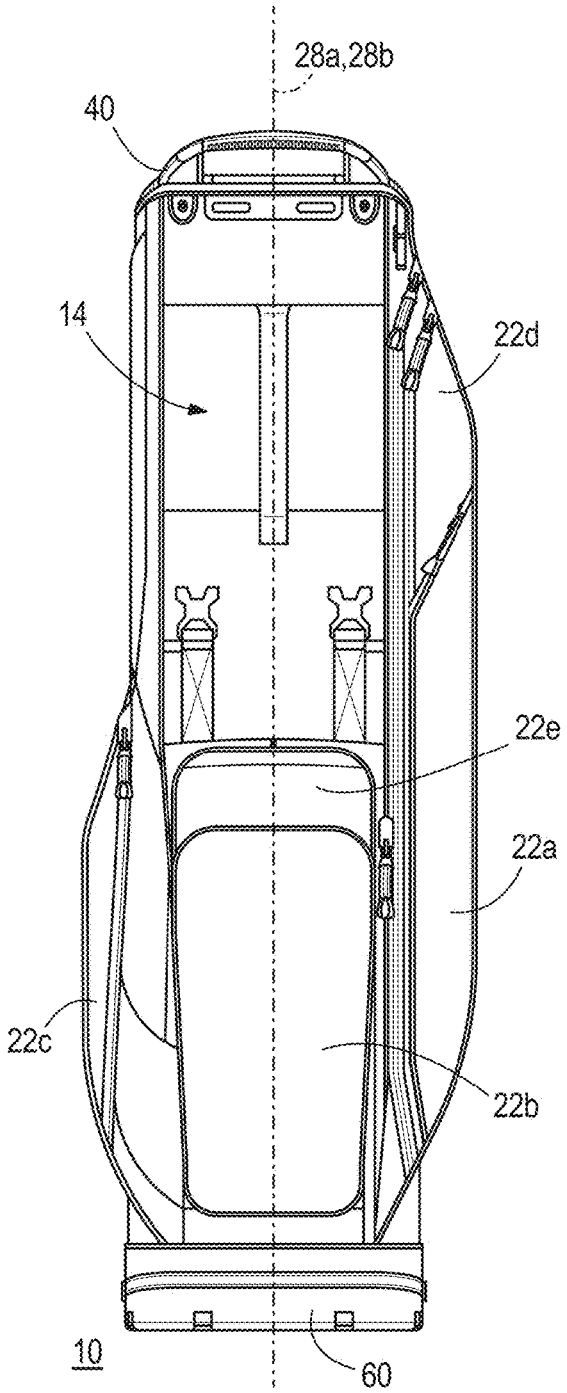
FIG. 2 illustrates a back view of a golf bag, in an upright position, according to an embodiment.
Figure 3:
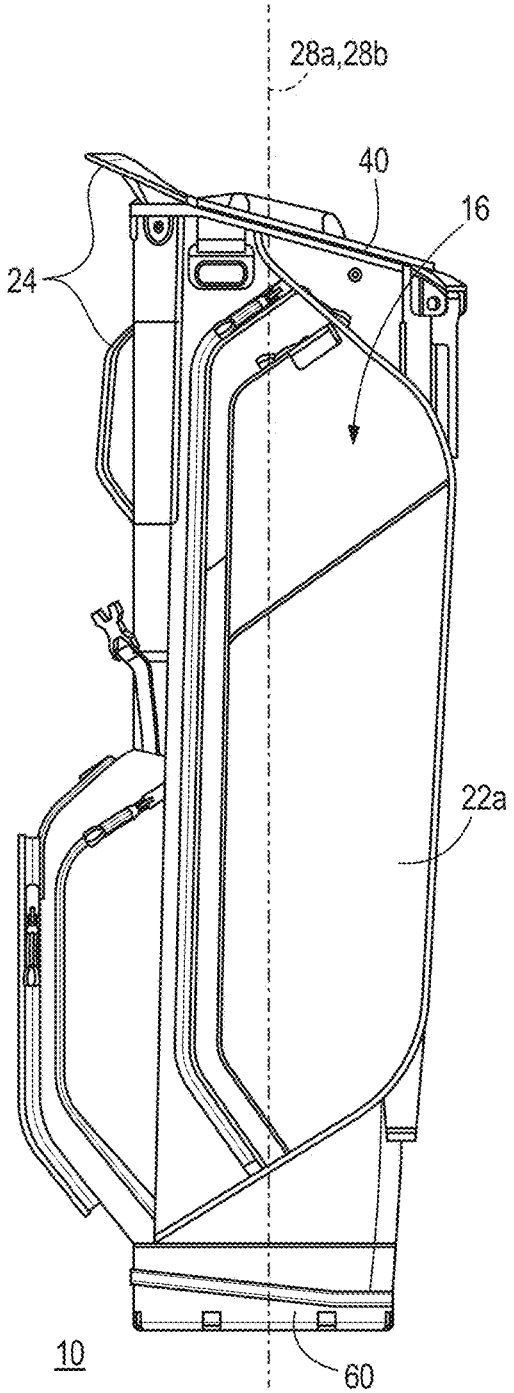
FIG. 3 illustrates a first side view of a section of the golf bag of FIG. 2, in an upright position.
Figure 4:
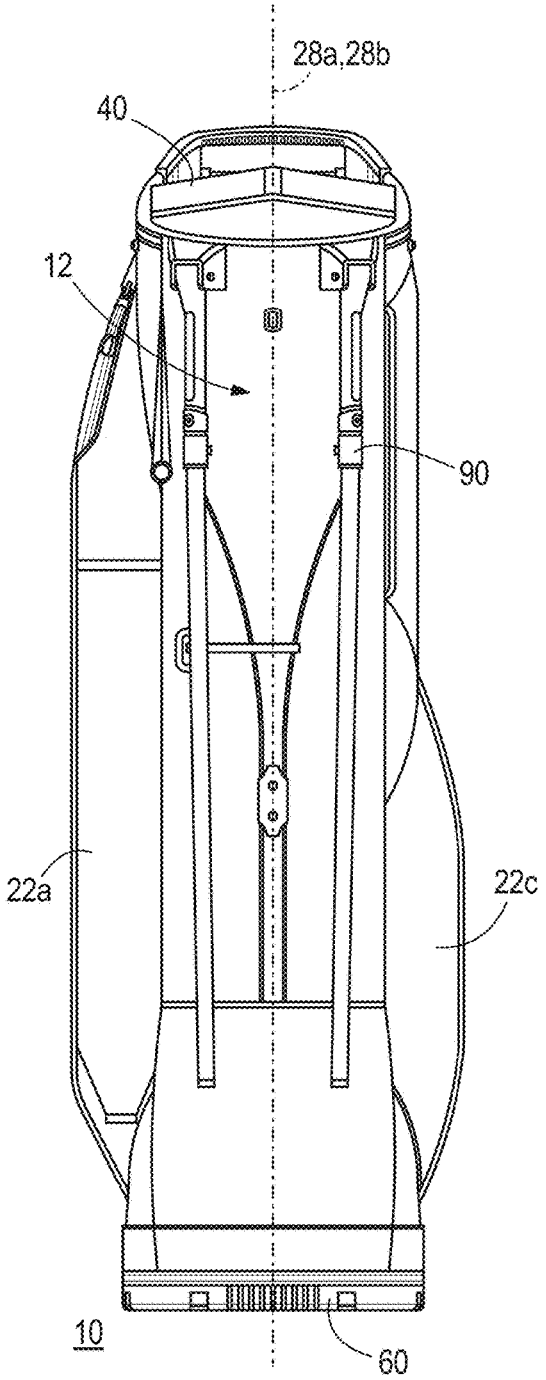
FIG. 4 illustrates a front view of the golf bag of FIG. 2, in an upright position.
Figure 5:
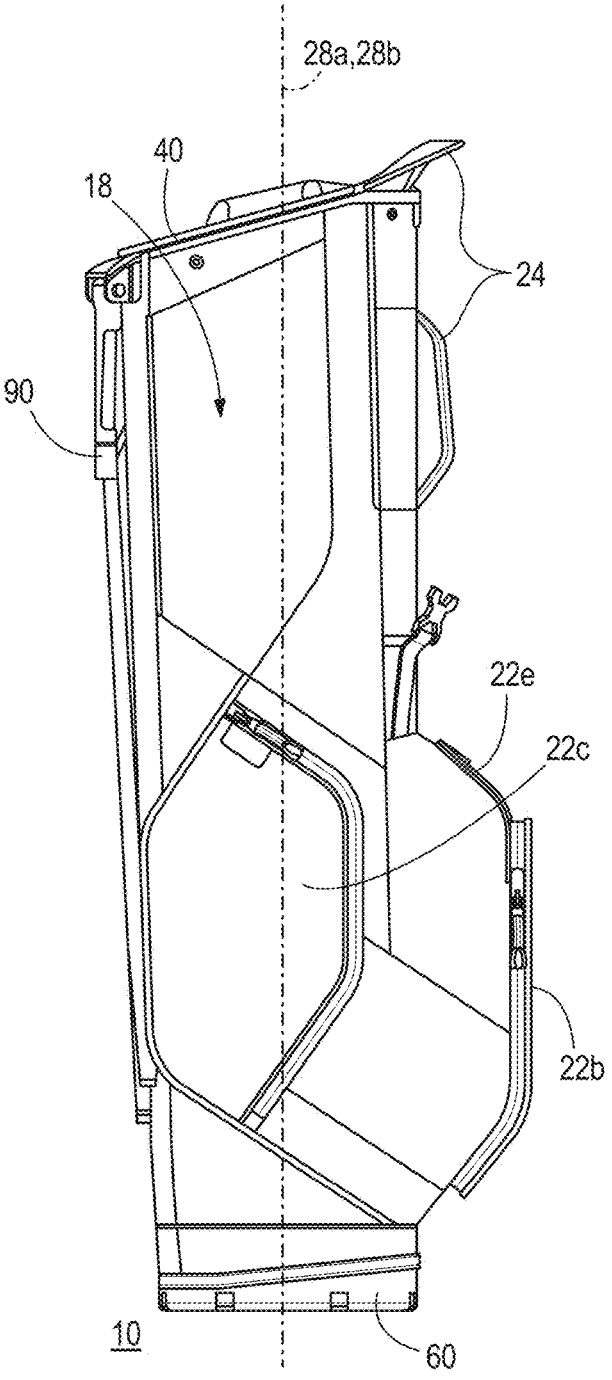
FIG. 5 illustrates a second side view of a section of the golf bag of FIG. 2, in an upright position.
Figure 6:
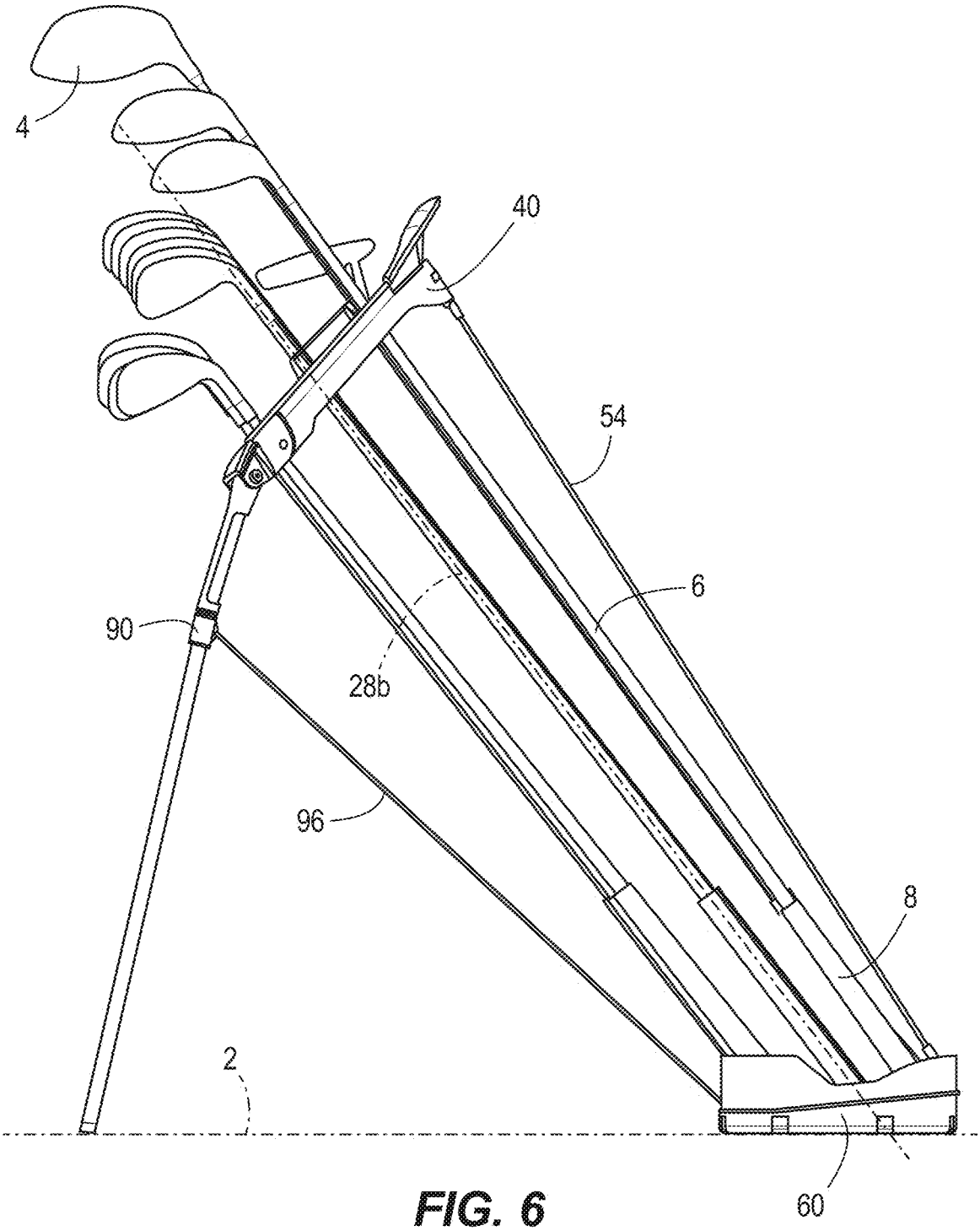
FIG. 6 illustrates a side view of a golf bag containing golf clubs in the deployed position, according to one embodiment.
Figure 7:
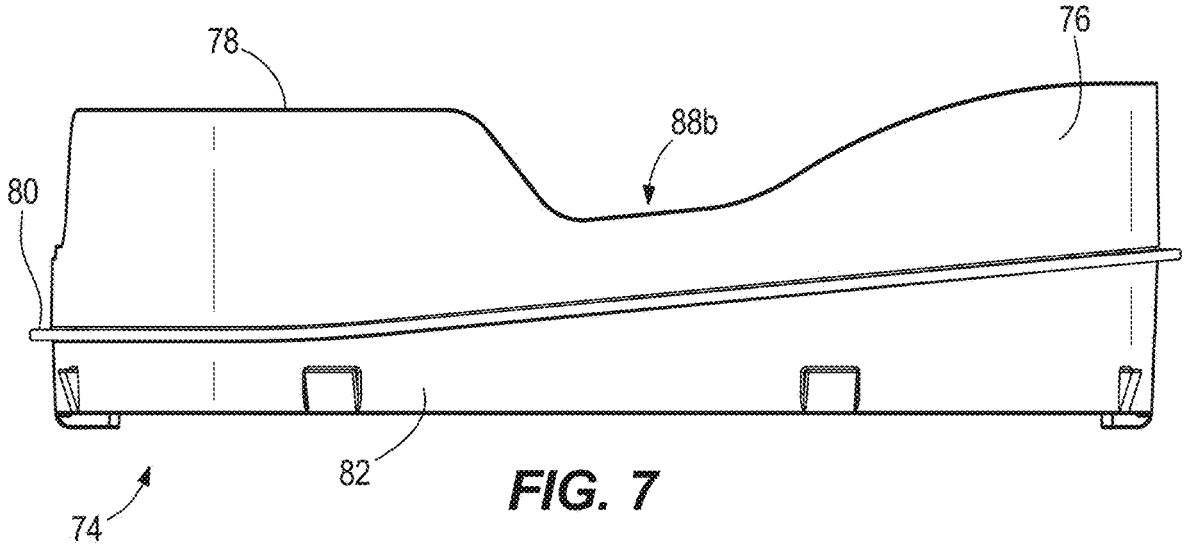
FIG. 7 illustrates a side view of the base ring, according to one embodiment.
Figure 8:
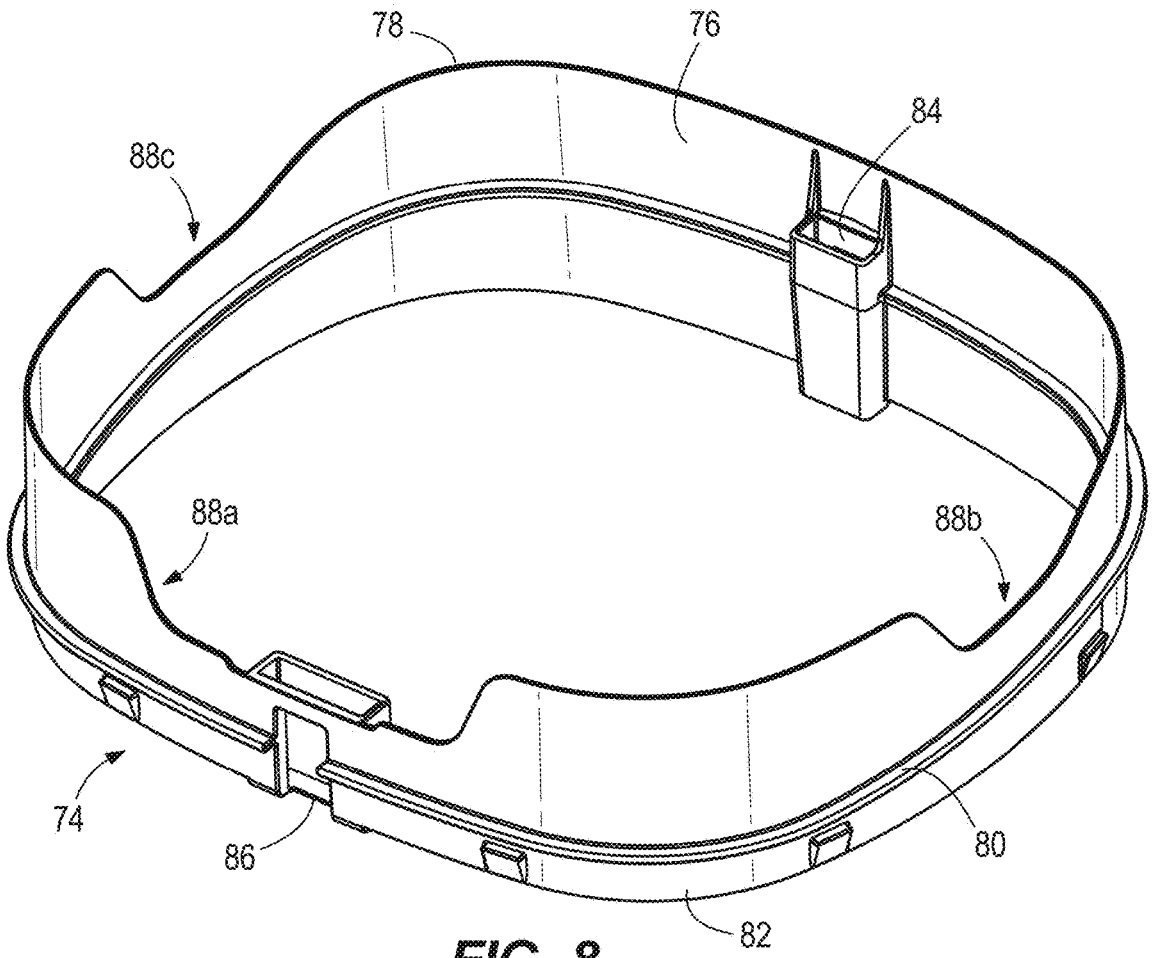
FIG. 8 illustrates a perspective view of the base ring of FIG. 7.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The anti-tangles features described herein include, but are not limited to, a flat with a crush zone, a base with a tall ring and dividing ribs, a reinforced divider sleeve, a rain hood pocket panel, and/or combinations thereof. The golf bag described herein can comprise a crush zone to prevent fabric from collapsing toward the center of the golf bag and increasing the risk of club tangle. Similarly, the golf bag described herein can further comprise a base with a tall ring that acts as a physical blockade to prevent fabric on one or multiple sides of the bag from collapsing toward the center of the golf bag. The golf bag described herein can further comprise base walls that maintain separation of the golf club grips at the end of the golf club, and prevent movement throughout the base of the golf bag.

Deployment and retraction of the stand assembly can be a major cause of club tangle in golf bags lacking features for alleviating club tangle. Without said features, a golf bag with a ground-flush base design can partially collapse inward when the legs are deployed. The herein described features for alleviating club tangle can prevent or restrict the fabric flat from folding or collapsing towards a center of the bag in the manner described above. Therefore, the golf bag described herein constricts golf club grips less than conventional golf bags lacking features for alleviating club tangle. The crush zone and base dividing ribs, described below, can conserve base useful area, which reduces entanglement of the grips by providing more space for storage.

The golf bag features described herein prevent club tangle by maintaining the golf club grips and shafts in roughly the same position that they are initially placed in the bag. The golf bag can comprise a fabric flat with a crush zone that folds outwards, preventing constriction of the clubs within a lower region of the golf bag. The base, which is adjacent to the crush zone, can comprise dividing ribs. The bag can further comprise a base ring extending above the base to assist the crush zone in preventing fabric from folding inwards, and the dividing ribs can reduce the shifting of the golf clubs during play. The golf bag can further comprise a reinforced divider sleeve that assists in retaining clubs within their original position within the bag, thus reducing club tangle. The reinforcement structure of the divider sleeve can be positioned in a middle region of the golf bag, between the divider top and base.

DEFINITIONS

The term "golf bag," as used herein, refers to a storage container for transporting golf clubs. The golf bag can comprise at least a flat, a divider top, and a base The term "carry bag," as used herein, refers to a type of golf bag that is designed to be carried throughout a golf round. Carry bags can comprise straps and a stand assembly, defined below. The stand assembly allows the carry bag to stand in an upright, self-supporting position.

The term "cart bag," as used herein, refers to a type of golf bag that is designed to be placed on a golf cart during a golf round. Cart bags are typically heavier than carry bags and are configured to remain strapped to a golf cart during a round of golf. Cart bags do not include stand assemblies.

The term "upright configuration," as used herein, refers to a position of the golf bag where the majority of the golf bag is sitting vertically above the base, and the stand assembly of the golf bag is retracted. The golf bag upright configuration can also be called a legs-retracted, undeployed, or unsupported configuration or position. In the upright configuration, the two legs of the stand assembly can be retracted and flush with the flat.

The term "deployed configuration," as used herein, refers to a position of the golf bag where the golf bag is angled and supported by the stand assembly. In the deployed configuration, the majority of the golf bag does not sit vertically above the base. The golf bag deployed configuration can also be called a stabilized, inclined, self-supporting, or legs-extended configuration or position. In the deployed configuration, the two legs of the stand assembly can be extended away from the flat.

The term "tubular body," as used herein, refers to a general assembly of the golf bag, including at least a flat, a divider sleeve, a stay, a divider top, and a base, but not including the stand assembly, defined below. The tubular body can be capped or enclosed at a bottom end by the base.

The term "body reference axis," as used herein, refers to a reference axis that is centered within the tubular body. The body reference axis can intersect the vertical reference axis, defined below, at the ground plane.

The term "vertical reference axis," as used herein, refers to a reference axis that is perpendicular to a ground plane and centered.

The term "bag angle," as used herein, can be measured, from a side view, between the body reference axis and the vertical reference axis.

The term "stay," as used herein, refers to a structural rod, rigid or semi-rigid, that serves as a backbone for the golf bag. The stay connects to the base and the divider top via hinges. The stay can be an internal component, hidden by the flat in an assembled bag.

The term "flat," as used herein, refers to a fabric outer, shell, or skin that is configured to form a body of the golf bag. The flat can comprise a crush zone.

The term "crush zone," as used herein, refers to the portion of the flat configured to collapse when the golf bag moves into the deployed configuration.

The term "pocket," as used herein in relation to the flat, can refer to an apparel pocket, a side accessory pocket, ball pocket, a magnetic pocket, a glove pocket, a shoe pocket, and/or other pockets for holding items. A pocket of the flat can be formed from the same material as the flat, and can optionally comprise one or more panels for structural rigidity.

The term "divider top," as used herein, refers to a rigid or semi-rigid structural component that forms a top and a mouth of the golf bag. The divider top can be configured to receive golf clubs. The divider top can also be configured to secure or be riveted to a top edge of the flat.

The term "divider top outer ring," as used herein, refers to an outermost or peripheral portion of the divider top that surrounds a frame, defined below.

The term "frame," as used herein in relation to the divider top, refers to a central structure of the divider top. The frame defines club pockets, as defined below.

The term "club pocket," as used herein, refers to divider top structural openings, apertures, or holes defined by the construction of the divider top frame. Club pockets can facilitate entry of the clubs into the golf bag, while also separating, or partially separating, the clubs from one another.

The term "leg connection bracket," as used herein, refers to a component that is integral or attached to the divider top and configured to rotationally secure a pair of legs, defined below. The bracket can receive a pair of leg end caps that hold the pair of legs. The term "leg connection bracket" can be shortened to "bracket."

The term "handle," as used herein, refers to a component that can be grasped and used to lift the golf bag.

The term "base," as used herein, refers to a rigid or semi-rigid structural component that forms an enclosed bottom of the golf bag. The base can be configured to support the grips of the stored golf clubs when the golf bag is in an upright position. The base can also be configured to secure or be riveted to a bottom edge of the flat.

The term "main panel," as used herein with reference to the base, refers to a portion of the base that lies flush against the ground when the golf bag is in the upright configuration.

The term "base ring," as used herein, refers to a component in connection with the base, extending perpendicularly from the base main panel.

The term "ring wall," as used herein with reference to the base, refers to an outermost or peripheral portion of the base that surrounds or connects to the edge of the main panel.

The term "base inner surface" as used herein, refers to the surface of the base facing the hollow interior of the bag.

The term "base outer surface" as used herein, refers to the surface of the base facing the exterior of the bag.

The term "regions," as used herein, refers to allotted areas of the base main panel. In some embodiments, the regions may correspond with the divisions of the divider top.

The term "dividing ribs," as used herein in reference to the base, refers to the components protruding from the base main panel that define the regions along the base main panel.

The term "stand assembly," as used herein, refers to a deployable apparatus for supporting the golf bag. The stand assembly can comprise a pair of legs, a spring, a pair of leg end caps, and a pair of spring attachment joints.

The term "leg," as used herein, refers to a rod, shaft, or tube that acts as a support element for the golf bag. A pair of legs can prop up the carry bag when it is in the deployed configuration.

The term "spring," as used herein, refers to one or more thin rods with a tendency to retain its original shape. In some embodiments, the spring can comprise two thin rods that are bonded or bound together at one end. In other embodiments, the spring can be one unitary element at a first end that splits into two rods at a second end (i.e. taking on a Y-shape).

The term "leg end cap," as used herein, refers to components that can connect a leg to a bracket of the top divider. Each leg end cap can fit over a top end of a leg.

The term "spring attachment joint," as used herein, refers to a component that can connect the spring to the pair of legs.

The term "straps," as used herein, refers to fabric or mesh components that allow a golfer to lift the golf bag. The straps can be configured to be placed over a golfer's shoulders.

The term "divider sleeve," as used herein, refers to fabric sheets or a fabric tube that extends inside the flat from the divider top towards the base. The divider sleeve can be configured to assist in separating the golf clubs. In embodiments with a tubular divider sleeve, the divider sleeve can correspond to one or more club pockets of the divider top.

The term "hollow interior," as used herein, refers to a region enclosed by the tubular body.

The term "front," when used herein with respect to the golf bag, refers to a belly side of the golf bag. The front of the golf bag is the side of the golf bag towards which the golf bag leans when placed in the deployed configuration.

The term "rear," when used herein with respect to the golf bag, refers to a back side of the golf bag, opposite the front side. The rear of the golf bag is the side supporting the ball pocket. A handle is often attached to the rear of the golf bag.

The term "first side," when used herein with respect to the golf bag, refers to a side of the golf bag between the front and the rear.

The term "second side," when used herein with respect to the golf bag, refers to a side of the golf bag opposite the first side.

The term "outwards," as used herein with respect to the golf bag, refers to a direction away from a center of the golf bag body. In other words, the term "outwards" refers to a direction away from the hollow interior of the golf bag.

The term "inwards," as used herein with respect to the golf bag, refers to a direction, opposite "outwards."

The term "extension plane," as used herein with respect to the crush zone refers to a plane that runs roughly parallel to a top edge and a bottom edge of the crush zone.

The term "extension distance," as used herein with respect to the crush zone refers to a distance the crush zone extends perpendicular to the extension plane when the golf bag is in the deployed configuration.

The term "bulge point," as used herein with respect to the crush zone, refers to a point along the crush zone where the fabric is most likely to extend outwards when the golf bag is in the deployed configuration. In many embodiments, the bulge point occurs at the meeting point between adjacent panels.

The term "horizontal bulge distance," as used herein with respect to the crush zone refers to a distance between the front of the base and the bulge point of the crush zone.

The term "base useful area," as used herein, refers to an area measurement that corresponds to a region of the base interior surface that is largely free of fabric obstruction.

The term "mid-useful area," as used herein, refers to an area measurement that corresponds to a middle region of the tubular body, the middle region being roughly halfway between the base and the divider top. The mid-useful area can be measured parallel to the ground plane when the golf bag is in the upright configuration. The mid-useful area is largely free of fabric obstruction. The mid-useful area illustrates the space available for storage of golf club shafts.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Provided herein is a carry golf bag with a deployable assembly comprising anti-tangle features to ensure golf clubs can be removed with ease from the bag. The anti-tangle features can help the user remove a single golf club without the grip sticking to another golf club in the bag when the bag is either in a deployed or upright configuration. The anti-tangle features described below include a flat crush zone feature, a base having a tall ring and dividing ribs, a reinforced divider sleeve, a rain hood pocket panel design, and any combination thereof. The golf bag 10 can be a carry bag, having a stand assembly 90 with legs 92. The golf bag 10 can be positioned in an upright position or a deployed configuration. The base 60 remains flush against the ground in both the upright and deployed configurations. The stand assembly 90 includes a pair of legs 92, towards which the tubular golf bag body tilts when the legs 92 are deployed. Due to the base remaining flat against the ground while the body tilts, the fabric flat of the body can partially crumple or fold within a region adjacent the base 60. One of the anti-tangle features, the crush zone 100 of the fabric flat 20, is designed to intentionally collapse outwards when the legs 92 are deployed, to prevent the flat 20 from crumpling inwards and constricting the stored clubs 4. The crush zone 100 can be compressed when the golf bag 10 is in the deployed configuration and decompressed when the golf bag 10 is in the upright configuration.

Referring to FIGS. 1-6, the golf bag 10 can comprise a tubular body and a stand assembly 90. The tubular body can comprise a divider top 40, a flat 20, a divider sleeve 30, a stay 54, and a base 60. The tubular body can enclose a hollow interior of the golf bag 10. The stand assembly 90 can comprise a pair of legs 92, a spring 96, a pair of leg end caps 94, and a pair of spring attachment joints 98. The spring 96 can be configured to help the legs 92 deploy and retract. The stand assembly 90 is attached to the divider top 40 and the base 60 of the body. The golf bag 10 can comprise a front 12 (or belly), a first side 16, a second side 18, and a back 14. The stand assembly 90 can be positioned on the front 12 of the golf bag 10. The golf bag 10 can lean towards the front 12 when placed in the deployed configuration.

The flat 20 can further comprise one or more pockets 22 for storing apparel, golf gloves, golf balls, tees, score cards, and other accessories. The one or more pockets 22 can comprise an apparel pocket 22*a*, a side accessory pocket 22*c*, ball pocket 22*b*, a magnetic pocket 22*e*, a glove pocket 22*d*, a rain hood pocket 22*f*, and/or other pockets. For example, an apparel pocket 22*a* can extend along a majority of the height of the first side 16 of the golf bag 10, a side accessory pocket 22*c* can be extend along roughly half of the height of the second side 18 of the golf bag 10, and a ball pocket 22*b* can be positioned on the back 14 of the golf bag 10. The one or more pockets 22 can be shaped to avoid regions of the bag that collapse or compress during deployment of the stand assembly 90. For example, the apparel pocket 22*a* and the side accessory pocket 22*c* can each comprise an angled bottom edge. The angled bottom edge allows the pockets 22 to remain unaffected when the bag 10 is in the deployed configuration. In other words, the one or more pockets 22 can be located so that they do not overlap the crush zone 100.

The base 60 comprises an inner surface 62, outer surface 64, a bottom panel 68, and receiving wall 70. The bottom panel 68 lies flush with the ground plane 2 when the golf bag 10 is set on the ground in either the upright or deployed configuration. The receiving wall 70 extends up from a perimeter edge of the bottom panel 68. The outer surface 64 of the of the base 60 contacts the ground. The inner surface 62 is opposite the outer surface 64. The inner surface 62 contacts the grips 8 of the golf clubs 4, which are placed into the hollow interior of the golf bag 10. In one of the anti-tangle features, the inner surface 62 comprises ribs or dividing ribs 69 that can reduce grip slippage, as described below.

Another anti-tangle feature, the base ring 74, runs along the perimeter edge of the bottom panel 68 of the base 60. In some embodiments, the base ring 74 can have a height that varies, wherein the base ring height is measured vertically when the base is flush with the ground. In some embodiments, the height of the base ring 74 at the back 14 of the bag 10 is greater than the height of the base ring 74 at the front 12 of the bag 10. This height differential between the front 12 and the back 14 of the bag 10 can allow the crush zone 100 to fold further towards the ground plane 2 when the golf bag 10 is resting in the deployed configuration. In other configurations, the height of the base ring 74 can be equal or greater at the front 12 of the bag 10. An upper wall 76 of the base ring 74 can restrict a front of the flat 20 from folding into the hollow interior of the golf bag 10, as described below.

The body can also comprise a stay 54 that connects the divider top 40 to the base 60 at a back 14 of the golf bag 10. The stay 54 acts like a backbone, giving the golf bag 10 some rigidity. The stand assembly 90 gives the front 12 of the golf bag 10 rigidity, opposite the stay 54. The stay 54 comprises a stay top end 55, a stay bottom end 57, a top hinge 56, and a bottom hinge 58. The stay top end 55 flexibly attaches to the divider top 40 by way of the top hinge 56. The stay bottom end 57 flexibly attaches to the base ring 74 by way of the bottom hinge 58. The top and bottom hinges 56, 58 are configured to bend in a front-to-back direction. When the golf bag 10 is in the upright position, the stay 54 is positioned roughly perpendicular to both the top divider 40 and the base 60. However, when the golf bag 10 is in the deployed configuration, the stay 54 is positioned at a first non-perpendicular angle from the divider top 40 and at a second non-perpendicular angle from base 60. In this way, the top and bottom hinges 56, 58 allow the base 60 to remain flat against the ground while the remainder of the bag bends or leans towards the legs 92.

The golf bag 10 further comprises the divider sleeve 30, which connects the divider top 40 and the base 60. The divider sleeve 30 can comprise a fabric tube or one or more fabric sheets that separate clubs within the body of the golf bag 10. The divider sleeve 30 can further comprise top and bottom connection members extending, respectively, from a top and bottom edge of the fabric tube. The top connection members can be configured to attach to part of the frame of the divider top. The bottom connection members can be configured to attach to the base. In some embodiments, the bottom connection members of the divider sleeve 30 loop or clip into one or more base ribs 69. In some embodiments, the fabric tube does not extend fully to the base 60. This can help prevent fabric bunching and club tangle. As described below, one of the anti-tangle features, the divider sleeve 30, can be reinforced by reinforcement panels 32 to additionally reduce club tangle by limiting body sag.

The stand assembly 90 can comprise two legs 92, two leg end caps 94 corresponding to the two legs 92, a spring 96, and two spring attachment joints 98. Each leg 92 can have an upper end and lower end. Each leg end cap 94 can be configured to attach, secure, and/or adhere to the upper end of one of the two legs 92. Each leg end cap 94 can be rotationally received into the leg connection bracket of the divider top 48. The spring 96 can push the legs 92 outwards when they are extended, and the spring 96 can pull the legs 92 inwards when they are retracted. The spring 96 can comprise two arms, each one configured to connect to one of the legs 92 via the two spring attachment joints 98. The spring 96 attaches to the base 60 at the front 12 of the golf bag 10. When the golf bag 10 is set down and the base 60 is pressed against the ground at a front 12 of the bag 10, the spring 96 moves upwards and forces the legs 92 to extend outwards. When the bag 10 is lifted into the upright configuration, the spring 96 pulls the legs 92 inwards until they contact the flat 20. Simply put, when the golf bag 10 is in the upright configuration, the stand assembly 90 has its legs 92 retracted. When the golf bag 10 is in the deployed configuration, the stand assembly 90 has its the legs 92 extended.

The configuration of the golf bag 10 can affect the interaction between the golf bag 10 and the carried golf clubs 4. When the golf bag 10 is in the upright configuration, the golf clubs 4 are typically oriented such that the golf club shafts 6 are roughly vertical with reference to a ground plane 2. In the upright configuration, the golf clubs 4 are primarily supported by their grips 8 contacting the base 60. The clubs 4 are held roughly upright with their shafts or hosels 6 leaning gently against the frame of the divider top 40. Golfers naturally place golf clubs into a golf bag so that the golf club grip rests in a region of the base 60 that generally corresponds to the pocket 46 of the divider top frame 44 through which the club extends. Club tangle happens when the golf bag 10 is moved into non-upright orientations that tilt the grips 8 and shafts 6 relative to their original orientation within the bag body. For example, club tangle can be exacerbated by placing the golf bag 10 in the deployed configuration or sideways in the trunk of a vehicle.

When the golf bag 10 is in the deployed configuration, the golf clubs 4 are typically oriented such that the golf club shafts 6 are angled with respect to the ground plane 2. As the stand assembly 90 is extended, the body folds towards the legs 92, crumpling a front, lower region of the flat 20 adjacent the base. The base 60 remains flush against the ground. In a golf bag lacking an anti-tangle feature such as a crush zone, the fabric flat can constrict or collapse inwards towards the hollow interior of the bag body when the stand assembly 90 deploys. This can cause the shafts and grips of the golf clubs to be pushed towards a back of the golf bag. The limited space for movement can cause or aggravate club tangle.

The angle at which the bag deploys affects how much of the flat 20 collapses during deployment of the stand assembly 90. The bag angle 28, measured between the vertical reference axis 28*a* and the body reference axis 28*b*, in a side view, can be approximately zero degrees in the upright configuration. In the deployed configuration, however, the bag angle 28 can range, inclusively, between 25 degrees and 45 degrees, preferably inclusively between 30 degrees and 40 degrees. In some embodiments, the bag angle 28 in the deployed configuration can range, inclusively, between 25 degrees and 35 degrees, 30 degrees and 34 degrees, 32 degrees and 36 degrees, 34 degrees and 38 degrees, 36 degrees and 40 degrees, or 35 degrees and 45 degrees.

In golf bags without the herein described tangle-prevention features, repeatedly deploying the stand assembly 90 can cause movement of the grips 8 from their original position in the base 60 to another region of the base 60. This grip movement, caused in part by the constriction of base useful area and/or mid-useful area 640, 644, can result in more club tangle with each deployment of the stand assembly 90. Including an anti-tangle feature such as a crush zone 100 in the flat 20 can help reduce or prevent constriction of the base useful area 640. Similarly, including a divider sleeve 30 structure can help reduce or prevent constriction of the mid-useful area 644. The crush zone 100, described below, helps maintain and/or maximize base useful area and by reducing constriction of the flat fabric adjacent the base. Hereafter, it should be understood that constriction/reduction of the base useful area will also result in constriction/reduction of the body useful volume.

Described below are anti-club tangle golf bag features, including a crush zone, raised base ring 74, base dividing ribs, reinforced divider sleeve 30, and rain hood pocket panel 23 that preserve grip and shaft positions to prevent club tangle. In some embodiments, the golf bag 10, as described above, can further comprise any one or combination of the anti-tangle features described in detail below.

I. CRUSH ZONE

Referring to FIGS. 9-38, the golf bag 10, as described above, can further comprise a portion of the flat 20 that collapses during leg deployment (i.e. a crush zone). The structure of the crush zone guides its collapse to avoid crumpling or compression in specific regions of the flat 20. The crush zone, as described below with reference to crush zone 100, can describe any of the crush zone embodiments 100, 200, 300, 400, or 500. The crush zone 100 can also be called a crumple zone, a fold zone, or a compressible zone. In some embodiments, the crush zone 100 can bulge, extend, or bump outwards, biasing the crush zone 100 to compress outwards from the hollow interior. The crush zone 100 of the flat 20 is described below with reference to a first crush zone embodiment 100, illustrated in FIGS. 9-12. However, other embodiments, such as 200, 300, and 400, can be understood with respect to similar reference numbers with a different hundreds scheme. For example, the pivot point 202 of the second crush zone embodiment 200 can be similar to the pivot point 102 of the first crush zone embodiment 100.

When the legs 92 are extended (i.e. deployed configuration), the crush zone 100 folds outwards to prevent the flat 20 material of the crush zone 100 from greatly constricting the base usable area. The crush zone 100 can fold away from the hollow interior of the golf bag 10. Preserving the usable area 640 of the base inner surface 62 prevents the golf club grips from getting entangled and trapped within the golf bag 10. The crush zone 100 can extend across portions of the front (or belly), the first side 16, and the second side 18 of the golf bag 10. The crush zone 100 does not extend across the back 14 of the golf bag 10.

The crush zone 100 can have one or more panels connected or cinched or sewn by one or more seams. The panels can also be called tailored panels, folding panels, pleated panels, tailored gussets, folding gussets, or pleated gussets. The shape and size of the one or more panels in combination with the seam placement can create a region where the flat 20 fabric is biased to fold outwards or overlap itself. The outwards direction as used here within and defined above refers to a direction away from the hollow interior of the bag, or the center of the bag. In some embodiments, from a side view, the flat 20 fabric can bulge or curve outwards slightly on the front of the golf bag 10 to create the bias. On the sides 16, 18 of the golf bag 10, the crush zone 100 can cover a roughly triangular region, allowing the crush zone 100 to collapse forward when the stand assembly 90 is deployed. In some embodiments, the one or more seams can be corded, piped, or serged externally. Since the flat 20 is made from a fabric material, it can return to its original form after being collapsed or folded. The crush zone 100 can also return to its original form after being collapsed or folded because of the locations and orientations of its seams. Various panel and seam combinations and configurations can achieve the desired crush zone shaping, as described in the below embodiments.

In order to define the position of the crush zone, context of space for the crush zone is defined in relativity to the golf bag 10. Referring to FIGS. 9-12, the golf bag 10 can be set on a ground plane 2, so that the base 60 is flush with the ground plane 2. When the stand assembly 90 is deployed, the golf bag 10 bends at the stay bottom hinge 58 near the rear 14 of the golf bag 10. From the side view, the bottom hinge 58 of the stay 54 defines a pivot point 102. However, in some embodiments, the pivot point 102 can be slightly offset from the bottom hinge 58 due to how the flat 20 and base 60 interact and fold. The crush zone 100 can extend back to or almost to the pivot point 102. Referring to FIG. 11, the crush zone 100 can be described with respect to a pivot plane 104. The pivot plane 104 is parallel to the ground plane 2 and coincident with the pivot point 102. In crush zone embodiments 100, 200, 300, 400, and 500, the crush zone 100 can extend both above and below the pivot plane 104. Crush zone 550 does not extend below the pivot plane 104. Extending below the pivot plane 104 gives the crush zone 100 additional space to collapse without inhibiting the golf bag 10 from leaning into the deployed configuration.

In some embodiments, in the upright configuration, over half of the crush zone 100 can be positioned above the pivot plane 104, and in the deployed configuration over half of the crush zone 100 can be compressed below the pivot plane 104. The crush zone 100 of the flat 20 is described below with reference to a first crush zone embodiment 100, illustrated in FIGS. 9-12. However, other embodiments, such as 200, 300, 400, and 500 can be understood with respect to similar reference numbers with a different hundreds scheme. For example, the pivot plane 204 of the second crush zone embodiment 200 can be similar to the pivot plane 104 of the first crush zone embodiment 100.

In some embodiments, in the upright configuration, over two-thirds or three-quarters of the crush zone 100 can be positioned above the pivot plane 104. In some embodiments, in the deployed configuration, over one-third, one-half, or two-thirds of the crush zone 100 can be compressed below the pivot plane 104. By positioning a portion of the crush zone 100 below the pivot plane 104 in the upright configuration, the crush zone 100 has additional room to fold relatively uninhibited as the stand assembly 90 deploys. Since the base ring 74 can be located below the pivot plane 104, extending the crush zone 100 below the pivot plane 104 further allows the base ring 74 to assist in holding the crush zone 100 outside the hollow interior of the tubular body. In further embodiments, the entirety of the crush zone 100 is positioned above the pivot plane 104 and does not interact with the ring. As mentioned above, the crush zone, as described below with reference to crush zone 100, can describe any of the embodiments 100, 200, 300, 400, or 500. The crush zone 550 does not extend below the pivot plane 504.

The pivot plane 104 can be offset above the ground plane 2 by a pivot plane height 106 between 1 inch and 6 inches. In some embodiments, the pivot plane 104 can be offset above the ground plane 2 by between 1 inch and 2 inches, 2 inches and 3 inches, 3 inches and 4 inches, 4 inches and 5 inches, or 5 inches and 6 inches. The pivot plane height 106 can be designed to be greater than the diameter of a butt end of a golf club grip, so that when the golf clubs 4 are angled in the deployed configuration, the butt end of the grips 8 are not constricted between the base 60 and the flat 20 at the rear 14 of the bag 10.

Figure 10:
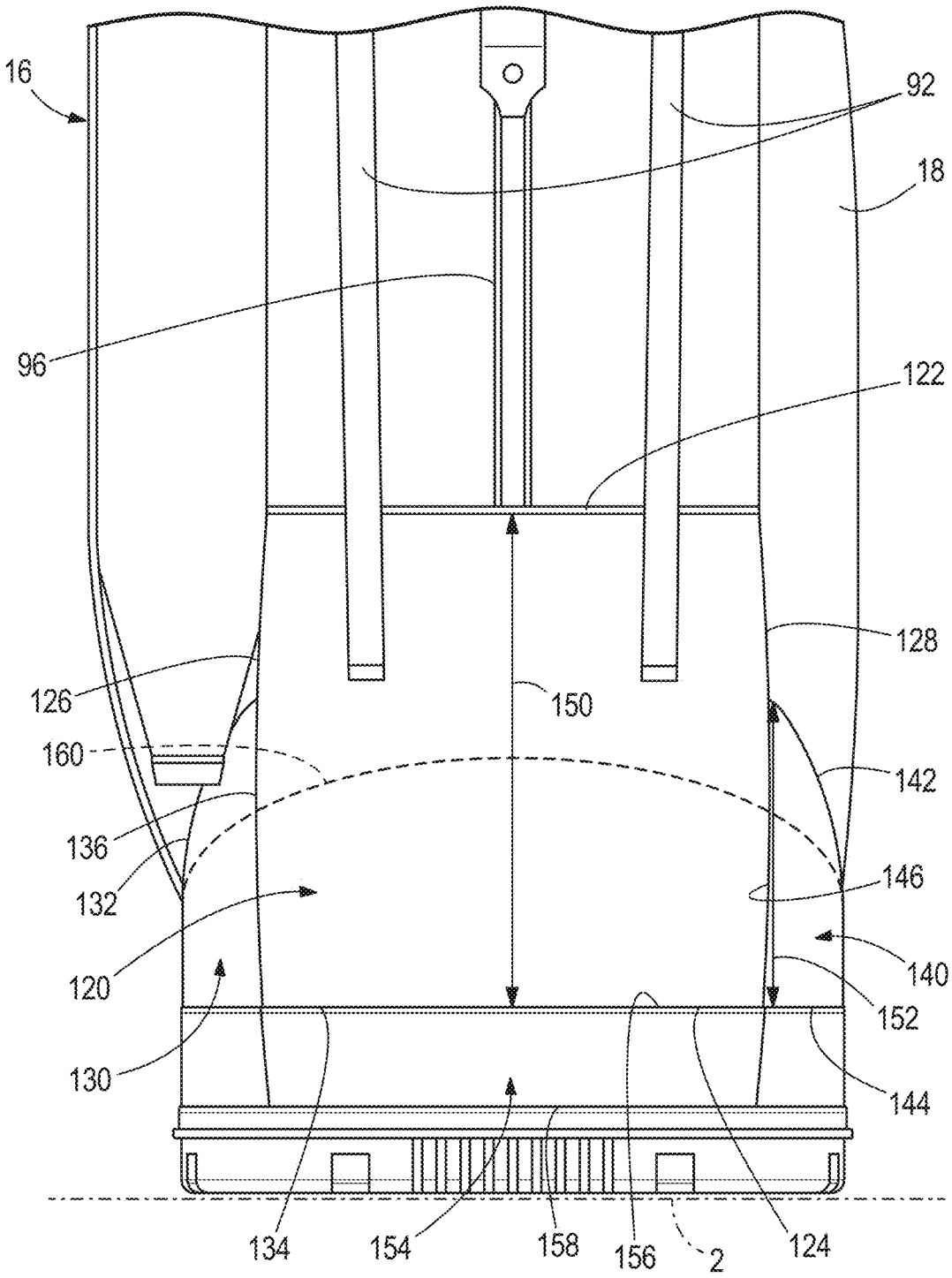
FIG. 10 illustrates a front view of a section of a golf bag in an upright position, according to one embodiment.
Figure 11:
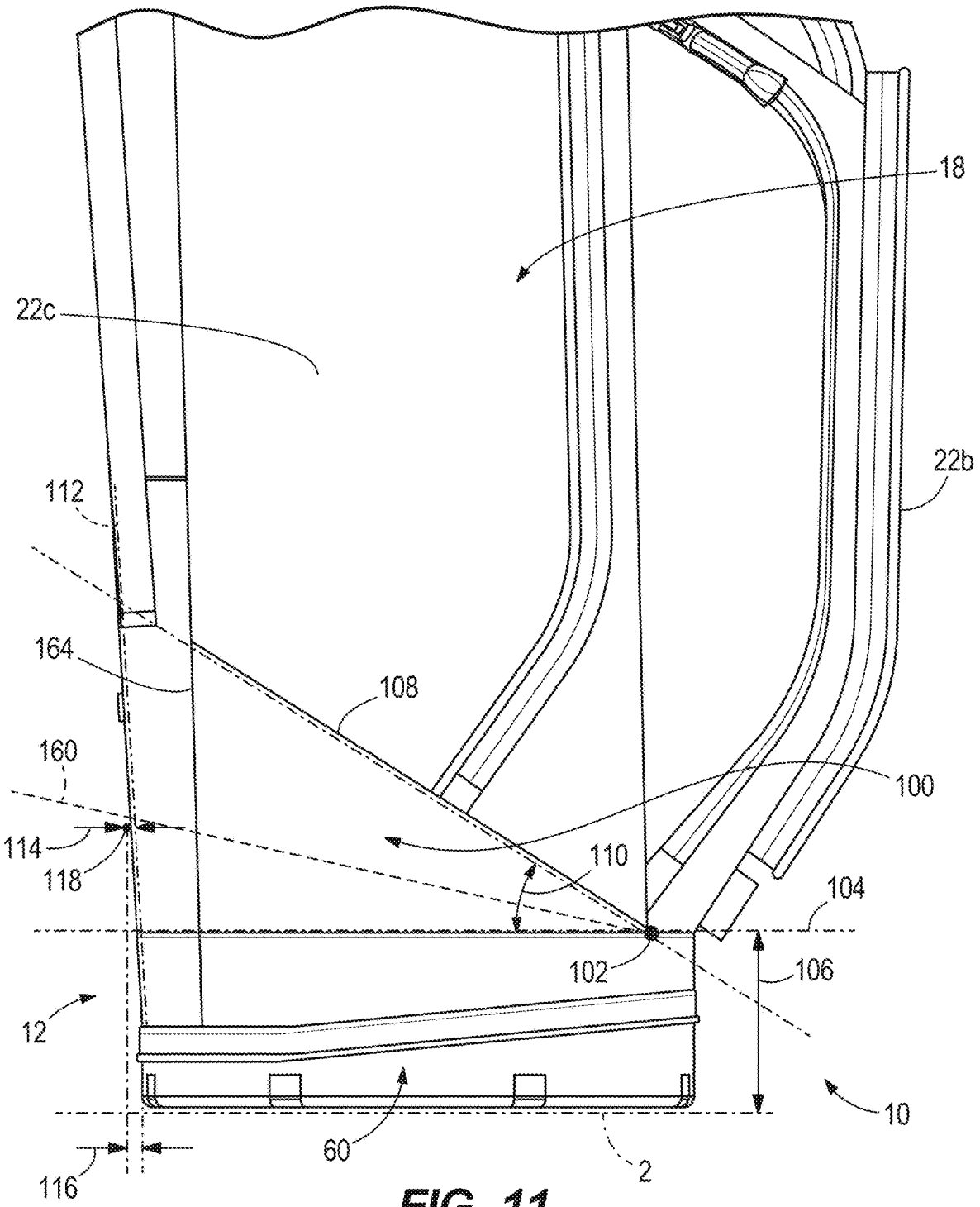
FIG. 11 illustrates a first side view of a section of a golf bag in an upright position, according to the embodiment of FIG. 10.

Referring to FIGS. 10-11, the crush zone 100 shape, from a side view, can be understood with respect to an extension plane 112. The extension plane 112 can extend roughly parallel to the front of the golf bag 10 from a bottom edge 124 to a top edge 122 of the crush zone 100. In the deployed configuration, the crush zone 100 can bulge perpendicularly outwards from the extension plane 112 by an extension distance 114 that is greater than the extension distance 114 when the crush zone 100 is in the upright configuration.

In the upright configuration, the crush zone 100 can bulge perpendicularly outwards (i.e. away from the hollow interior of the bag) from the extension plane 112 by an extension distance 114 of inclusively between 0 and 3 inches. In some embodiments, the extension distance 114 in the upright configuration ranges inclusively between 0 inches and 0.5 inches, 0.5 inches and 1 inch, 1 inch and 1.5 inches, 1.5 inches and 2 inches, 2 inches and 2.5 inches, or 2.5 inches and 3 inches. When the stand assembly 90 is deployed, the slight sagging or bulging of the crush zone 100 in the upright configuration biases the crush zone 100 fabric to collapse outwards from the hollow interior when the stand assembly 90 is deployed. In the deployed configuration, the referenced extension plane 112 can be angled as it follows the front angulation of the golf bag 10. In the deployed configuration, the extension distance 114 can range, inclusively, between 0 inches and 4 inches. The extension distance 114 deployed configuration can range, inclusively, between 0 inches and 0.5 inches, 0.5 inches and 1 inch, 1 inch and 1.5 inches, 1.5 inches 2 inches, 2 inches and 2.5 inches, 3 inches, 3 inches and 3.5 inches, or 3.5 inches and 4 inches.

The extension distance 114 can be, inclusively, between 30% and 80% greater in the deployed configuration than it is in the upright configuration. In some embodiments, the extension distance 114 can be, inclusively, between 30% and 50%, 40% and 60%, 50% and 70%, 50% and 80%, or 60% and 80% greater in the deployed configuration than it is in the upright configuration. This greater extension distance 114 in the deployed configuration shows that the crush zone 100 folds outwards from the hollow interior of the tubular body when the crush zone 100 collapses.

Figure 12:
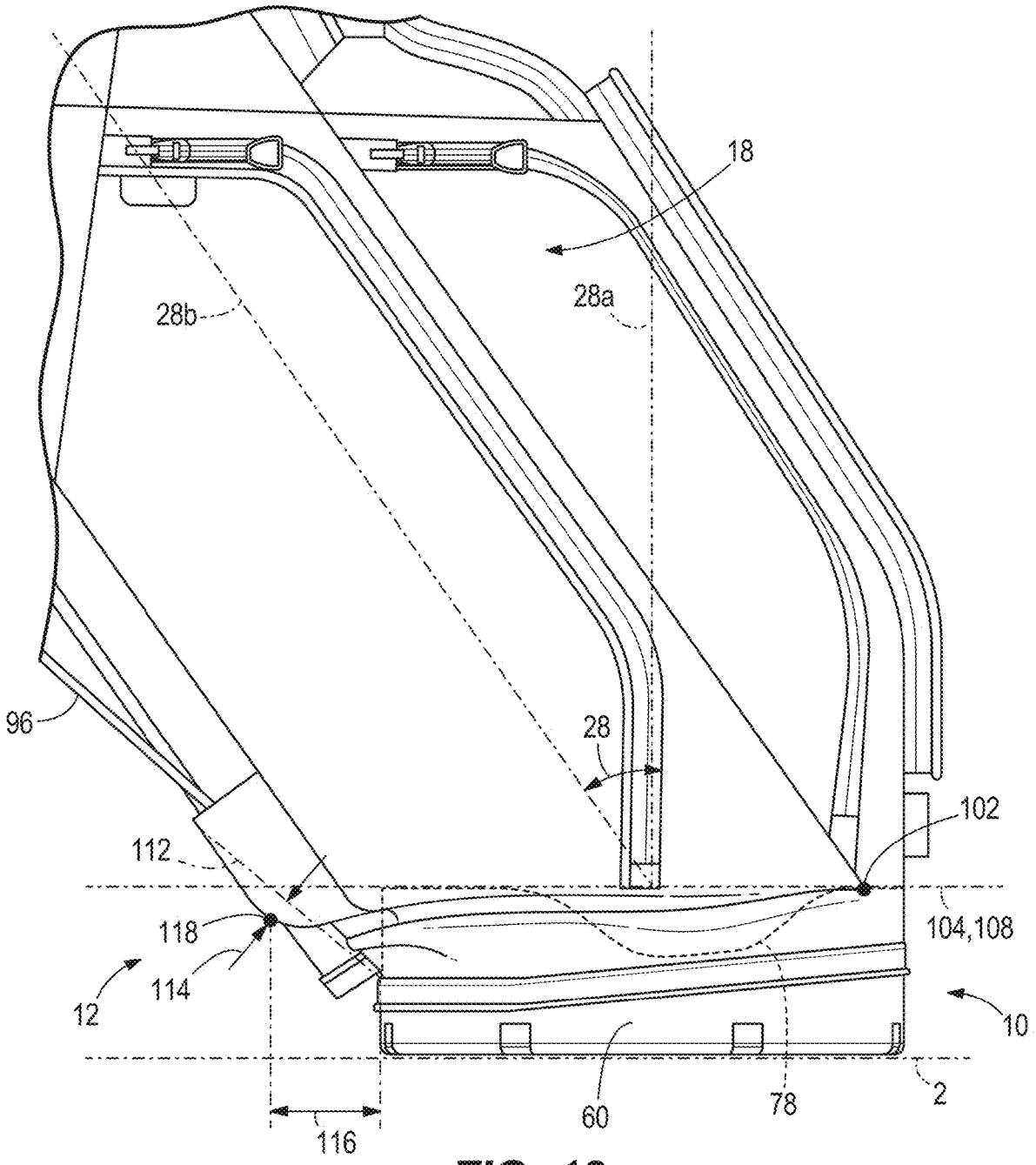
FIG. 12 illustrates a first side view of a section of a golf bag in a deployed position, according to the embodiment of FIG. 10.

Referring to FIGS. 10-12 the crush zone 100 shape, from a side view, can further be understood by means of a horizontal bulge distance 116. The horizontal bulge distance 116 is measured parallel to the ground plane 2 from the base 60 to a bulge point 118 of the crush zone 100, in a side view. In a side view, the crush zone 100 can have a front edge that is convex—with respect to the outside of the golf bag 10. The bulge point 118 can be the outermost extent of the convex front edge of the crush zone 100 in a side view. In other words, the horizontal bulge distance 116 is a measurement of how far the crush zone 100 extends forward of the base 60 horizontally. In the upright configuration, the horizontal bulge distance 116 can range, inclusively, between 0.25 and 2 inches. In some embodiments, the horizontal bulge distance 116 in the upright configuration can range, inclusively, between 0.25 inches and 1.0 inch, 1.0 inch and 1.5 inches, or 1.5 inches and 2.0 inches. When the stand assembly 90 is deployed, the crush zone 100 folds or collapses outwards from the hollow interior, causing the horizontal bulge distance 116 to increase. In the deployed configuration, the horizontal bulge distance 116 can range, inclusively, between 0.5 inches and 4.25 inches. In some embodiments, the horizontal bulge distance 116 in the deployed configuration can range, inclusively between. 5 inches and 1.0 inches, 1.0 inches and 1.5 inches, 1.5 inches and 2.0 inches, 2.0 inches and 2.5 inches, 2.5 inches and 3.0 inches, 3.0 inches and 3.5 inches, 3.5 inches and 4.0 inches, or 4.0 inches and 4.25 inches.

In the deployed configuration, the crush zone 100 can bulge horizontally outwards by a horizontal bulge distance 116 that is greater than the horizontal bulge distance 116 when the crush zone 100 is in the upright configuration. The horizontal bulge distance 116 can be, inclusively, between 30% and 95% greater in the deployed configuration than it is in the upright configuration. In some embodiments, the horizontal bulge distance 116 can be, inclusively, between 30% and 50%, 40% and 60%, 50% and 70%, 50% and 95%, 60% and 95%, 70% and 95%, or 80% and 95% greater in the deployed configuration than it is in the upright configuration. This greater horizontal bulge distance 116 in the deployed configuration shows that the crush zone 100 folds outward from the hollow interior of the tubular body when the crush zone 100 collapses. In the upright position, the horizontal bulge distance 116 can range, inclusively, between 0 cm and 4 cm. In some embodiments, the horizontal bulge distance 116 can range, inclusively, between 0 and 0.5 cm, 0.5 cm and 1 cm, 1 cm and 2 cm, 2 cm and 3 cm, 3 cm and 4 cm, 1 cm and 3 cm, or 1.5 cm and 2.5 cm.

The size of the crush zone 100 can be dependent on the bag angle 28 at which the golf bag 10 rests with respect to the ground plane 2 when the legs 92 are deployed (i.e. the bag angle 28 in the deployed configuration). For legs 92 that extend a short distance from the base 60, the flat 20 and the crush zone 100 can be relatively small since the bag angle 28 is shallow. For legs 92 that extend further away from the base 60, the crush zone 100 can be relatively large to accommodate the larger bag angle 28.

Referring to FIG. 10, from a side view, the size of the crush zone 100 can be characterized, in part, by an upper angled plane 108. The upper angled plane 108 can extend from the pivot point 102 towards the front 12 of the golf bag 10, above the pivot reference plane 104. In some embodiments, the upper angled plane 108 can be defined to extend through the pivot point 102 and roughly parallel to a bottom edge of one or more of the apparel pocket 22*a* and/or the side accessory pocket 22*c*. From the side view, in some embodiments, the crush zone 100 does not extend above (or is located fully below) the upper angled plane 108. In some embodiments, the crush zone 100 of the flat 20 can be confined or bounded below the upper angled plane 108.

The bag angle 28 in the deployed configuration correlates to the position of the upper angled plane 108 that bounds the crush zone 100. The apparel pocket 22*a*, side accessory pocket 22*c*, and/or any pockets 22 on the first or second side of the golf bag 16 and 18 must be located above upper angled plane 108, so that the pockets 22 do not interfere with the bending of the crush zone fabric when the golf bag stand assembly 90 deploys.

From the side view, an upper reference angle 110 can be measured about the pivot point 102 between the pivot reference plane 104 and the upper angled plane 108. In the upright configuration, the upper reference angle 110 can be between 20 degrees and 60 degrees. In some embodiments, the upper reference angle 110, in the upright configuration, can be between 20 degrees to 25 degrees, 25 degrees to 30 degrees, 30 degrees to 35 degrees, 30 degrees and 40 degrees, 35 degrees to 40 degrees, 40 degrees to 45 degrees, 45 degrees to 50 degrees, 50 degrees to 55 degrees, or 55 degrees to 60 degrees. In some embodiments, the upper reference angle 110, in the upright configuration, can be greater than 20 degrees, greater than 30 degrees, greater than 40 degrees, greater than 45 degrees, greater than 50 degrees, less than 60 degrees, less than 50 degrees, less than 45 degrees, less than 40 degrees, or less than 30 degrees. In the upright configuration, a smaller upper reference angle 110 corresponds to a smaller crush zone 100, and a larger upper reference angle 110 corresponds to a larger crush zone 100. In some examples, the upper reference angle 110, in the upright configuration, can be 20 degrees, 25 degrees, 30 degrees, 35 degrees, 40 degrees, 45 degrees, 50 degrees, 55 degrees, or 60 degrees.

As the stand assembly 90 deploys, the upper angled plane 108 can approach the pivot plane 104, causing the upper reference angle 110 to dynamically decrease. In other words, the upper reference angle 110 can decrease as the bag angle 28 increases. Therefore, in the deployed configuration, the upper reference angle 110 can be between 0 degrees and 30 degrees. In some embodiments, the upper reference angle 110, in the deployed configuration, can be between 0 degrees to 5 degrees, 0 degrees to 10 degrees, 0 degrees to 15 degrees, 0 degrees and 20 degrees, 10 degrees to 20 degrees, or 15 degrees to 30 degrees. In some embodiments, the upper reference angle 110, in the deployed configuration, can be less than 30 degrees, less than 25 degrees, less than 20 degrees, less than 15 degrees, or less than 10 degrees.

In some embodiments, when the golf bag 10 is in the upright position, the entire crush zone 100 can be located between 0.5 inch and 12 inches above the ground plane 2. In some embodiments, when the golf bag 10 is in the upright position, the entire crush zone 100 can be located in a region extending above the ground plane 2 by between 0.5 inch and 6 inch, 1 inch and 6 inches, 2 inches and 6 inches, 1 inch and 12 inches, 1 inch and 11 inches, 1 inch and 10 inches, 1 inch and 9 inches, 1 inch and 8 inches, 1 inch and 7 inches, 1 inch and 6 inches, 2 inches and 12 inches, 2 inches and 11 inches, 2 inches and 10 inches, 2 inches and 9 inches, 2 inches and 8 inches, 2 inches and 7 inches, 2 inches and 6 inches, 3 inches and 12 inches, 3 inches and 11 inches, 3 inches and 10 inches, 3 inches and 9 inches, 3 inches and 8 inches, 4 inches and 12 inches, 4 inches and 11 inches, 4 inches and 10 inches, 4 inches and 9 inches, 5 inches and 12 inches, 5 inches and 11 inches, or 5 inches and 10 inches. The entire crush zone 100 can be located within a lower quarter of the golf bag 10, because when the legs 92 are extended, no more than the lowest quarter of the flat 20 endures bending, collapsing, and/or folding.

The crush zone size and function can further be characterized by a crush zone height 180. A height of the crush zone 180 alone, not including the entire base height, can be measured orthogonal to the ground plane 2 from a bottom edge 124 of the crush zone 100 to a top edge 122 of the crush zone 100 at the front 12 of the golf bag 12. The crush zone height 180 in the upright configuration can range, inclusively, between 2 and 15 inches. In some embodiments, the crush zone height 180 in the upright configuration can range, inclusively, between 2 inches and 5 inches, 5 inches and 7 inches, 7 inches and 9 inches, 9 inches and 11 inches, 11 inches and 13 inches, or 13 inches and 15 inches. The crush zone height 180 in the deployed configuration can be smaller than the crush zone height 180 in the upright configuration and can range, inclusively, between 2 and 12 inches. In some examples, the crush zone height 180 in the deployed configuration can range, inclusively, between 2 inches and 4 inches, 4 inches and 6 inches, 6 inches and 8 inches, 8 inches and 10 inches, or 10 inches and 12 inches. A ratio of the crush zone height 180 in the upright configuration to the crush zone height 180 in the deployed configuration can be between 2:1 and 8:1. In some embodiments, the ratio of the crush zone height 180 in the upright configuration to the crush zone height 180 in the deployed configuration can be between 2:1 and 3:1, 3:1 and 4:1, 4:1 and 5:1, 5:1 and 6:1, 6:1 and 7:1, 7:1 and 8:1, 2:1 and 4:1, 3:1 and 5:1, 4:1 and 6:1, 5:1 and 7:1, or 6:1 and 8:1.

The crush zone 100 can fold along one or more folding lines, such as folding line 160. In some embodiments, the crush zone 100 folds along a seam 160, as shown in FIGS. 9-12. In some embodiments, in the upright configuration, the folding line 160 can bulge outwards (i.e. away from the hollow interior of the bag body) to bias the crush zone 100 to fold outwards when the stand assembly 90 is deployed. Upon deployment of the stand assembly 90, the folding line 160 can move outwards, away from a hollow interior of the golf bag 10, to preserve base useful area 640.

Various panel and stitching patterns can be employed to achieve the desired crush zone size and shape, described above. In a first embodiment of the crush zone 100, a tall panel 120 can be centrally located and can be sewn to one side of each triangular side panel 130, 140. The tall panel 120 can be sized to naturally have slack. The combination of the natural slack of the tall panel 120 and the angulation of the side seams 136, 146 can bias the flat fabric within the crush zone 100 to fold outwards.

In a second embodiment of the crush zone 200, as discussed below, an upper panel 220 and a lower panel 230 can extend from the first side 16 of the golf bag 10, across the front 12, and to a second side 18 of the golf bag 10. The upper and lower panels 220, 230 can be slightly angled with respect to one another and can be connected by a folding seam 224, 234, along which the crush zone 200 bends outwards when the stand assembly 90 is deployed.

In a third embodiment of the crush zone 300, as discussed below, four panels can be used to form bending zones on either side 16, 18 of the golf bag 10. The third embodiment can function similarly to the second embodiment, except that the panels of the third embodiment are separated at the front 12 of the golf bag 10 by a pointed panel 350.

In a fourth embodiment of the crush zone 400, as discussed below, darting can be used to shape the fabric within the crush zone 400 to bulge slightly outwards. Darting is a technique used for shaping fabric in which a triangular shape is removed or pinched from the fabric and the remaining adjacent seams are sewn together. The darting can extend upwards or downwards from an edge of the crush zone 400 toward a center of the crush zone 400. In a fifth embodiment, the crush zone 500 can have an accordion design that allows the flat fabric to fold over itself.

In golf bags without a crush zone 100, the fabric flat 20 can collapse inwards and overlap a portion of a base bottom panel 68, reducing the amount of useful area available for supporting golf clubs on the inner surface of the bottom panel 68. As shown in FIG. 1, this collapse of the flat fabric 20 inwards causes the grips 8 of the golf club to be constricted, confined, or contained within a smaller area. If the golf club grips 8 are constricted too tightly, they can tangle and interfere with each other, making it challenging to pull the golf clubs 4 out of the golf bag 10. The herein described golf bag 10 with the fold out crush zone 100 comprises a greater base useful area 640 than golf bags lacking the fold out crush zone 100. When the golf bag 10 is in the deployed configuration, the flat fabric 20 within the crush zone 100 does not greatly constrict the grips 8 of the golf clubs 4 that are stored within the bag 10. By folding outwards, the crush zone 100 frees up space within the hollow interior of the golf bag 10, preventing the golf club grips 8 from tangling, binding up, or otherwise interlocking within the hollow interior adjacent the base 60.

Referring to FIG. 1, a comparative golf bag can comprise a base that remains flush with the ground in the deployed position. However, the comparative golf bag has a traditional flat, lacking the crush zone described herein. When the comparative golf bag is moved from the upright position to the deployed position, the flat fabric within a crush region collapses or crumples inwards. The collapsed fabric overlaps a portion of a base main panel, reducing the amount of useful area available for supporting golf clubs on the inner surface of the base main panel. As shown in FIG. 1, this collapse of the flat fabric inwards causes the grips of the golf club to be constricted, confined, or contained within a smaller area. If the golf club grips are constricted too tightly, they can tangle and interfere with each other, making it challenging to pull the golf clubs out of the golf bag. The comparative golf bag base inner surface can comprise a total area, which is the sum of an overlapped area and a useful area. The overlapped area can also be called a fold-occupied area, an unusable area, or an obstructed area. The overlapped area can comprise between 15% and 25% of the total area. In some embodiments, the overlapped area of the comparative golf bag can comprise between 15% and 20%, 18% and 22%, or 20% and 25% of the total area of the base inner surface.

Referring to FIG. 12, in the herein described golf bag, a majority of the fabric is directed outwards due to the structure of the crush zone 100, as described above. Only a small portion of the fabric folds in a way that overlaps a portion of the base bottom panel 68. This limited overlapping preserves base useful area 640 on the inner surface 62 of the base bottom panel 68. The base inner surface 62 comprises a total area, which is the sum of an overlapped area and a useful area. The overlapped area of the golf bag with the fold out crush zone can be between 0% and 8%. In some embodiments, the overlapped area can be 0%, 1%, 2%, 3%, 4%, 5%, 6%, 7%, or 8% of the total area of the base inner surface 62. Consequently, the base useful area 640 can be between 92% and 100%. In some embodiments, the base useful area 640 can be 92%, 93%, 94%, 95%, 96%, 97%, 98%, 99%, or 100%. The outward folding of the crush zone 100 preserves base useful area 640, leaving ample space in the hollow interior for the golf club grips 8 to remain untangled. In this way, the crush zone 100 prevents the golf clubs 4 from getting trapped within the golf bag 10.

II. BASE RING

During use of the golf bag, fabric portions of the flat can crumple, especially near the base, restricting the available area for the golf clubs. Because the grips lie at the base of the golf bag, the area restriction of the base can shift the grips inwards and cause club entanglement. The golf bag described herein comprises a base ring 74 to prevent the golf bag flat from crumping inward and restricting available area for the clubs within the bag.

Another anti-tangle feature, the base ring 74, can be configured to restrict flat fabric from folding into the hollow interior of the golf bag. The base ring 74 can comprise a front, a first side, a second side, and a back corresponding to the front 12, first side 16, second side 18, and back 14 of the bag 10. The base ring 74 can further comprise an upper wall 76, a lower wall 82, and a lip 80 between the upper and lower walls 76, 82. The lip 80 can protrude from the base ring 74 slightly in order to distinguish and separate, or border, the upper wall 76 and lower wall 82. The lip 80 can comprise a width measured from the base walls outward, ranging inclusively from 1 mm to 10 mm. In some embodiments, the lip 80 can be 1 mm, 2 mm, 3 mm, 4 mm, 5 mm, 6 mm, 7 mm, 8 mm, 9 mm, or 10 mm in width. The base ring 74 interacts with the base 60 such that the ring lower wall 82 is received by the base receiving wall 70. The lip of the base ring 80 abuts the upper edge 78 of the base receiving wall 70 and supports the base ring 74 atop the base 60. In many embodiments, the lower wall 82 of the base ring 82 can extend into the base receiving wall 70 until the lip 80 connects with the receiving wall edge 71. In some embodiments, the flat 20 can be sewn to the base ring 74 prior to the ring 74 being snapped or attached to the base 60.

In many embodiments, the flat 20 can be sewn or attached to the base ring 74 near the lip 80. This provides the flat 20 fabric a range of motion between the upright and deployed positions. The flat 20 moves forward into the bag angle 28 when the bag 10 is deployed. Thus, a range of motion around the base ring 74 is essential for bag 10 deployment. In embodiments in which the golf bag 10 comprises a crush zone 100, the crush zone 100 may interact with the base ring 74 to prevent the fabric of the flat 20 from disturbing the hollow interior of the base 60 where the club grips 8 lie. The base ring 74 may act as a barrier between the flat 20 and hollow interior of the base 60 when the golf bag 10 is in the deployed position, preventing the fabric from pushing against the interior grips 8. As discussed below and in embodiments 100, 200, 300, 400, 500 of the crush zone, the base ring 74 coordinates the folding of the flat 20 around the base ring upper wall 76. For example, when the golf bag 10 stand assembly 90 deploys, a portion of the bag 10 hollow interior below the pivot plane 104 can remain relatively undisturbed. This preservation of space occurs because the base ring 74 can at least partially extend up to the pivot plane 104 and the base 60 remains flush against the ground plane 2 even in the deployed configuration. The undisturbed storage space within the tubular body retains space for the grip of the golf clubs. The undisturbed space allows a golfer to remove and replace golf clubs 4 with relative ease while the golf bag 10 is in the deployed configuration.

The base ring 74 can further comprise an upper edge 78 of the upper wall 76. The base ring 74 in combination with the base 60 defines a height 75 between the ground plane 2 and the upper edge 78 of the base ring 76. Because the lower walls 82 of the base ring 74 overlap with the height of the base, the height 75 between the ground plane 2 and upper edge of the base ring 78 can be determined by the height of the upper wall 76 of the base ring 74 plus the height of the base 60. In some embodiments, the height 75 between the ground plane 2 and upper edge 78 of the base ring 76 is not the same across the front and back 12, 14 of the golf bag 10 In other embodiments, the height 75 of the base 60 plus the base ring 74 can define a plane parallel to the ground plane 2. This plane can define or coincide with the pivot plane 104 to prevent fabric of the crush zone 100 from disturbing the hollow interior of the golf bag 10 when the bag 10 is in the deployed position. The height 75 between the upper edge 78 and the ground plane 2 can range inclusively between 2 and 10 cm. The height 75 between the upper edge 78 and the ground plane 2 can be between 2 cm and 4 cm, 4 cm and 6 cm, 6 cm and 8 cm, or 8 cm and 10 cm. In some embodiments, the lowest height between the ground plane 2 and upper edge 78 is 2.5 cm, while the largest height between the ground plane 2 and upper edge 78 is 6.5 cm.

The shape of the base ring 74 is configured to interact with the fabric of the crush zone 100 and guide the fabric of the crush zone 100 around the base ring 74 to allow the crush zone 100 to fully collapse. When the golf bag 10 moves into the deployed position, the crush zone bulge point 118 lowers toward the pivot plane 104 as described above. The upper walls 76 on the front of the base ring 74 create a barrier against the fabric collected below the pivot plane 104 in order to prevent the crush zone 100 from entering the hollow interior of the base 60. The connection points, or seams 174, of the crush zone 100 to the bag flat 20 may pull or create tension on the sides of the crush zone 100 when this occurs. In order to prevent this tension from interfering with the crush zone 100 or golf bag 10 deployment, the base ring 74 can comprise a first side cut out 88*b* and a second side cut out 88*c*. The first side cut out 88*b* may be located on the upper wall of the first side of the base ring accordingly. The second side cut out 88*c* may be located on the upper wall 76 of the second side of the base ring accordingly. The first and second side cut outs 88*b* and 88*c* may allow the crush zone 100 to slightly enter the hollow interior of the bag 10. When the bag 10 moves into the deployed position, the seams 174 where the crush zone 100 connects to the bag flat 20 on either side 16 and 18 of the bag 10 tighten and pull at the fabric of the crush zone 100 on either side. This results in tension that can prevent the crush zone 100 from folding properly and interfering with overall bag 10 deployment. The fabric that enters at these side cut outs 88*b* and 88*c* allows the crush zone 100 to enter the bag 10 hollow interior slightly at either side 16 and 18 of the bag 10 and prevents the aforementioned tension at the seams 174. Upon deployment of the golf bag 10, the side cut outs 88*b* and 88*c* are formed from the upper walls 76, which guides the crush zone 10 below the pivot plane 104 into the collapsed position.

As discussed below and in embodiments 100, 200, 300, 400, 500 of the crush zone, the base ring 74 coordinates the folding of the flat 20 around the base ring upper wall 76. The amount of fabric that enters the first and second side of the base ring through the side cuts outs 88*b* and 88*c* does not typically interfere with the grips 8 of the golf club 4 heads as the club grips 8 do not lie proximal enough to the upper wall of the base ring 76 at the first and second sides for the fabric to reach and push clubs 4 inward. The fabric of the crush zone 100 that enters the base 60 hollow interior at the first and second cut out 88*b* and 88*c* when the bag 10 is in the deployed position may range between 2-10% of the base 10 useful area. For example, the amount of fabric that enters through the first and second side cut outs 88*b* and 88*c* when the bag 10 is in the deployed position can cover, in combination, between 2% and 4%, 4% and 6%, 6% and 8%, or 8% and 10% of the base 60 useful area. As mentioned above, this area does not affect the shifting of the club grips 8 due to the location of the fabric and the low amount of area intruding into the hollow interior of the bag 10.

Figure 9A:
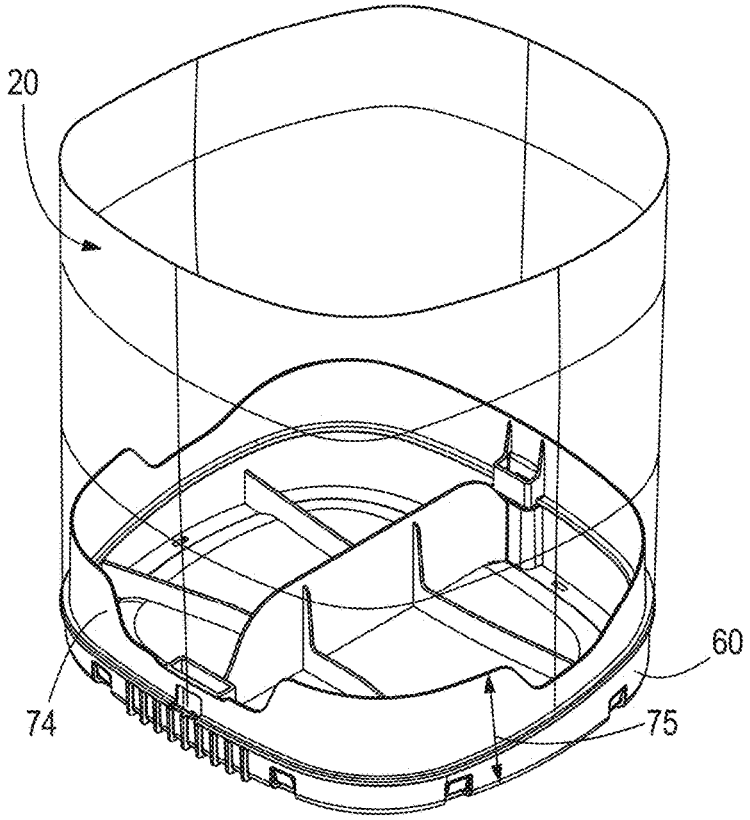
FIG. 9A illustrates a perspective view of a section of a golf bag with a flat and a ring in the upright position, according to an embodiment.
Figure 9B:
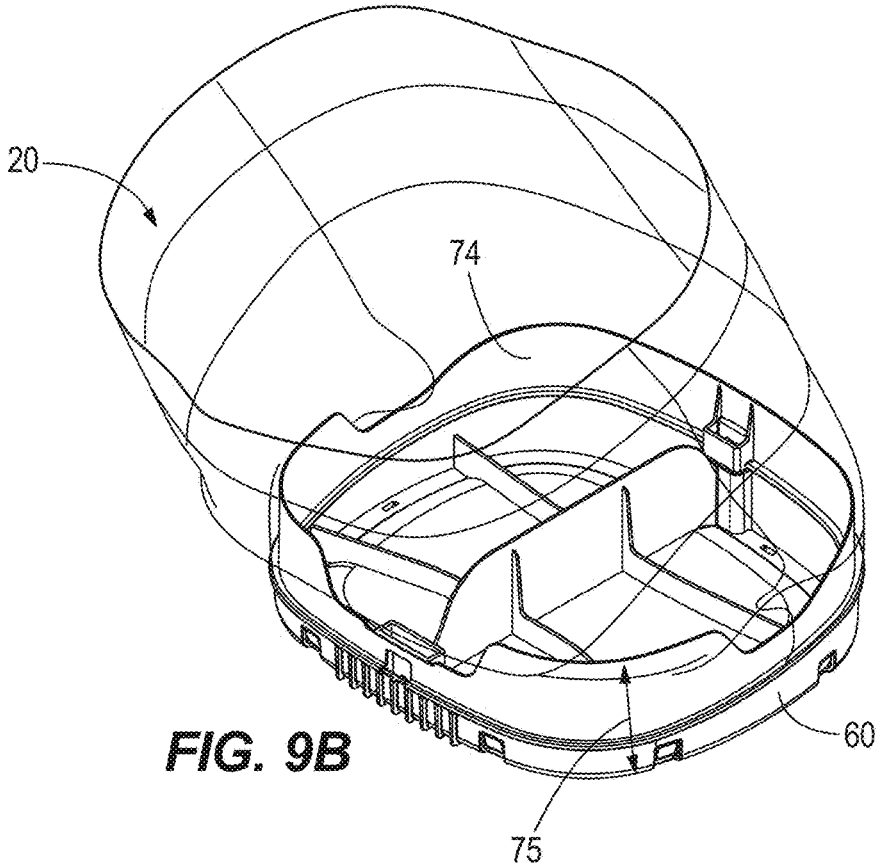
FIG. 9B illustrates a perspective view of a section of a golf bag with a flat and a ring in the deployed position, according to an embodiment.

The outwards collapse of the crush zone 100 fabric at the front 12 of the golf bag 10 and the consequential pulling inwards of fabric at the first and second side of the base ring 60 forms a pseudo-S-shape (i.e. the fabric bends with a pseudo S-shape) from above on either side of the base ring 60 when the golf bag 10 is in the deployed position, as seen in FIGS. 9A and 9B. This fabric configuration is a direct result of the base ring 60 geometry, allowing the crush zone 100 to fully collapse when the bag 10 is deployed and preventing the collapse of fabric from caving into the hollow interior of the bag 10 where club grips 8 would be shifted.

The base ring 74 can further comprise a stay port 84 at the back of the base ring 74 configured to receive the lower hinge of the stay 58. The lower hinge of the stay 58 can pivotably connect with the stay port 84 in order to allow the stay 54 to swing between the upright and deployed positions while the base 60 remains flush with the ground plane 2 between positions. The base ring 74 can further comprise a spring port 86 at the front of the base ring 74 configured to receive the spring 96. Similarly, the spring 96 may pivotably connect with the spring port 86 in order to allow the spring 96 to swing between the upright and deployed positions while the base 60 remains flush with the ground plane 2. When the bag 10 is in the deployed position, the spring 96 may also prevent crush zone 100 fabric from caving into the hollow interior of the bag 10 at the front of the base ring 74. The spring 96 accomplishes this by forming a physical block between the front of the base ring 74 and hollow interior of the bag 10. In some embodiments, the upper wall of the base ring 76 can further comprise a cut out portion at the front of the base ring 88*a*. This front cut out portion 88*a* allows for the spring 96 to move forward at the bag angle 28 when the golf bag 10 is deployed. The front cut out portion 88*a* also reduces material of the base ring 74, resulting in a lighter bag 10.

When the golf bag 10 moves into the deployed position, the crush zone 100 gathers around the base ring 74, as mentioned above. The front of the base ring 74 acts as a barrier and prevents the material of the crush zone 100 from entering into the interior space of the golf bag 10 and restricting useful area. If the material of the crush zone 100 were to bunch solely at the front base ring 74, the high concentration of fabric may cause resistance or prevent the golf bag 10 from moving fully into the deployed position. In order for the crush zone 100 to fully collapse, the fabric of the crush zone 100 is guided into an S-shape configuration around the base ring 74. When the front of the crush zone 100 bunches around the front of the base ring 74, the corners of the crush zone 100 are inclined to flare outward. This results in a pull on the sides of the crush zone 130 and 140. In order for the sides of the crush zone 130 and 140 to collapse fully as well, the sides of the crush zone 130 and 140 partially enter the side cut-outs of the base ring 88*b* and 88*c*. Thus, the fabric of the crush zone 100 creates an S-shape around either side of the base ring 74 for optimal useful area while still allowing for proper bag 10 deployment. The crush zone 100 bunching pattern of the golf bag 10 described herein allows proper outward bending of the crush zone 100 at the front 12 of the golf bag 10 while enabling the golf bag 10 to properly extend into the deployed position.

III. EMBODIMENT 1 OF THE CRUSH ZONE

In some embodiments, the golf bag 10, as described above, can comprise a crush zone 100 as described below, according to a first embodiment. Referring to FIGS. 10-15, the crush zone 100 can comprise a center panel 120 connected to two side panels 130 and 140. The crush zone 100 can also comprise a circumscribing panel 154, that is positioned below the center 120 and side panels 130 and 140. This design provides fabric slack, especially within the center panel 120. The fabric slack biases the first crush zone 100 to fold outwards when the stand assembly 90 is deployed.

In some embodiments, the center panel 120 can be taller than the first and second side panels 130, 140. The center panel 120 can be roughly rectangular. The first and second side panels 130, 140 can each be roughly triangular. In some embodiments, the first and second side panels 130, 140 can be achiral, or mirror images of one another. The center panel 120 can be located on the front 12 of the golf bag 10. The first and second side panels 130, 140 can be located, at least partially, on the first and second sides 16, 18 of the golf bag 10. The circumscribing panel 154 can be sewn between the center and side panels 120, 130, and 140 and the base 60.

Figure 13A:
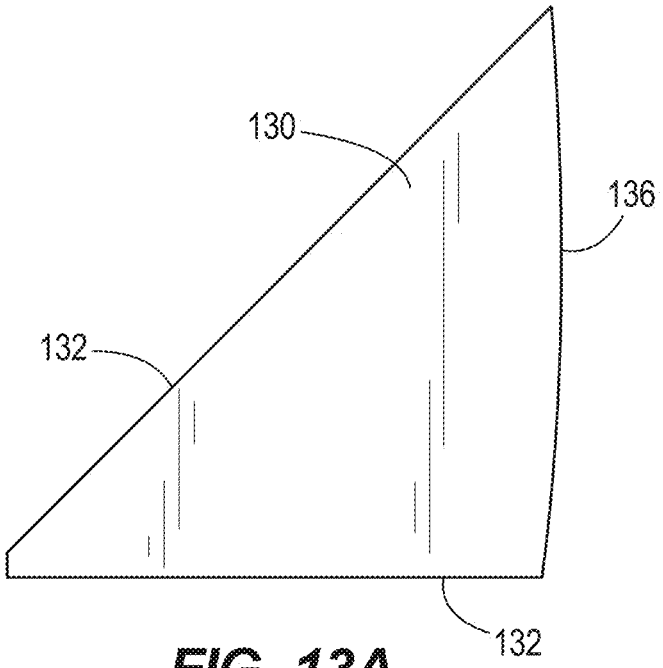
FIG. 13A illustrates a 2D view of a first side panel pattern, according to the embodiment of FIG. 10.
Figure 13B:
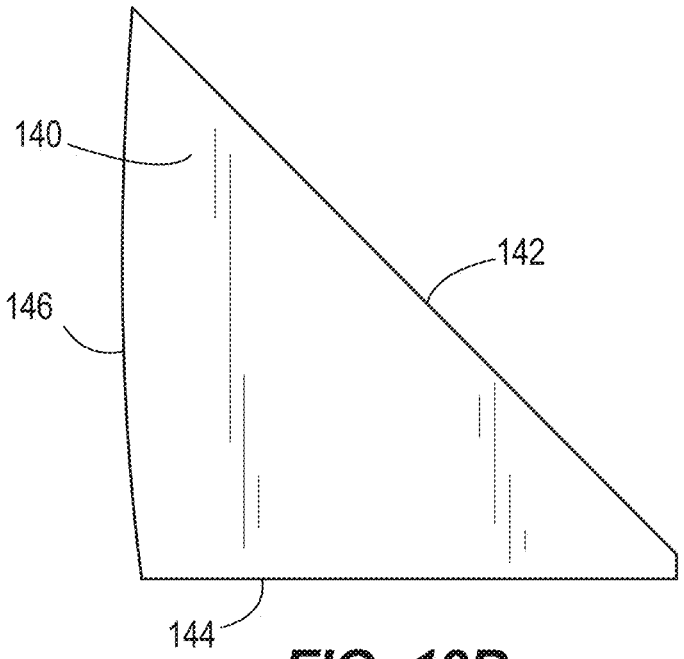
FIG. 13B illustrates a 2D view of a second side panel pattern, according to the embodiment of FIG. 10.
Figure 13C:
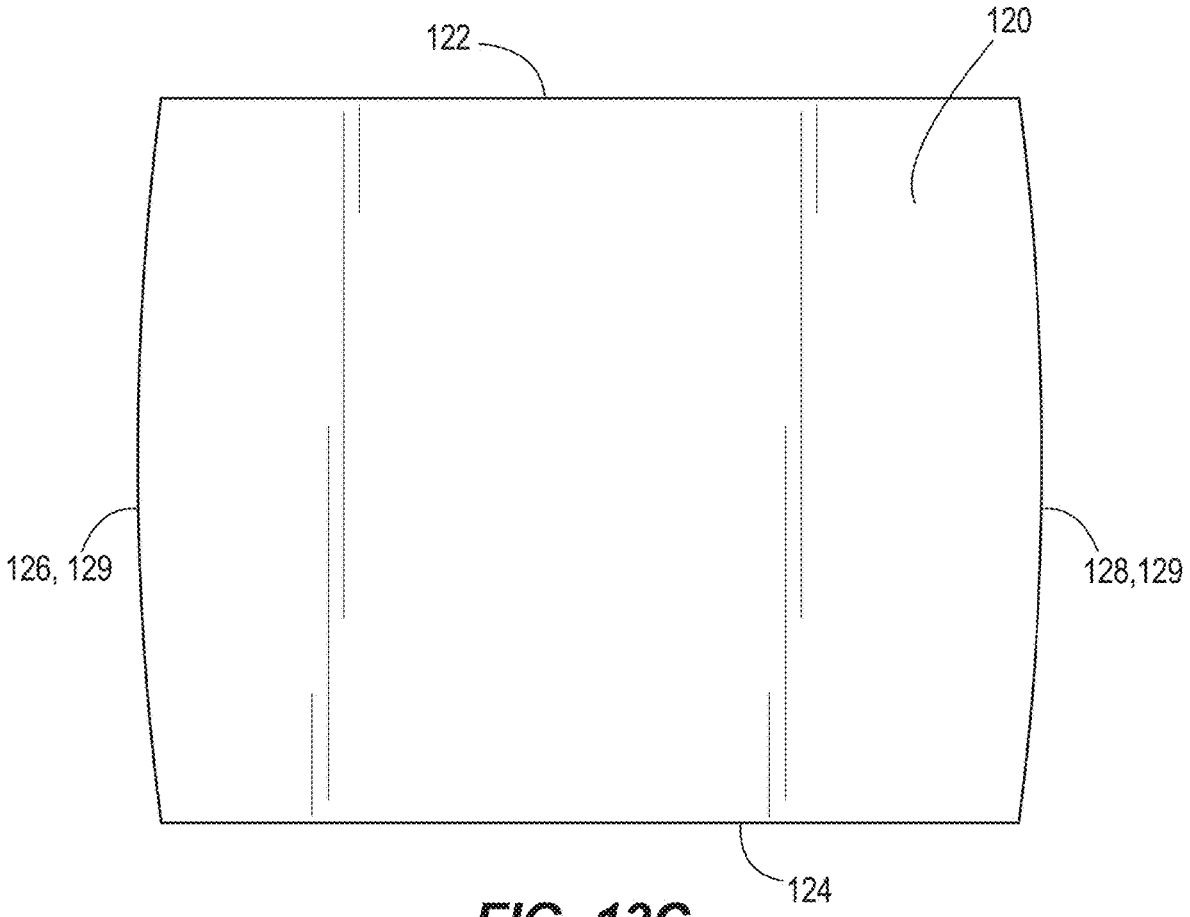
FIG. 13C illustrates a 2D view of a main panel pattern, according to the embodiment of FIG. 10.
Figure 14:
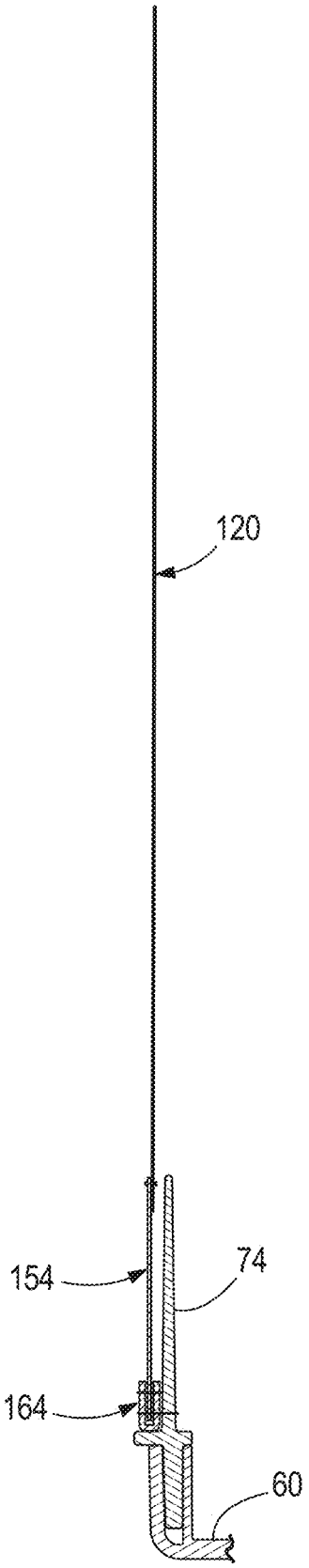
FIG. 14 illustrates a cross sectional view of a section of the golf bag in the upright position, according to one embodiment.
Figure 15:
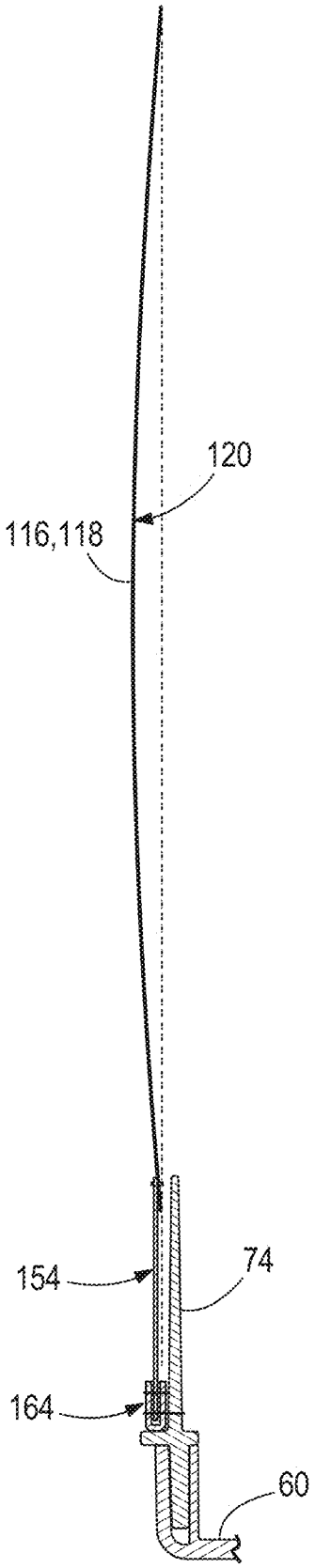
FIG. 15 illustrates a cross sectional view of a section of the golf bag in the upright position, according to the embodiment of FIG. 10.
Figure 16:
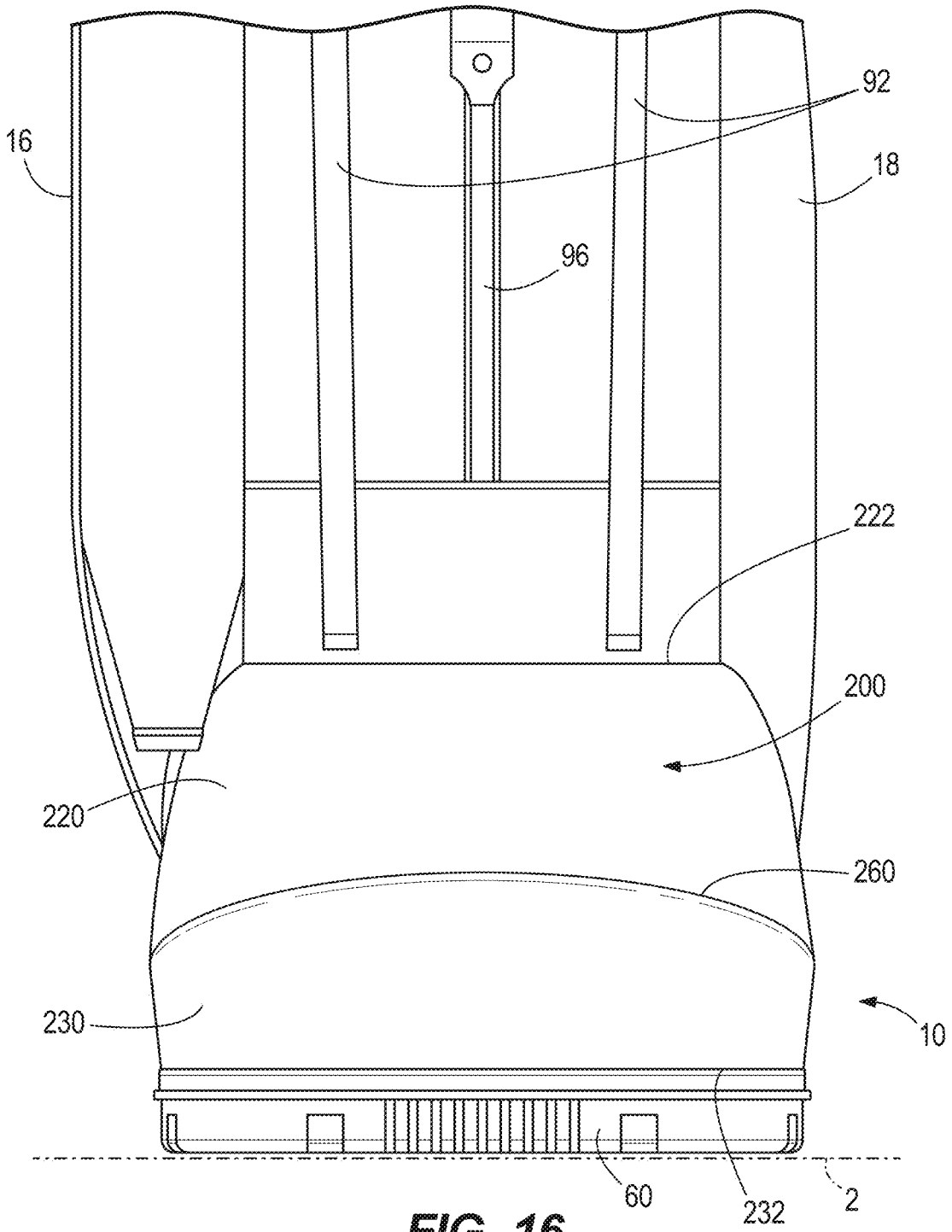
FIG. 16 illustrates a front view of a section of a golf bag in an upright position, according to a second embodiment.
Figure 17:
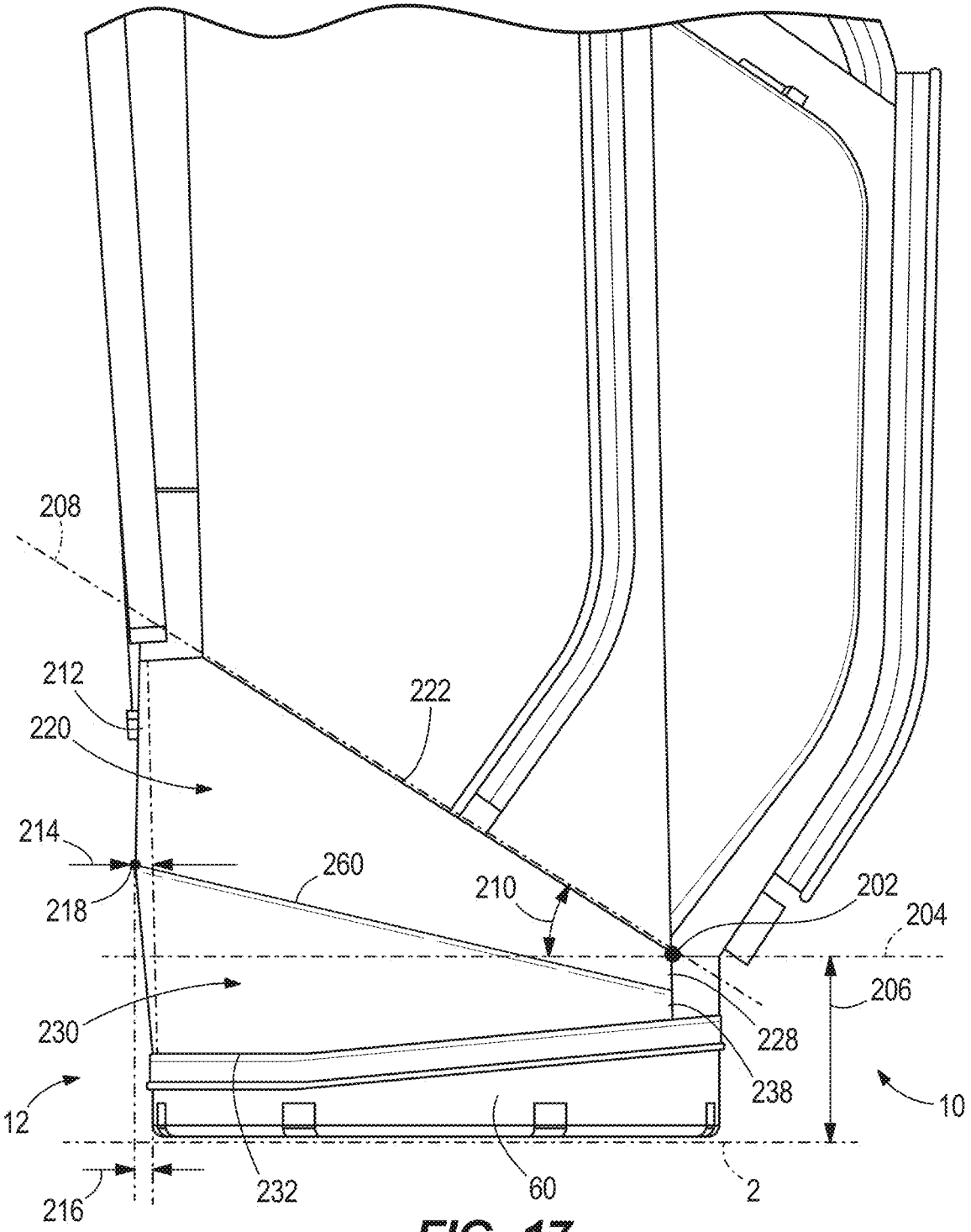
FIG. 17 illustrates a first side view of a section of a golf bag in an upright position, according to the embodiment of FIG. 16.

Referring to FIG. 13C, the center panel 120 can comprise a top edge 122, bottom edge 124, first side edge 126, and second side edge 128. Each of the center panel 120 and two side panels 130 and 140 can comprise curved seams 164 along at least one edge. The first and second side edges 126, 128 can be curved. The radius of curvature of the first and second side edges 126, 128 can be between 70 cm and 90 cm. In some embodiments, the radius of curvature of the first and second side edges 126, 128 can be between 70 cm and 75 cm, 75 cm and 80 cm, 80 cm and 85 cm, or 85 cm and 90 cm. In some examples, the radius of curvature of the first side edge 126 and the second side edge 128 can be 70 cm, 72 cm, 74 cm, 76 cm, 78 cm, 80 cm, 82 cm, 84 cm, 86 cm, 88 cm, or 90 cm.

Referring to FIGS. 13A and 13B, the first side panel 130 can comprise a top edge 132, a bottom edge 134, and a first side edge 136, which roughly form a triangle. Similarly, the second side panel 140 can comprise a top edge 142, a bottom edge 144, and a second side edge 146, which roughly form a triangle. The first side edge 136 of the first side panel 130 can be sewn to a portion of the first side edge 126 of the center panel 120, creating a first seam (not illustrated). Similarly, the second side edge 146 of the second side panel 140 can be sewn to a portion of the second side edge 128 of the center panel 120, creating a second seam 164. The first and second side panel top edges 132, 142 can be angled at approximately the same angle as the upper angled plane 108. The first side edge 136 and the second side edge 146 can be curved similarly to the first side edge 126 and the second side edge 129 of the center panel. In some embodiments, these respective edges can comprise matching radii of curvature to allow for a smooth attachment and increased fabric slack.

The circumscribing panel 154 can be sewn or connected below the other panels 120, 130, and 140 with a linear or horizontal seam. The circumscribing panel 154 can be configured to overlap the ring 74 of the base 60. In some embodiments, the circumscribing panel 154 can be located fully below the pivot plane 104. The circumscribing panel 154 can comprise a top edge 156 and a bottom edge 158. The bottom edge 158 of the circumscribing panel 154 is sewn, riveted, or otherwise secured to the base 60. The top edge 156 of the circumscribing panel 154 is not secured to the base 60. In some embodiments, the top edge 156 of the circumscribing panel 154 can be roughly colinear with the pivot plane 104. Since the top edge 156 is not secured to the base 60, the crush zone 100 can fold freely around the base ring 74 when the stand assembly 90 is deployed.

The center panel 120 can have a height 150. The center panel height 150 can range, inclusively, between 12 cm and 24 cm. In some embodiments, the center panel height 150 can range, inclusively, between 12 cm and 15 cm, 15 cm and 18 cm, 18 cm and 21 cm, or 21 cm and 24 cm. The center panel 120 can extend above a maximum height 152 of either of the first and second side panels 130, 140. Because of its position on the front 12 of the golf bag 10, the center panel 130 can extend above a bottom edge of either one or both of the apparel pocket 22*a* and the side accessory pocket 22*c*. Unlike the side panels 130, 140, the center panel 120 size is not limited by the pockets 22.

The center panel height 150 can enable or promote slack within the crush zone 100. In combination with the curved seam structure 129, the slack in the center panel 120 encourages outward bending of the crush zone 100 away from the hollow interior of the golf bag. As shown in the cross section of FIG. 15, the crush zone 100 folds away from the hollow interior of the golf bag when the bag 10 is in the deployed position. The collapsed fabric of the crush zone 100 gathers at or below the upper reference angle 110, wherein the center panel height 150 can further influence the horizontal bulge distance 116. A greater center panel height 150 can result in increased slack or excess fabric that occurs within the crush zone 100 in both the upright configuration and the deployed configuration, and, as such, a greater horizontal bulge distance 116. This is particularly true when the golf bag 10 is in the deployed position.

The crush zone 100, on its own or in combination with other anti-tangle features, can provide the golf bag with a greater base useful area 640. In some embodiments, the base useful area 640 of the golf bag 10 comprising the crush zone 100, as described above, can increase base useful area 640 by 4 $in^2$ to 10 $in^2$. In some examples, the base useful area 640 is increased by 4 $in^2$, 5 $in^2$, 6 $in^2$, 7 $in^2$, 8 $in^2$, 9 $in^2$, or 10 $in^2$.

IV. EMBODIMENT 2 OF THE CRUSH ZONE

In some embodiments, the golf bag 10, as described above, can comprise a crush zone 200 as described below, according to a second embodiment. Referring to FIGS. 16-19, the crush zone 200 can comprise an upper panel 220 and a lower panel 230. A folding seam 260 can connect the upper panel 220 to the lower panel 230. The crush zone 200 can comprise dimensions and features similar to those described generically above, with reference to figures of the first embodiment crush zone 100. For example, the second crush zone 200 can comprise an extension distance 214 similar to the extension distance 114 of the first embodiment. As described above, the aforementioned crush zone 100 dimensions enable the crush zone 200 to collapse outwards away from the hollow interior of the golf bag.

The upper panel 220 and lower panel 230 can be configured to fold outward and toward each other when the bag 10 moves into the deployed configuration. In the upright configuration, the upper panel 220 and lower panel 230 may not contact each other, except along the folding seam 260. The folding seam 260 can form an outermost extent of the crush zone 200. The folding seam 260 can encourage the upper and lower panels 220 and 230 to fold outwards rather than inwards towards the hollow interior. The folding seam 260 continuously extends from the first side to the second side of the golf bag 10, assisting the crush zone 200 to collapse evenly. In some embodiments, the folding seam 260 can comprise piping along an inside of the folding seam 260. The piping can bias the folding seam 260 to fold outwards rather than inwards. In this way, the piping can push the upper and lower panels 220 and 230 outwards, away from the hollow interior of the golf bag 10.

Figure 18A:
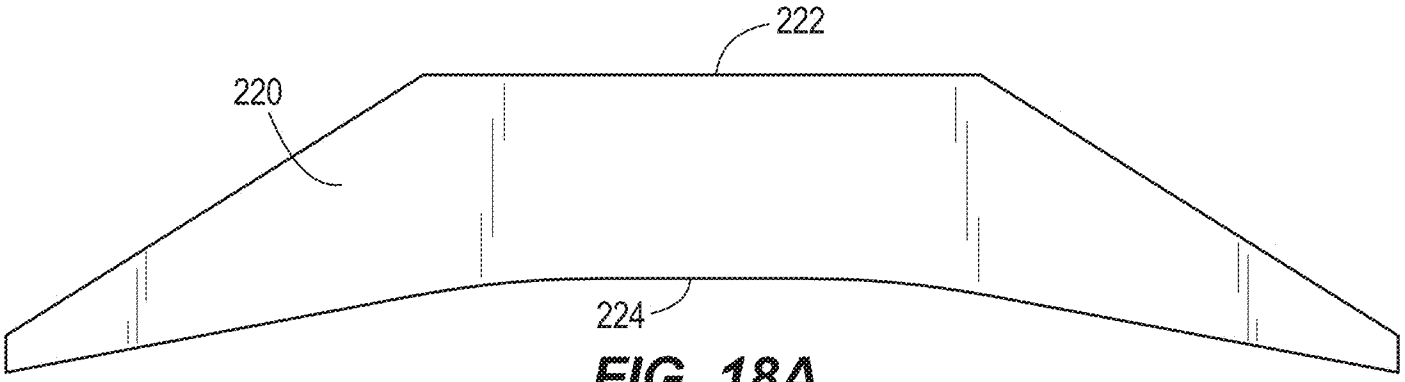
FIG. 18A illustrates a 2D view of an upper panel pattern, according to the embodiment of FIG. 16.

Referring to FIG. 18A, the upper panel 220 comprises a top edge 222, a folding edge 224, and side edges 228. The folding edge 224 can be opposite and below the top edge 222, and the side edges 228 can be between the top edge 222 and the folding edge 224. The top edge 222 can be located at a top of the crush zone 200. The folding edge 224 can be sewn into the folding seam 260. The side edges 228 of the upper panel 220 can attach to a portion of the flat 20 on the side 16 and 18 of the golf bag 10. In some embodiments, the side edges 228 can be sewn in such a way as to form side corners, rather than edges, in the completed flat 20.

Figure 18B:
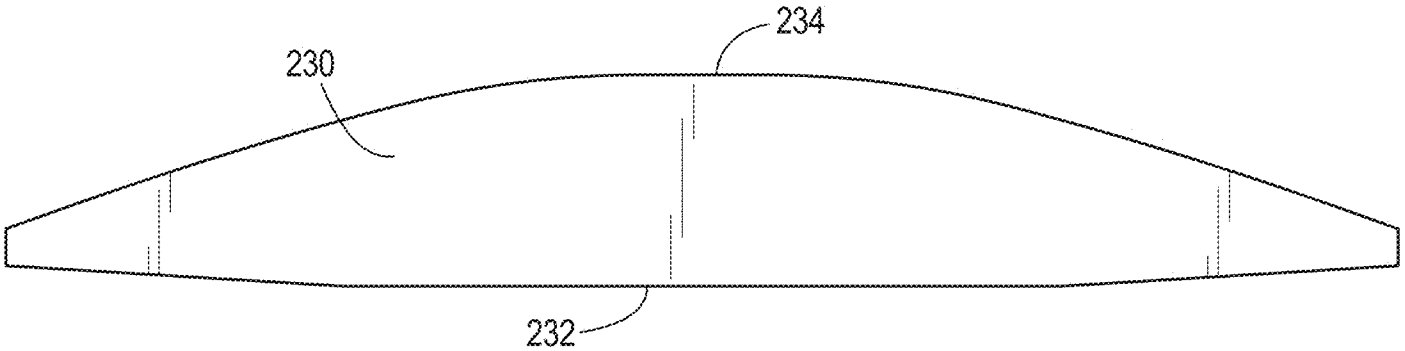
FIG. 18B illustrates a 2D view of a lower panel pattern, according to the embodiment of FIG. 16.

As shown in the flat pattern of FIGS. 18A and 18B, the edges of the upper 222 and 224 and lower panels 232 and 234 can be shaped to create the desired fold out nature of the crush zone 200. The top edge 222 of the upper panel 220 can be arcuate with a variable radii curvature. However, in some embodiments, a portion of the top edge 222 can be straight. The folding edge 224 can comprise a variable radii curvature. The curvature of the folding edge 224 can be steeper than the top edge 222 curvature. In other words, the folding edge 224 can have an average radius of curvature that is less than an average radius of curvature of the top edge 222.

Referring still to the flat pattern of FIG. 18B, the crush zone 200 can also comprise the lower panel 230, which can be configured to be attached to the upper panel 220. The lower panel 230 comprises a bottom edge 232, a folding edge 234, and a side edges 238 (or side corners). The folding edge 234 can be opposite and above the bottom edge 232. The bottom edge 232 can be located at a bottom of the crush zone 200. The folding edge 234 can be sewn into the folding seam 260. The side edges 238 of the lower panel 230 attach to a portion of the flat 20 on the side 16 and 18 of the golf bag 10. The curvatures and lengths of the lower panel edges 232 and 234 can roughly mirror the curvatures and lengths of the upper panel edges 222 and 224, as shown in FIGS. 18A and 18B.

The upper panel 220 can be sewn to the lower panel 230 via the folding seam 260. The upper panel 220 and lower panel 230 can both extend across the first side 16, the second side 18, and the front 12 of the golf bag 10. The lower panel 230 and a portion of the upper panel 220 can extend below the pivot plane 204. Consequently, the folding seam 260 can extend both above and below the pivot plane 204. In a side view, the folding seam 260 intersects a back portion of the flat 20 below the pivot plane 204. This configuration can help the crush zone 200 fabric to fold down below the pivot plane 204 when the golf bag 10 is placed into the deployed configuration. The bottom edge 232 of the lower panel 230 can be sewn to the base ring 74, just above the lip of the ring 80.

Figure 19:
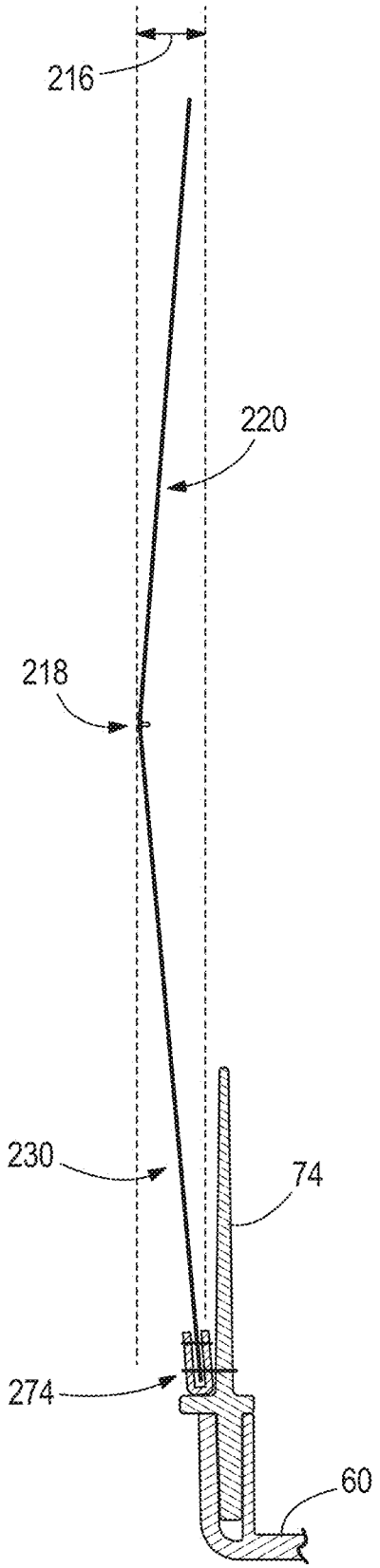
FIG. 19 illustrates a cross sectional view of a section of the golf bag in the upright position, according to the embodiment of FIG. 16.
Figure 20:
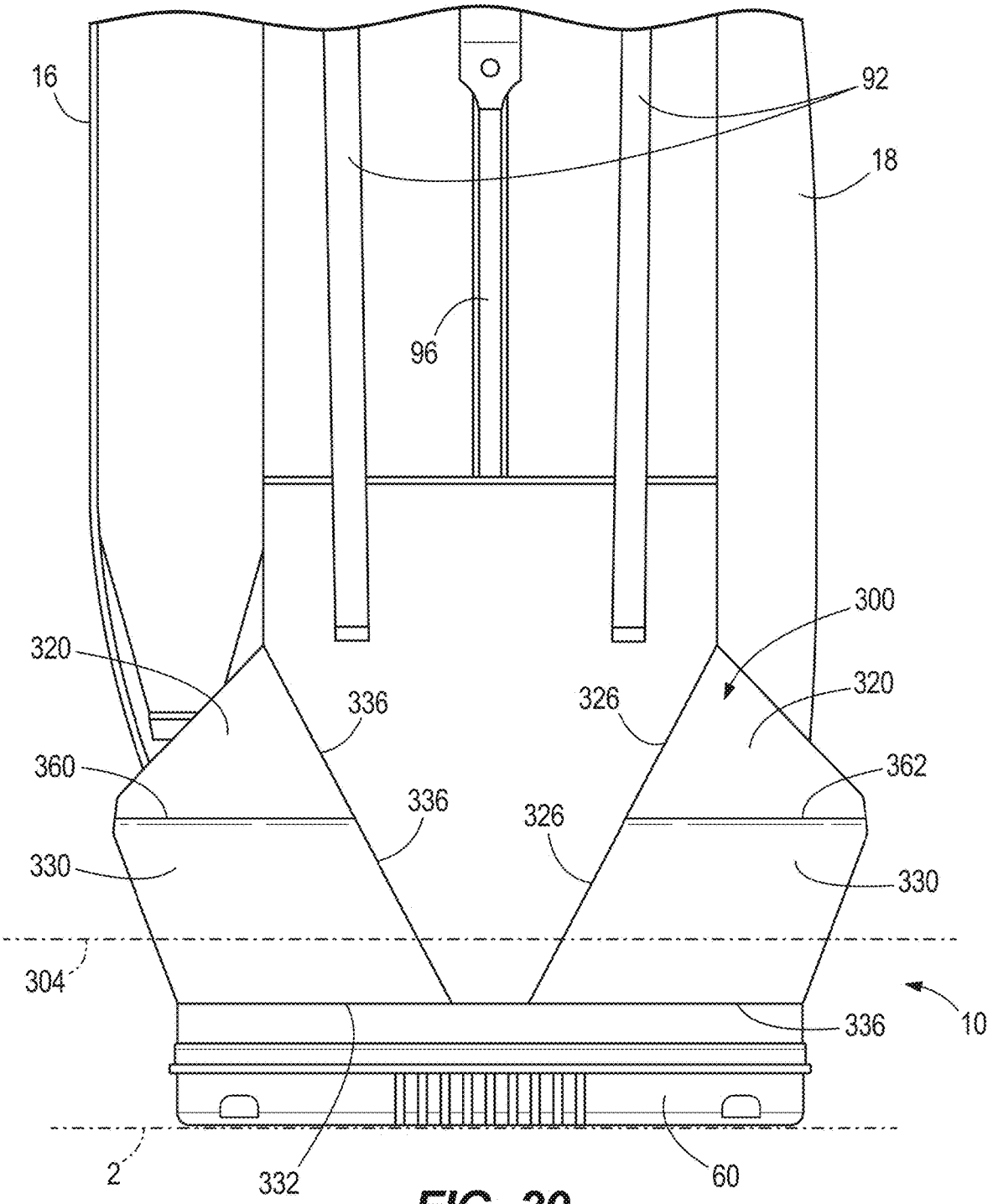
FIG. 20 illustrates a front view of a section of a golf bag in an upright position, according to an alternate embodiment.
Figure 21:
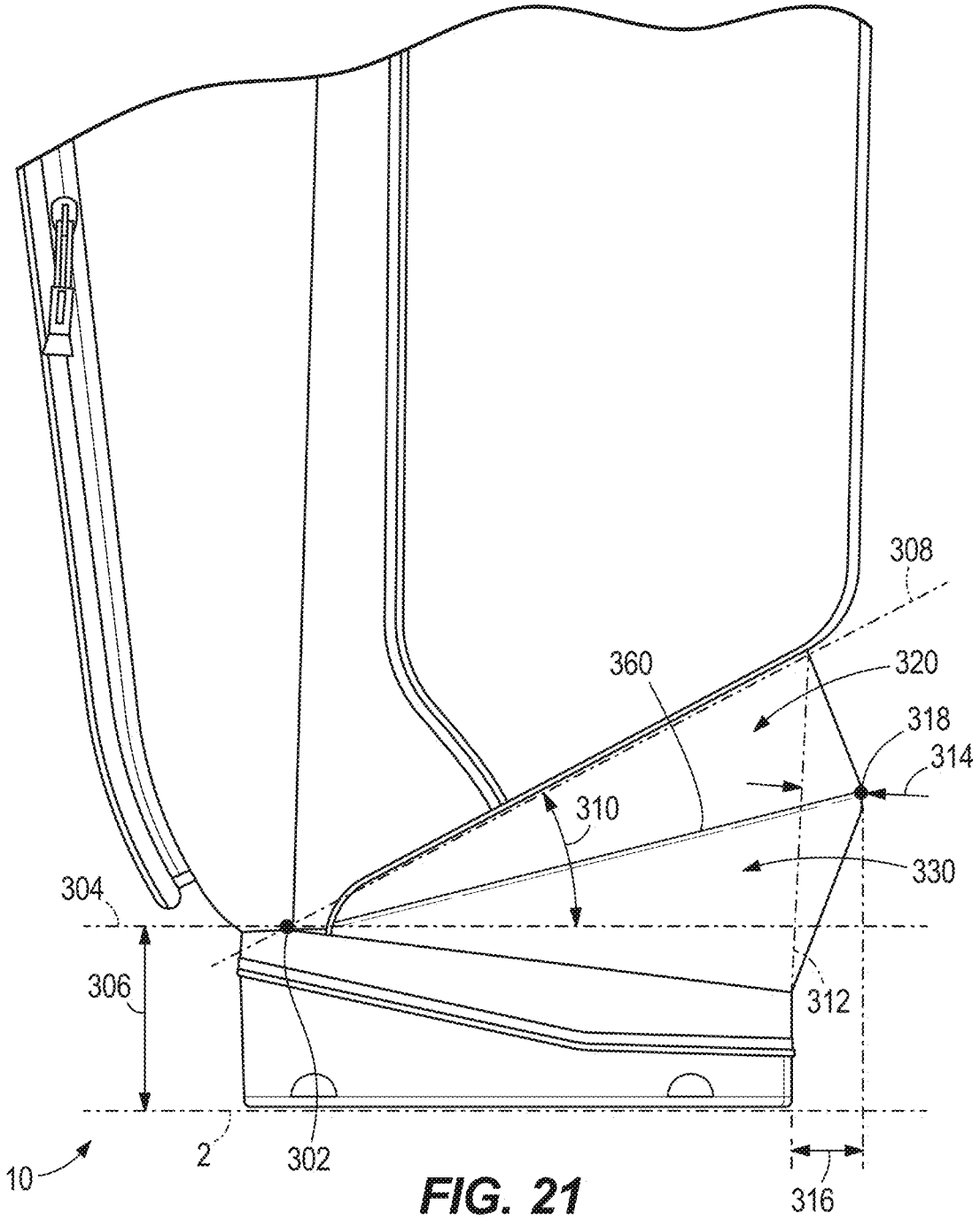
FIG. 21 illustrates a first side view of a section of a golf bag in an upright position, according to the embodiment of FIG. 20.
Figure 22:
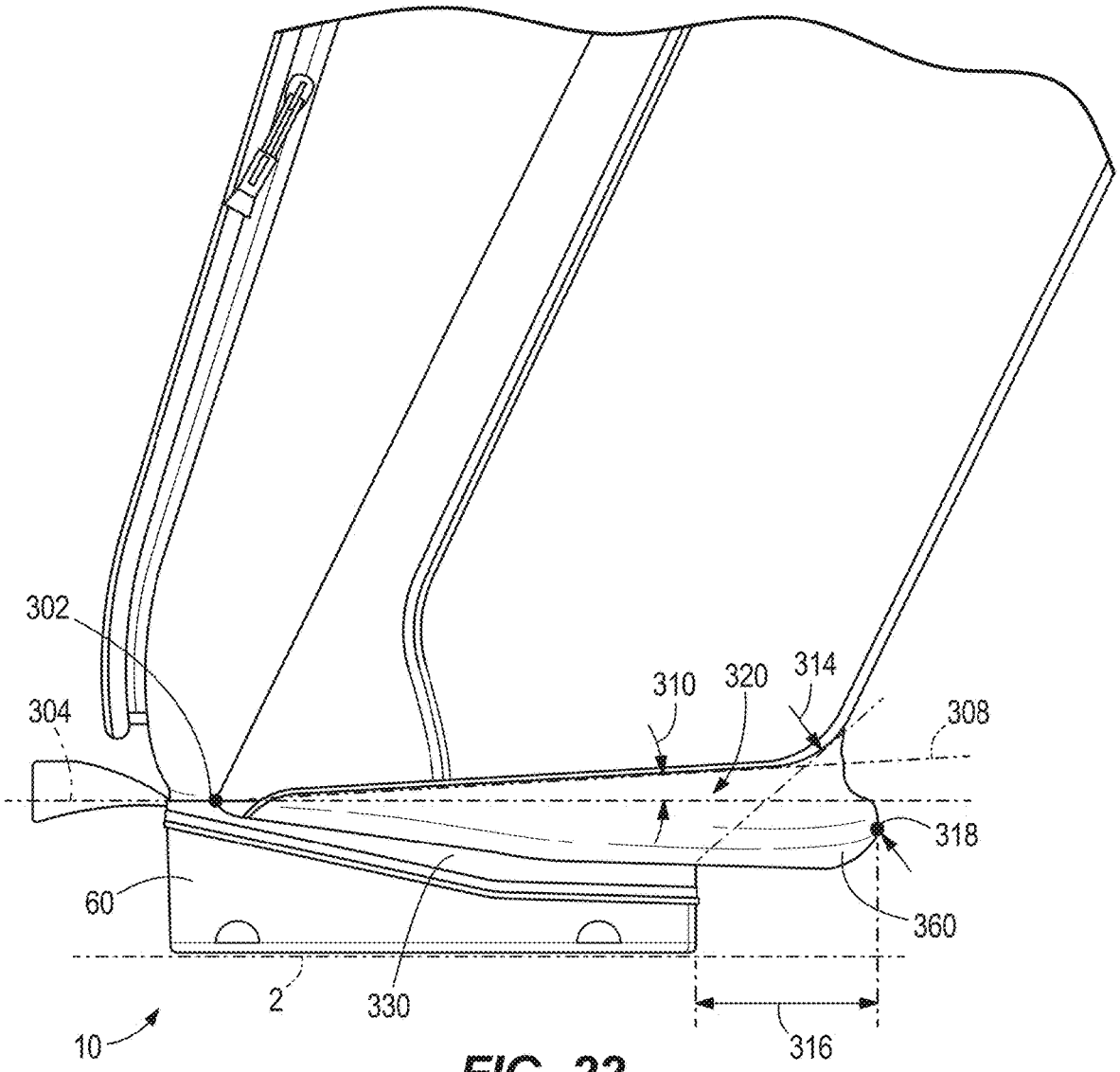
FIG. 22 illustrates a first side view of a section of a golf bag in a deployed position, according to the embodiment of FIG. 20.
Figure 23:
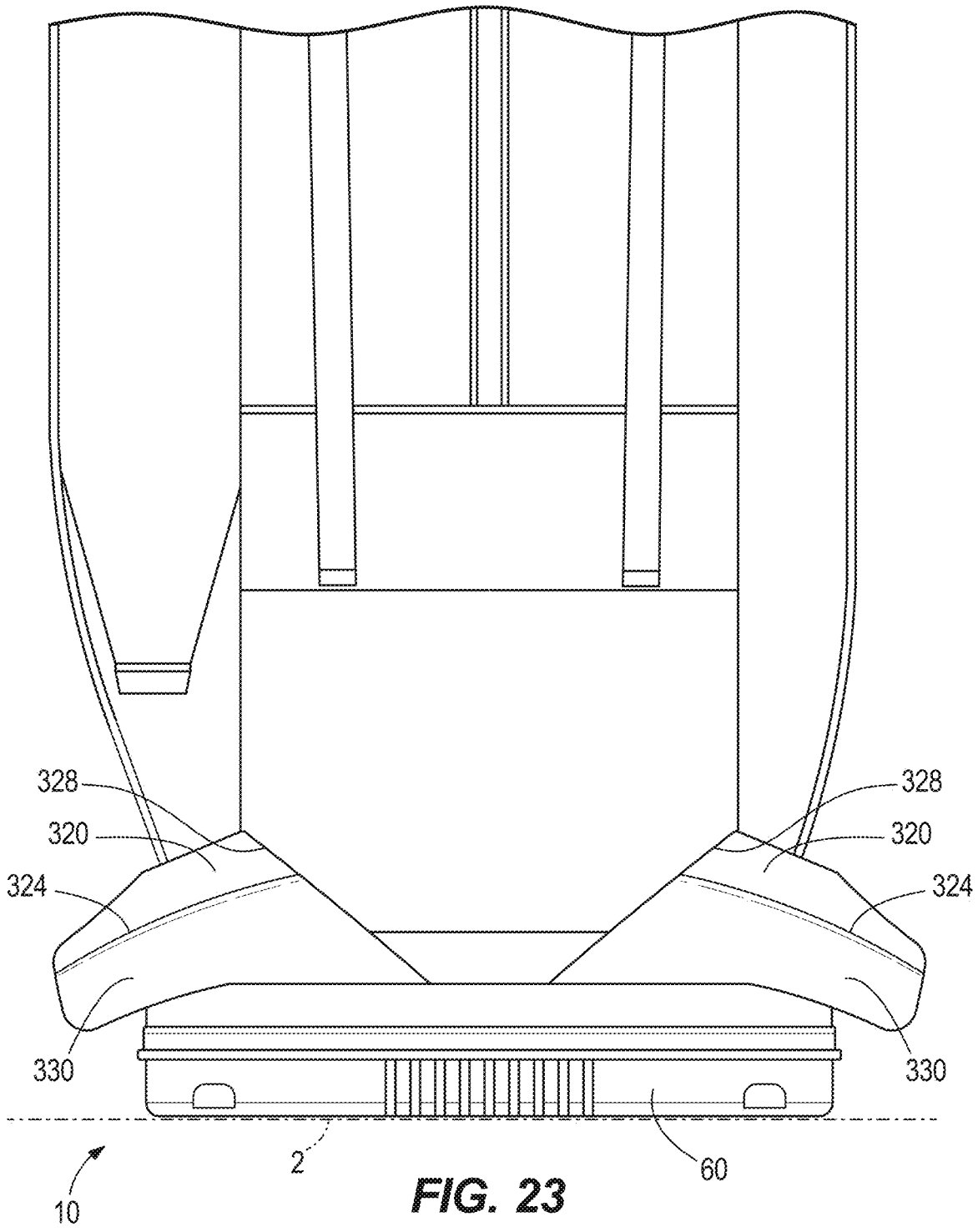
FIG. 23 illustrates a front view of a section of a golf bag in a deployed position, according to the embodiment of FIG. 20.

As shown in the cross section of FIG. 19, the crush zone 200 is configured to fold away from the hollow interior of the golf bag 10 when the bag 10 is deployed. The upper 220 and lower panels 230 of this embodiment create a seam 260 with an outward bulge 218 that can guide the fabric outward as the upper reference angle 208 lowers and the bag 10 is moved by approximately 30 degrees into the deployed position. As shown in FIG. 19, the upper 220 and lower panels 230 of this embodiment can further influence the horizontal bulge distance 216 of the crush zone 200. Similarly to the first embodiment, the greater the height of the upper 220 or lower panel 230, the greater the horizontal bulge distance 216 of the crush zone 200.

The crush zone 200, on its own or in combination with other anti-tangle features, can provide the golf bag with a greater base useful area. In some embodiments, the base useful area of the golf bag 10 comprising the crush zone 200, as described above, can increase base useful area by 4 $in^2$ to 10 $in^2$. In some examples, the base useful area is increased by 4 $in^2$, 5 $in^2$, 6 $in^2$, 7 $in^2$, 8 $in^2$, 9 $in^2$, or 10 $in^2$.

V. EMBODIMENT 3 OF THE CRUSH ZONE

In some embodiments, the golf bag 10, as described above, can comprise a crush zone 300 as described below, according to a third embodiment. Referring to FIGS. 20-24, the crush zone 300 can comprise four panels 320*a* and 320*b* and 330*a* and 330*b*, creating two folding zones 360 and 362 on either side of the golf bag 10. The two folding zones 360 and 362 can be separated at the front 12 of the golf bag 10 by a pointed panel of the flat 350. The pointed panel 350 can partially collapse when the two folding zones 360 and 362 collapse. The crush zone 300 can comprise dimensions similar to those described generically above, with reference to figures of the first embodiment crush zone 100. For example, the third crush zone 300 can comprise an extension distance 314 similar to the extension distance 114 of the first embodiment. As described above, the aforementioned crush zone dimensions enable the crush zone 300 to collapse outwards away from the hollow interior of the golf bag 10.

Referring to FIGS. 20-24, the crush zone 300 can comprise a first upper panel 320*a*, a first lower panel 330*a*, a second upper panel 320*b*, and a second lower panel 330*b*. The first upper and lower panels 320*a* and 330*a* can be attached to each other along a first folding seam 360 to form a first folding zone 360. The second upper and lower panels 320*b* and 330*b* can be attached to each other along a second folding seam 362 to form a second folding zone 362. The first and second folding zones can be located on first and second sides of the golf bag, respectively.

Referring to FIGS. 20-24, the first 320*a* and second 320*b* upper panels can each comprise a top edge 322, a folding edge 324, a front edge 326, and a side edge 328. The folding edge 324 can be opposite and below the top edge 322, and the side edge 328 can be opposite the front edge 326. The top edge 322 can be located at a top of the crush zone 322. Each folding edge 324 can be sewn into the respective folding seam 360 and 362. The front edge 326 can attach to the pointed panel of the flat 350 on the front 12 of the golf bag 10. The side edge of the upper panel 328 can attach to a portion of the flat 20 on the side 16 and 18 of the golf bag 10. In some embodiments, the side edge 328 can be sewn in such a way as to form a side corner, rather than an edge, in the completed flat 20.

Figure 24:
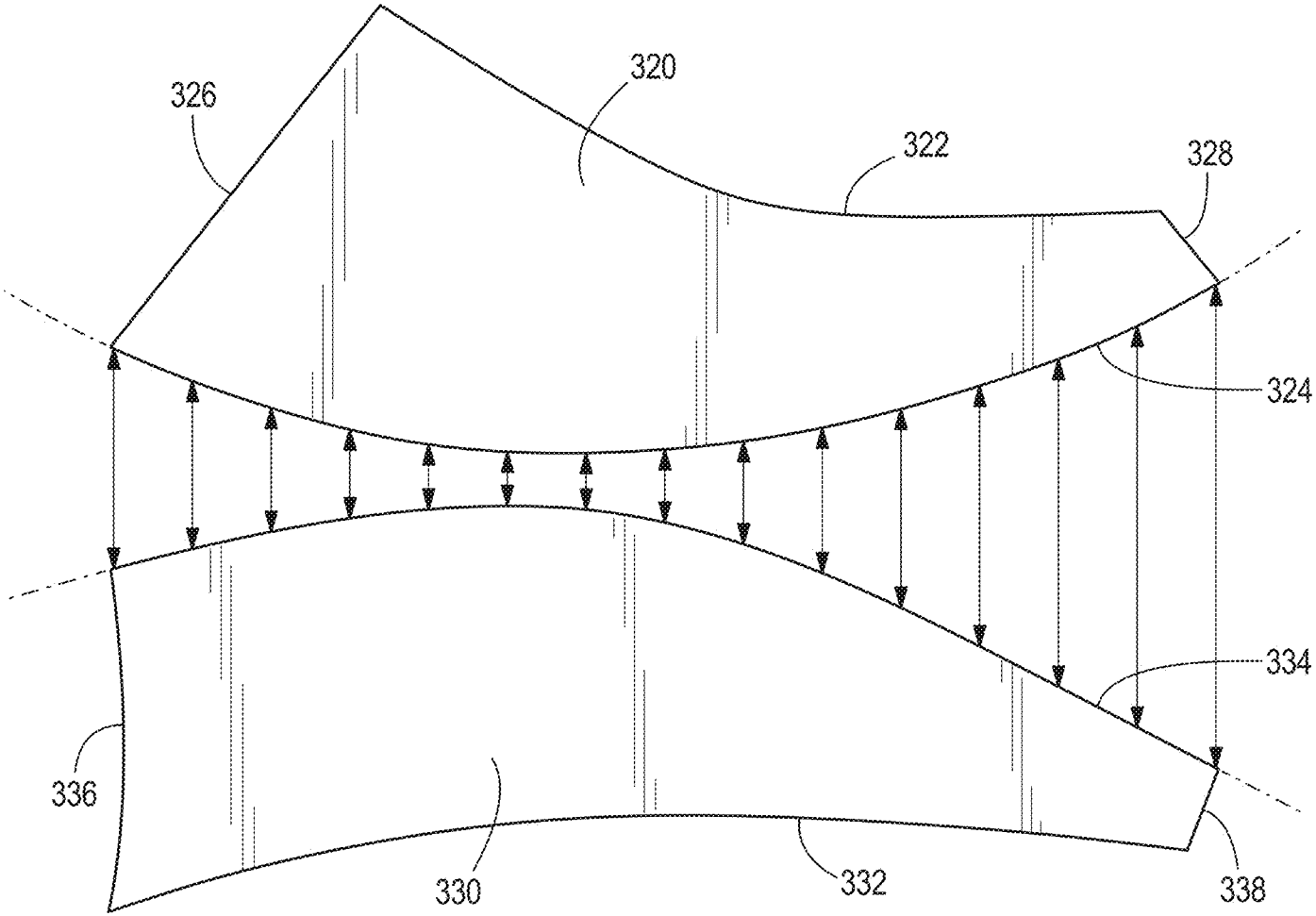
FIG. 24 illustrates a 2D view of an upper gusset pattern and a lower gusset pattern, according to the embodiment of FIG. 20.

As shown in the flat pattern of FIG. 24, the edges of the panels 322 and 324 and 326 and 328 and 332 and 334 and 336 and 338 can be shaped to create the desired fold out nature of the crush zone 300. The top edge of the upper panel 322 can be arcuate with a variable radii curvature. However, in some embodiments, a portion of the top edge 322 can be straight. The first and second folding edges 324*a* and 324*b* can comprise a variable radii curvature. The curvature of the folding edge 324 can be steeper than the top edge 322 curvature. In other words, the folding edge 324 can have an average radius of curvature that is less than an average radius of curvature of the top edge 322. As a consequence of this curvature difference, the side edge 328 can be shorter than the front edge 326.

The first upper panel 320*a* and first lower panel 330*a* (first folding zone) can extend across the first side 16 and the front 12 of the golf bag 10. The second upper panel 320*b* and second lower panel 330*b* (second folding zone) can extend across the second side 18 and the front 12 of the golf bag 10.

The bottom edge of the first and second lower panels 332*a* and 332*b* can be sewn to a circumscribing panel 354. The circumscribing panel 354 can be sewn to the base ring 74, just above the lip of the ring 80. At least a portion of the lower panel 330 can extend below the pivot plane 304. From side views, the first and second folding seams 360 and 362 can be above the pivot plane 304 and converge towards the pivot point 302. This configuration can help at least the first and second lower panels 330*a* and 330*b* of the crush zone 300 fabric to fold down below the pivot plane 304 when the golf bag 10 is placed into the deployed configuration.

The crush zone 300, on its own or in combination with other anti-tangle features, can provide the golf bag with a greater base useful area. In some embodiments, the base useful area of the golf bag 10 comprising the crush zone 300, as described above, can increase base useful area by 4 $in^2$ to 10 $in^2$. In some examples, the base useful area is increased by 4 $in^2$, 5 $in^2$, 6 $in^2$, 7 $in^2$, 8 $in^2$, 9 $in^2$, or 10 $in^2$.

VI. EMBODIMENT 4 OF THE CRUSH ZONE

Figure 25:
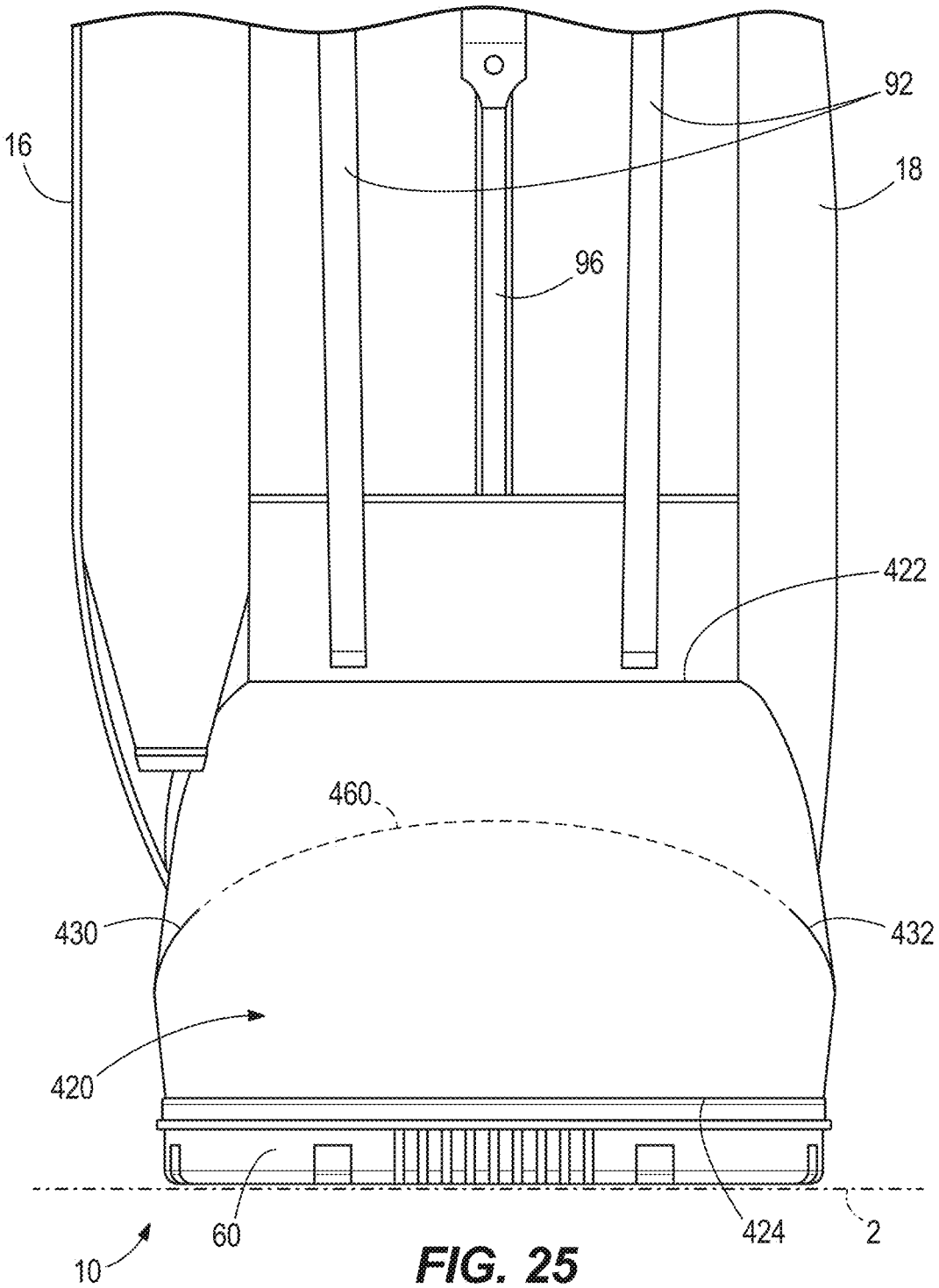
FIG. 25 illustrates a front view of a section of a golf bag in an upright position, according to a fourth embodiment.
Figure 26:
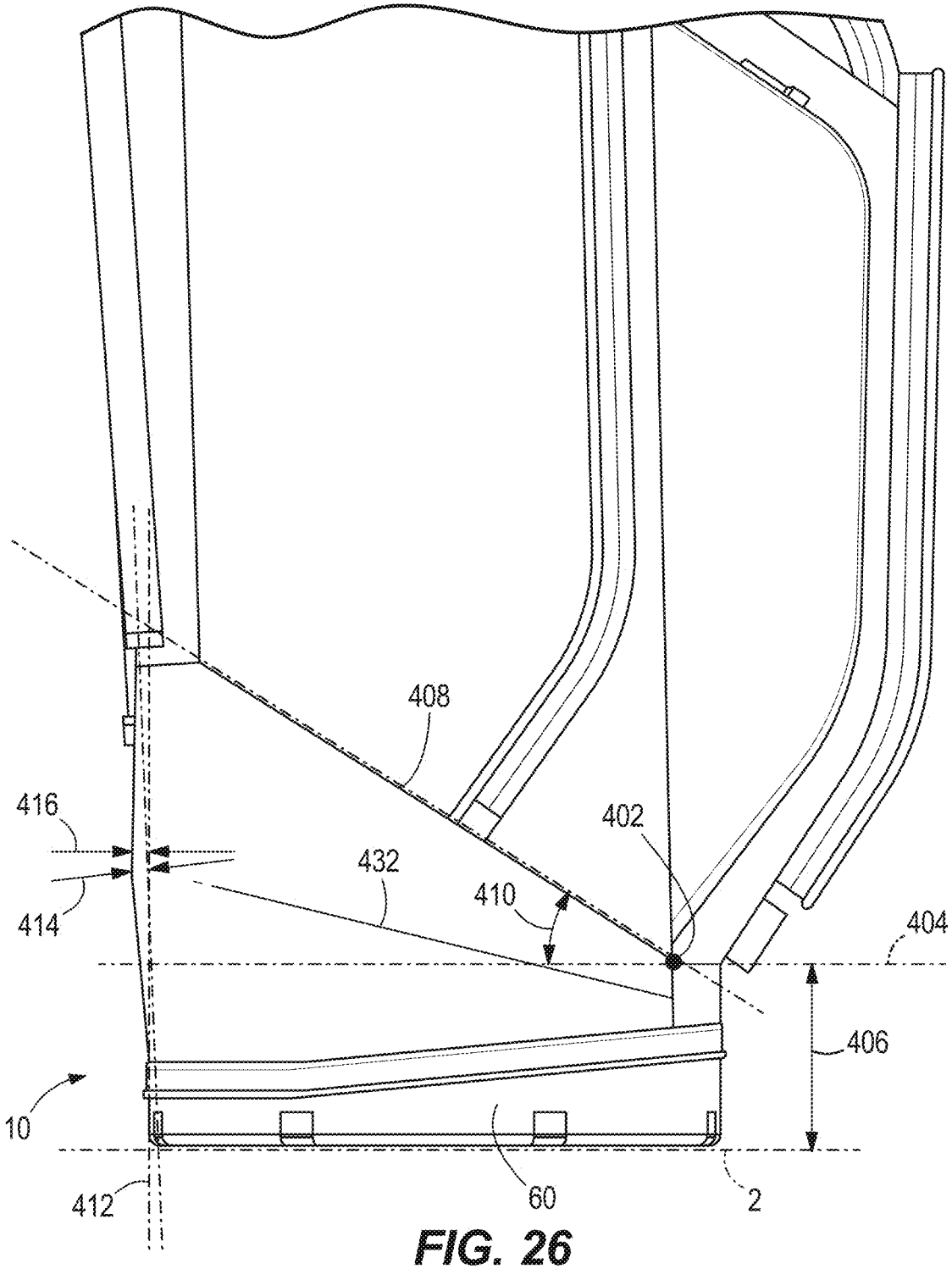
FIG. 26 illustrates a first side view of a section of a golf bag in an upright position, according to the embodiment of FIG. 25.
Figure 27:
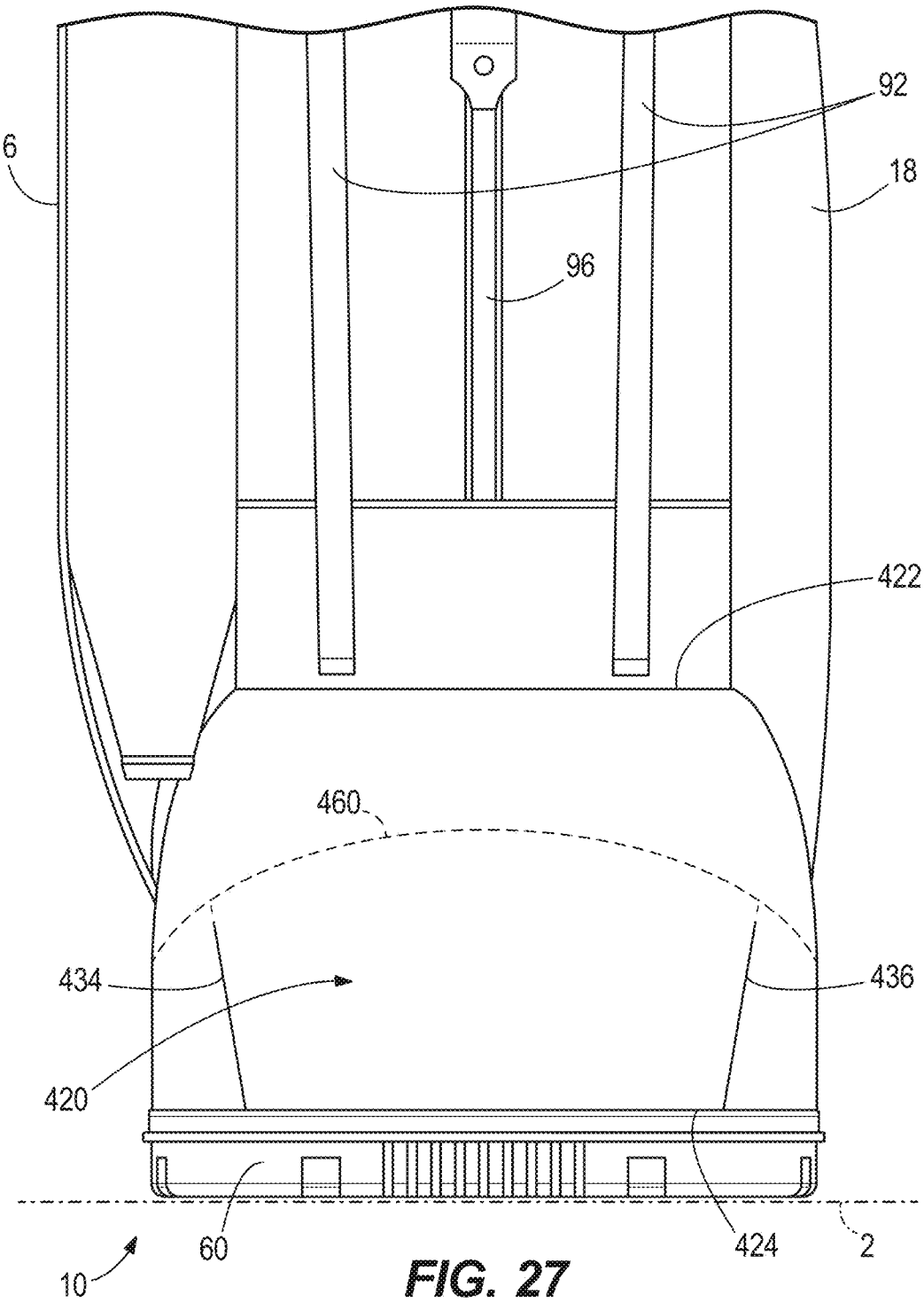
FIG. 27 illustrates a front view of a section of a golf bag in an upright position, according to an alternate embodiment.
Figure 28:
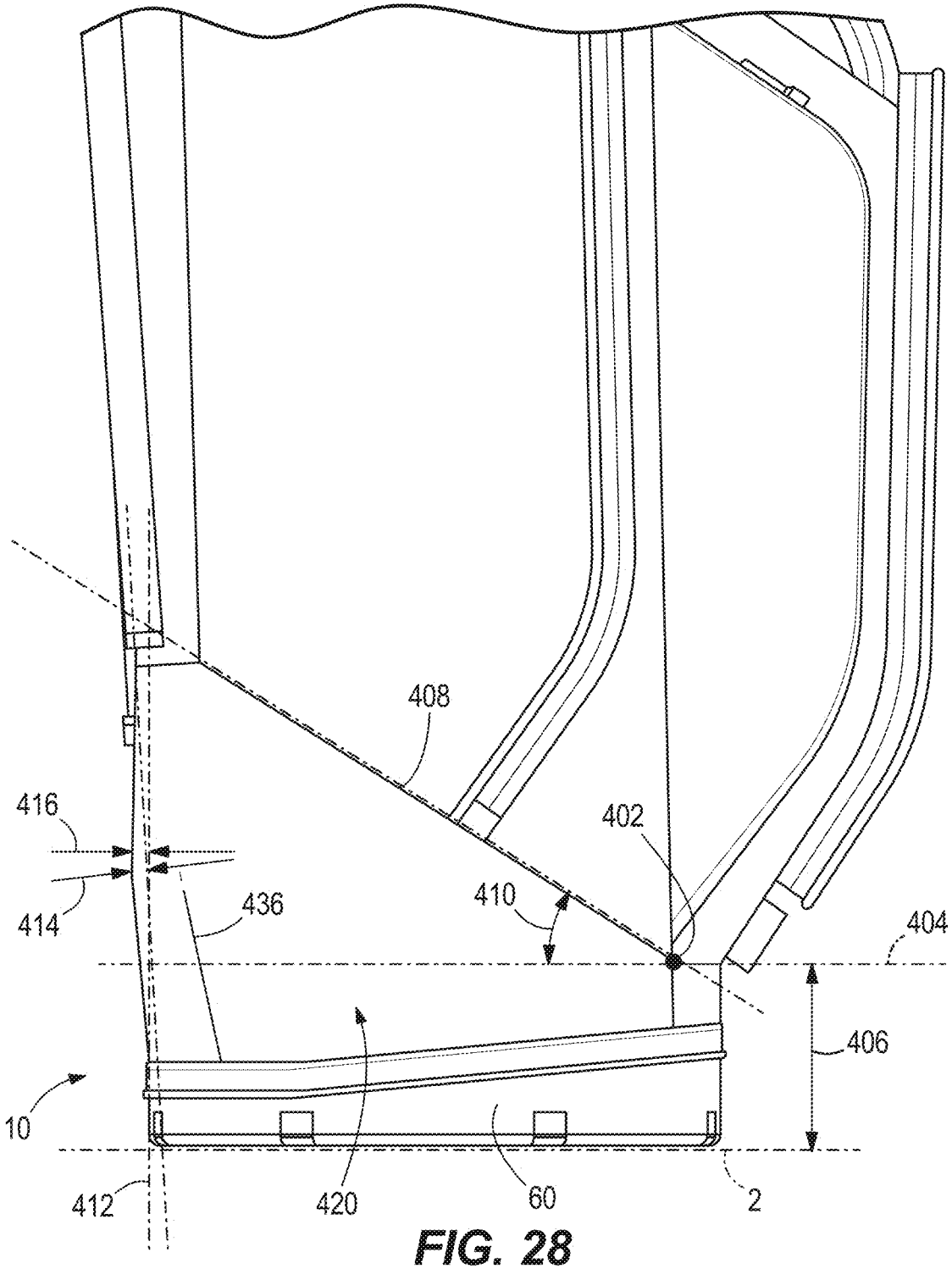
FIG. 28 illustrates a first side view of a section of a golf bag in an upright position, according to the embodiment of FIG. 27.
Figure 29:
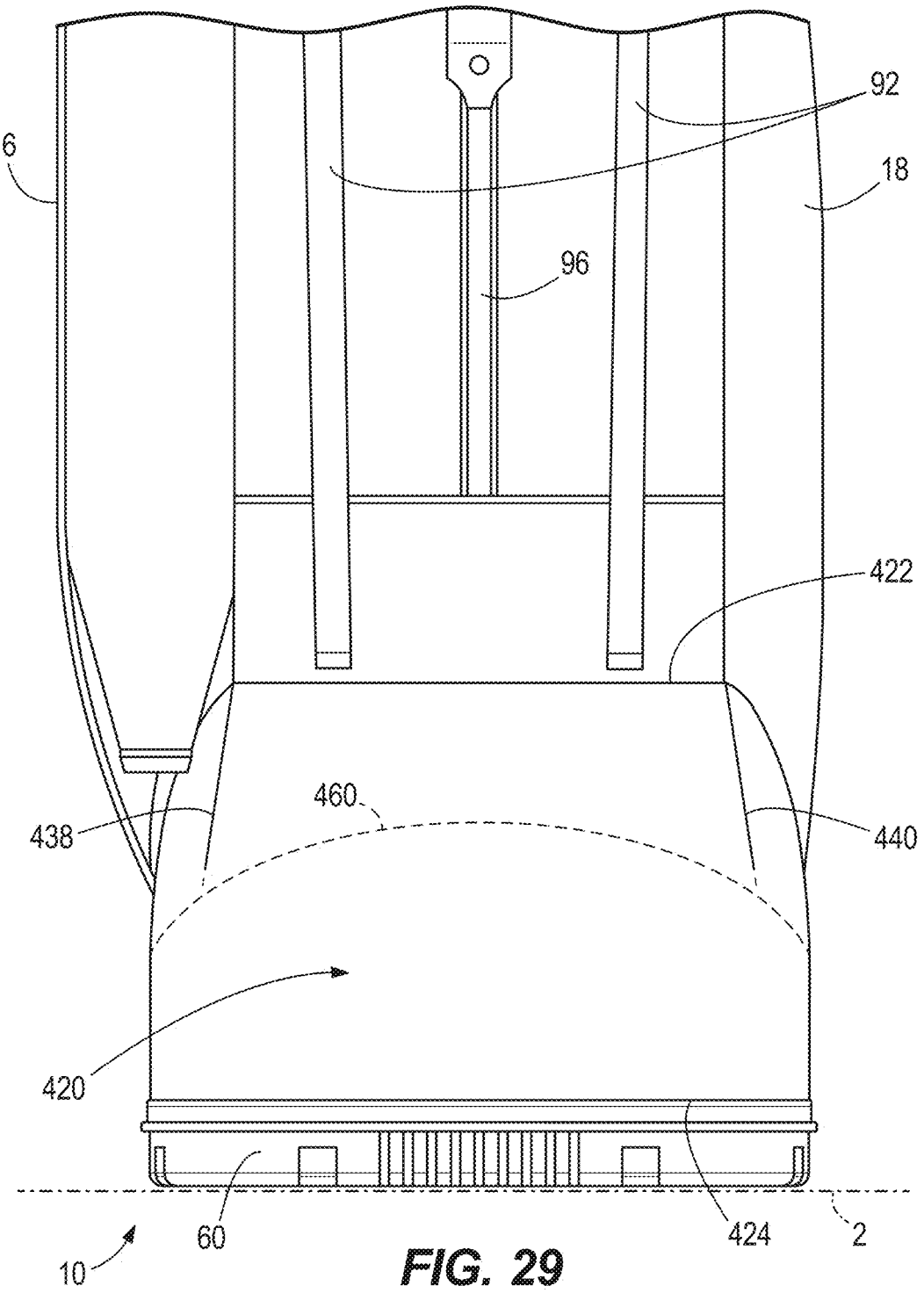
FIG. 29 illustrates a front view of a section of a golf bag in an upright position, according to an alternate embodiment.
Figure 30:
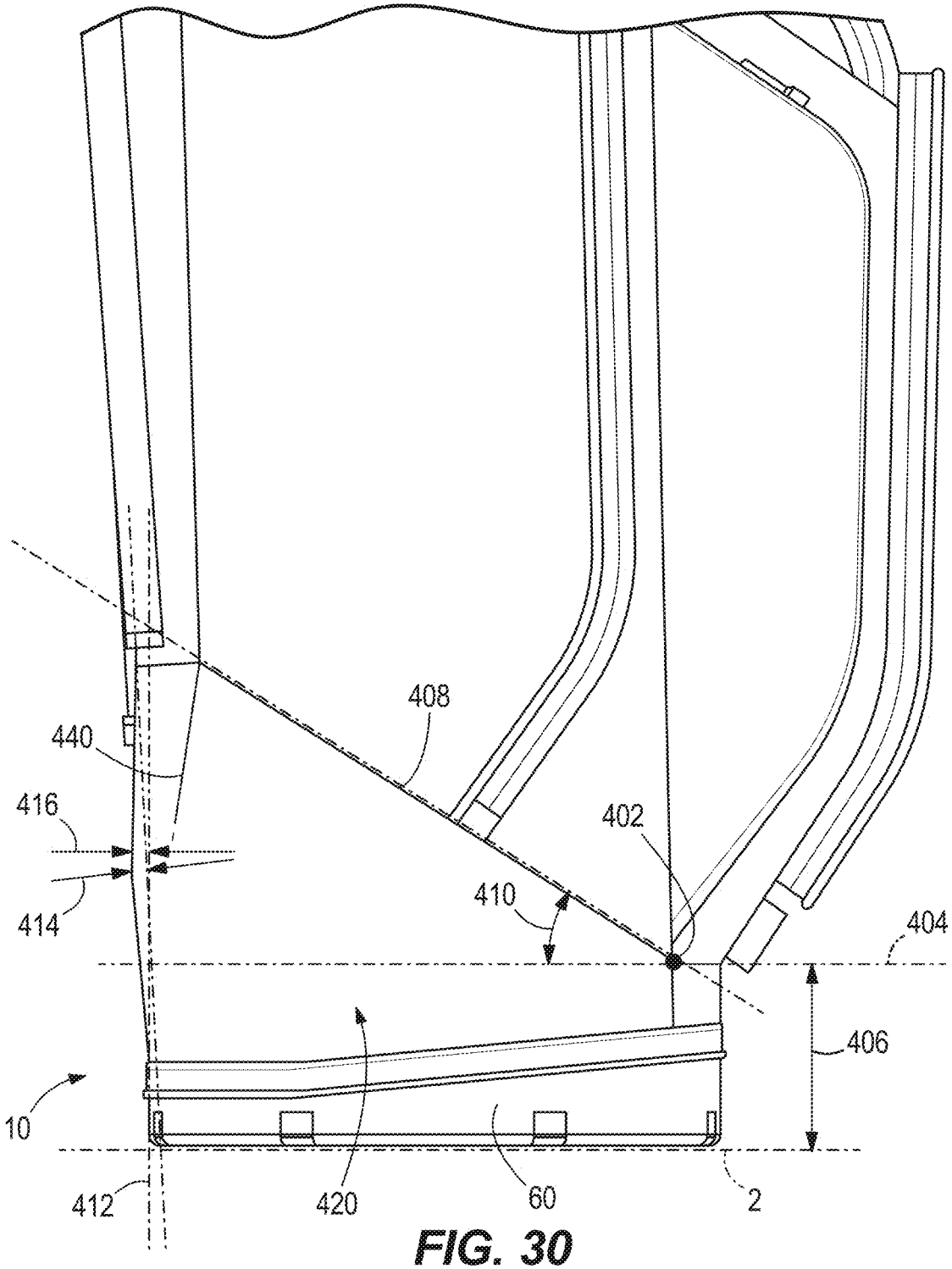
FIG. 30 illustrates a first side view of a section of a golf bag in an upright position, according to the embodiment of FIG. 29.

In some embodiments, the golf bag 10, as described above, can comprise a crush zone 400 as described below, according to a fourth embodiment. Referring to FIGS. 25-32, the crush zone 400 can comprise a panel 420, shaped by darts that cut across portions of the panel 420. As mentioned above, darting is a shaping technique in which a triangular portion of the fabric is removed or pinched together, and the remaining adjacent seams are sewn together to form a dart. The fourth crush zone 400 can be shaped by one or more sideways darts, upward darts, and/or downward darts. In the variation of FIGS. 25-26 the fourth crush zone 400 comprises a first sideways dart 430 and a second sideways dart 432, primarily cutting through the crush zone 400 along the first 16 and second 18 sides of the golf bag 10. In the variation of FIGS. 27-28, the fourth crush zone 400 comprises a first upward dart 434 and a second upward dart 436, located roughly in front corners 426 of the crush zone 400. In the variation of FIGS. 29-30, the fourth crush zone 400 comprises a first downward dart 438 and a second downward dart 440, located roughly in front corners 426 of the crush zone 400. The darts shape the single panel 420 to achieve the desired crush zone shaping 400. Across all the dart variations, the darts bias the crush zone 400 to fold outward along a folding line 460. The folding line 460 can be the outermost extent of the crush zone 400 in the upright position.

The crush zone 400 can comprise dimensions similar to those described generically above, with reference to figures of the first embodiment crush zone 100. For example, the fourth crush zone 400 can comprise an extension distance 414 similar to the extension distance 114 of the first embodiment. As described above, the aforementioned crush zone 100 dimensions enable the crush zone 400 to collapse outwards away from the hollow interior of the golf bag 10.

Referring to FIGS. 25-26 in some embodiments, the first and second sideways darts 430, 432 can follow a direction similar to the folding seam 260 of the second embodiment crush zone 200. However, the first and second sideways darts 430, 432 do not connect across a front 12 of the golf bag 10. The first and second sideways darts 430, 432 can follow or be coincident with portions of the folding line 460. Referring to FIGS. 27-28 in some embodiments, the first and second upward darts 434, 436 can be positioned to extend up to the folding line 460. Referring to FIGS. 29-30 in some embodiments, the first and second downward darts 438, 440 can be positioned to extend down to the folding line 460. The upward and downward darts can be positioned in rounded regions of the crush zone 400 within front corners of the golf bag 426 (i.e. both the corner formed at the transition from the front to the first side and the corner formed at the transition from the front to the second side). An end point of each dart, where the dart terminates, creates a bulge in the crush zone 400. This bulge causes the crush zone 400 to fold at the end of the dart. Therefore, positioning the upward and downward darts within the front corners 426 of the golf bag 10 biases the crush zone 400 to collapse outwards in the front corners 426.

Figure 31:
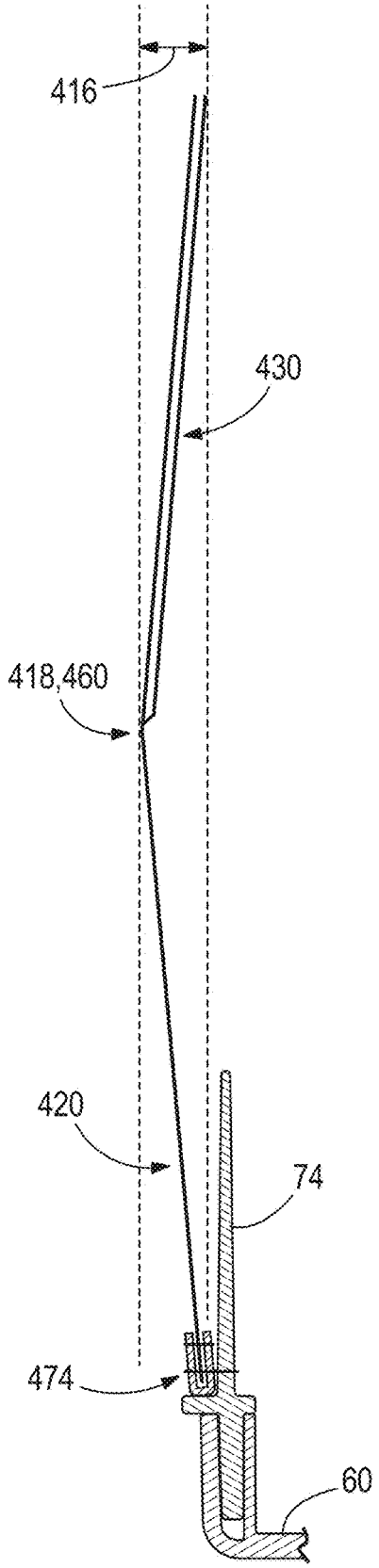
FIG. 31 illustrates a cross sectional view of a section of a golf bag in an upright position, according to the embodiment of FIG. 29.
Figure 32:
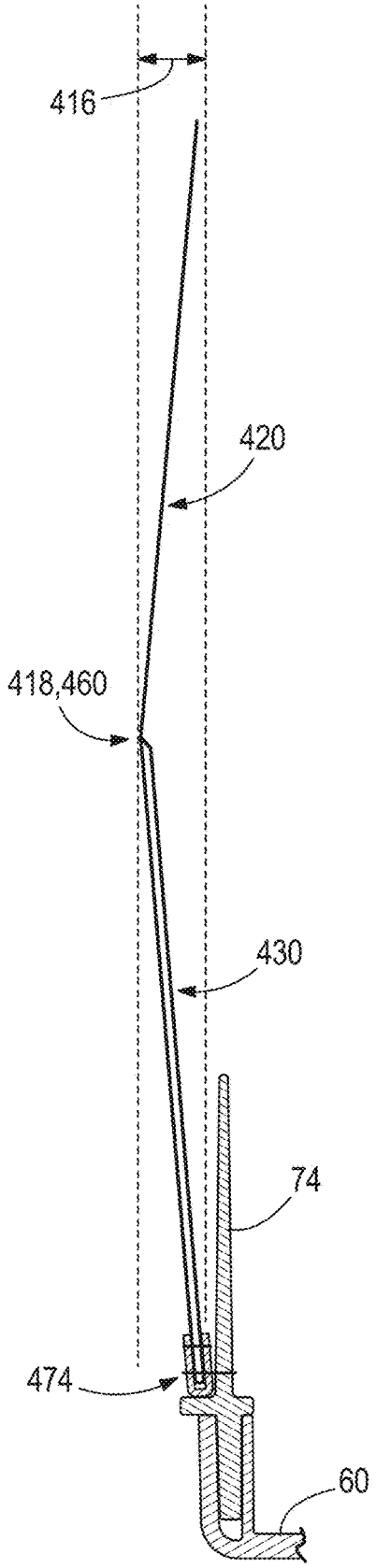
FIG. 32 illustrates a cross sectional view of a section of a golf bag in an upright position, according to the embodiment of FIG. 27.
Figure 33:
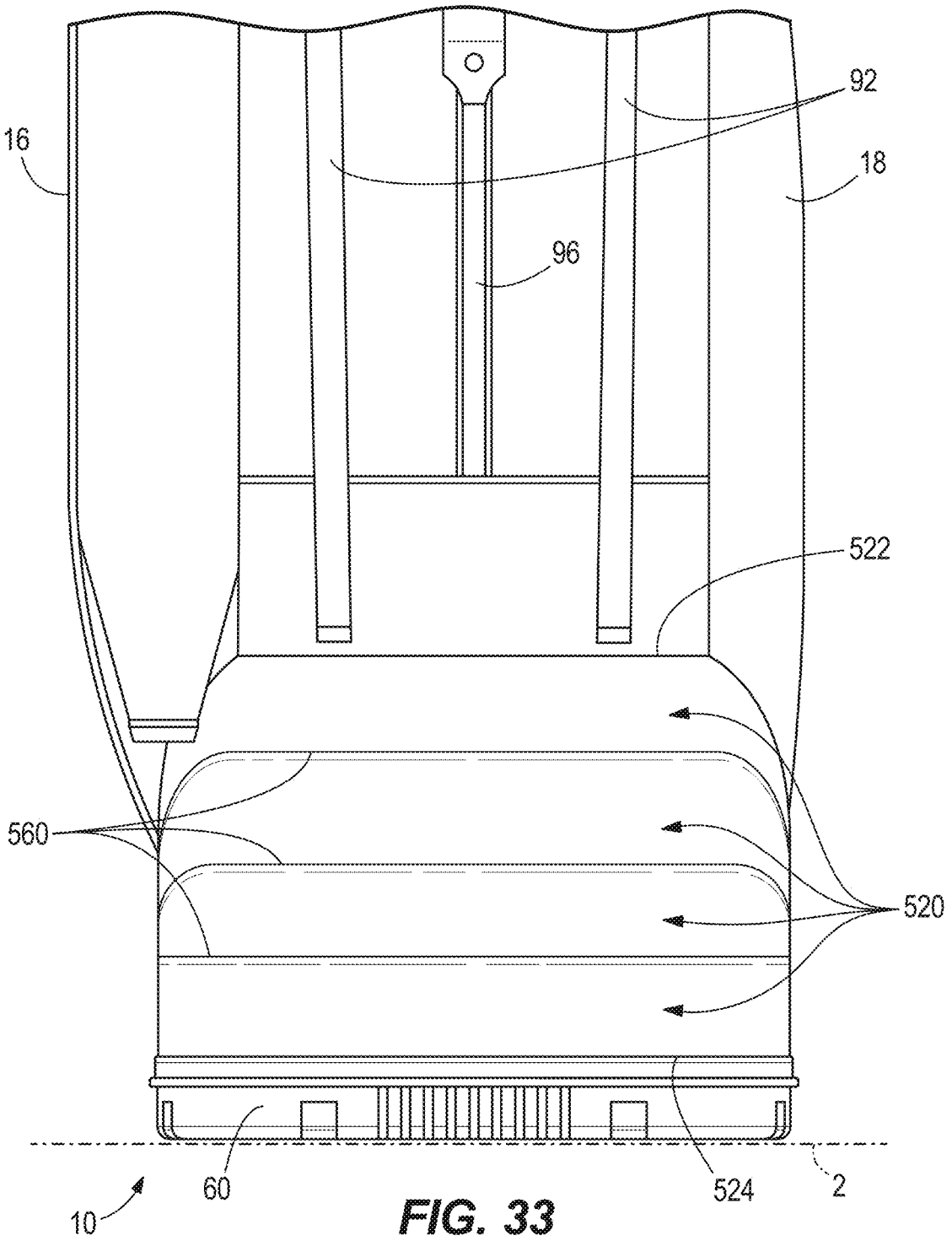
FIG. 33 illustrates a front view of a section of a golf bag in an upright position, according to a fourth embodiment.
Figure 34:
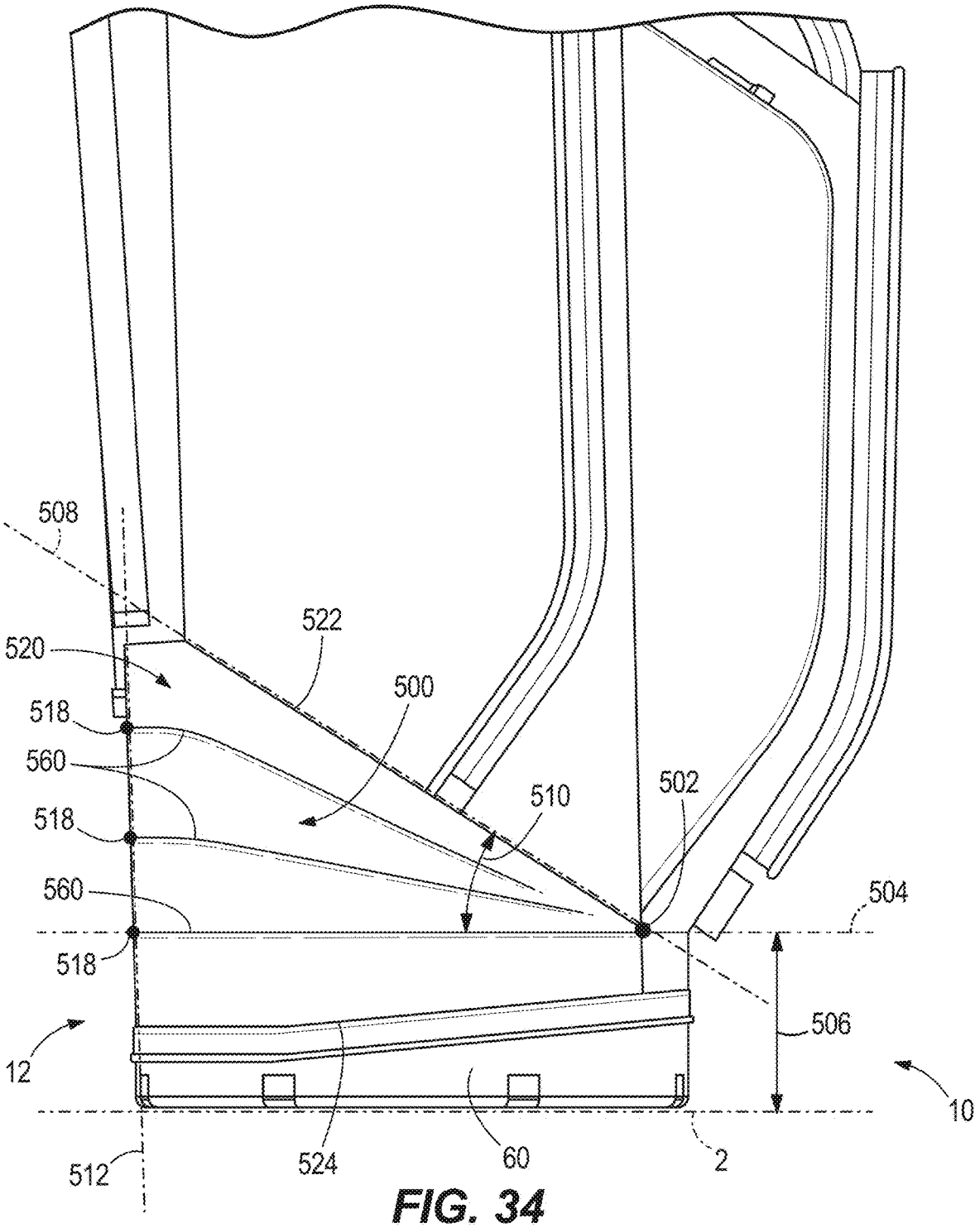
FIG. 34 illustrates a first side view of a section of a golf bag in an upright position, according to the embodiment of FIG. 33.
Figure 35:
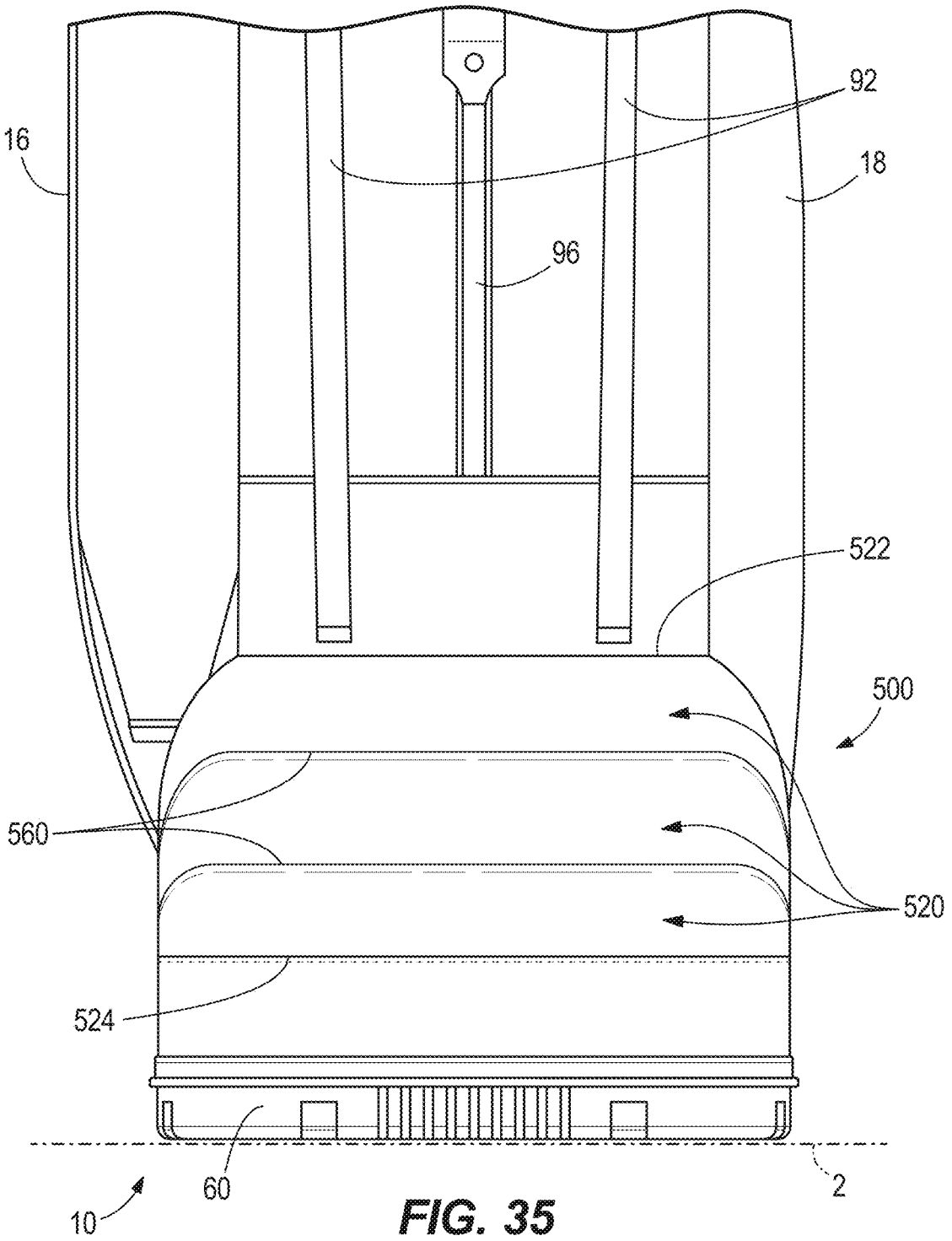
FIG. 35 illustrates a front view of a section of a golf bag in the upright position, according to a fifth embodiment.
Figure 36:
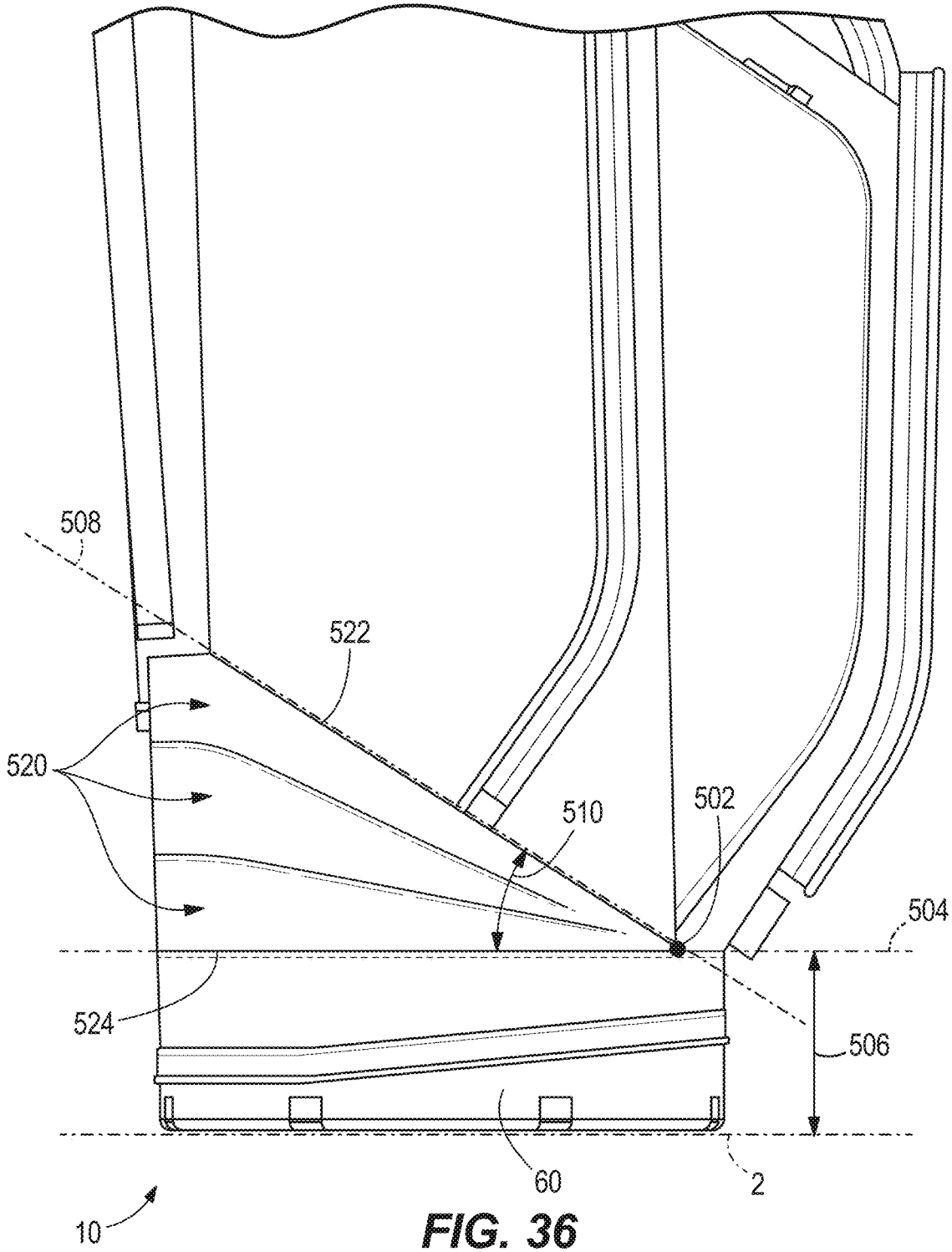
FIG. 36 illustrates a first side view of a section of a golf bag in the upright position, according to the embodiment of FIG. 35.

As shown in the cross section of FIGS. 31 and 32, the golf bag of this embodiment can comprise darting to encourage the fabric of the crush zone 400 outwards, particularly when the golf bag 10 is deployed. As further seen in the cross section of FIGS. 31 and 32, the upper wall 78 of the base ring 74 extends above the attachment point of the crush zone fabric. This attachment point to the base ring 74 allows the walls of the base ring to block the fabric of the crush zone from entering the hollow interior of the bag, as described above.

The crush zone 400, on its own or in combination with other anti-tangle features, can provide the golf bag with a greater base useful area. In some embodiments, the base useful area of the golf bag 10 comprising the crush zone 400, as described above, can increase base useful area by 4 $in^2$ to 10 $in^2$. In some examples, the base useful area is increased by 4 $in^2$, 5 $in^2$, 6 $in^2$, 7 $in^2$, 8 $in^2$, 9 $in^2$, or 10 $in^2$.

VII. EMBODIMENT 5 OF THE CRUSH ZONE

In some embodiments, the golf bag 10, as described above, can comprise a crush zone 500 as described below, according to a fifth embodiment. Referring to FIGS. 33-38, the accordion crush zone 500 can comprise one panel or a plurality of panels 520, a top edge 522, and a bottom edge 524. Many features of the crush zone 500 described below can be applied to a secondary accordion crush zone 550, described in detail below. However, the crush zone 550 does not extend below the pivot plane 504. In some embodiments, the crush zone 500 can be single fabric panel that has been folded, seamed, pressed, or otherwise overlapped on itself to allow dynamic change of the size of the panel 520. The accordion panel 520 can also be called a bellows panel. In alternate embodiments, the accordion panel 520 can be formed from multiple panels or strips of fabric that are sewn together.

The crush zone 500 can comprise dimensions similar to those described generically above, with reference to the figures of the crush zone 100. The crush zone 500 can be similar in many ways to the crush zones 100, 200, 300, 400 described above, however, in some embodiments, the crush zone 500 can have a relatively flat profile, rather than bulged, since the accordion design allows the crush zone fabric to naturally fold over itself without collapsing inwards toward the hollow interior. In some embodiments, the crush zone 500 can bulge outwards along multiple accordion folding lines 560, to bias the crush zone 500 to fold outwards.

Referring to FIGS. 33-38, in some embodiments, the golf bag crush zone can comprise between 1 and 15 accordion folding lines. In some embodiments, the golf bag crush zone 500 can comprise 1, 2, 3, 4, 5, 6, 7, 8, 9, 10, 11, 12, 13, 14, or 15 accordion folding lines 560. Referring to FIGS. 31 and 32, when the golf bag 10 is moved from the upright configuration to the deployed configuration, the accordion folding lines 560 can fold out and over the panels 520. The accordion folding lines of the crush zone 500 can be aligned to converge or run parallel to one another. In some embodiments, the accordion folding lines converge approximately at the pivot point downwards. The accordion folding lines do not fold into the hollow body of the golf bag 10.

Similarly, referring to FIGS. 33-38, in some embodiments, the accordion panel 520 can comprise between 1 and 16 panels 520. In some embodiments, the golf bag crush zone 500 can comprise 1, 2, 3, 4, 5, 6, 7, 8, 9, 10, 11, 12, 13, 14, 15, or 16 accordion panels 520. Each panel 520 is defined by at least one accordion folding line 560. The accordion panel 520 fabric can bend approximately at a midline between the adjacent accordion folding lines 560. In an upright configuration, each panel 520 can have a maximum height, measured perpendicular to the ground plane 2 and parallel to the flat 20, between 0.5 inch and 3 inches. In some examples, the maximum height can be 0.5 inch to 1 inches, 1 inch to 1.5 inches, 1.5 inches to 2 inches, 2 inches to 2.5 inches, or 2.5 inches to 3 inches. Each panel 520 can have the same or similar maximum height.

Figure 39A:
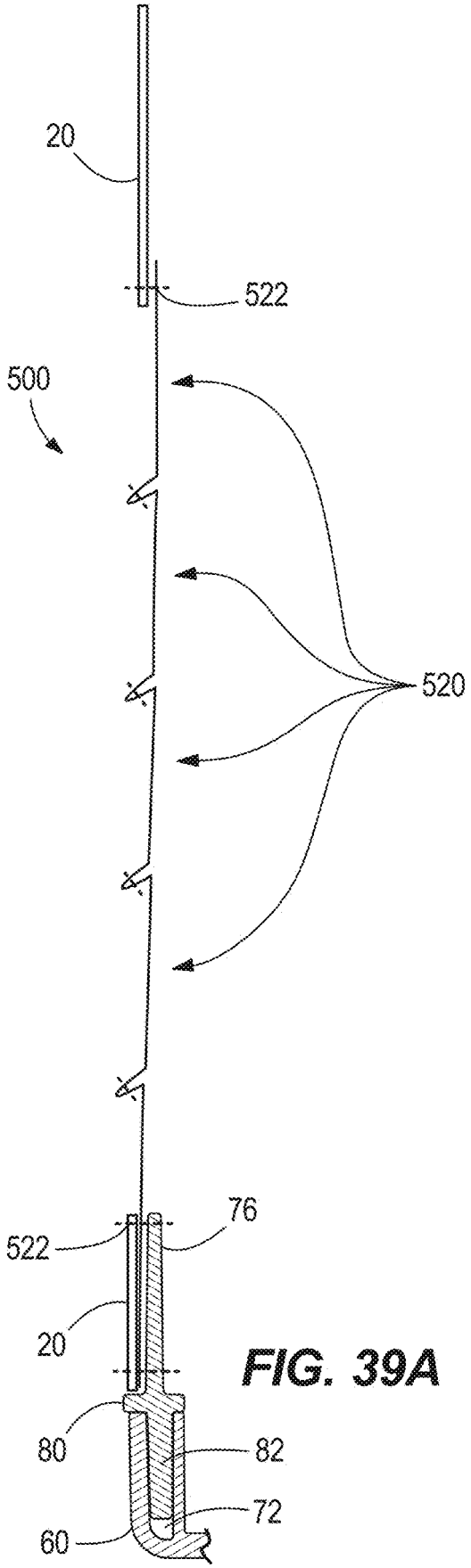
FIG. 39A illustrates a cross sectional view of a section of the golf bag in the upright position, according to the fifth embodiment.
Figure 39B:
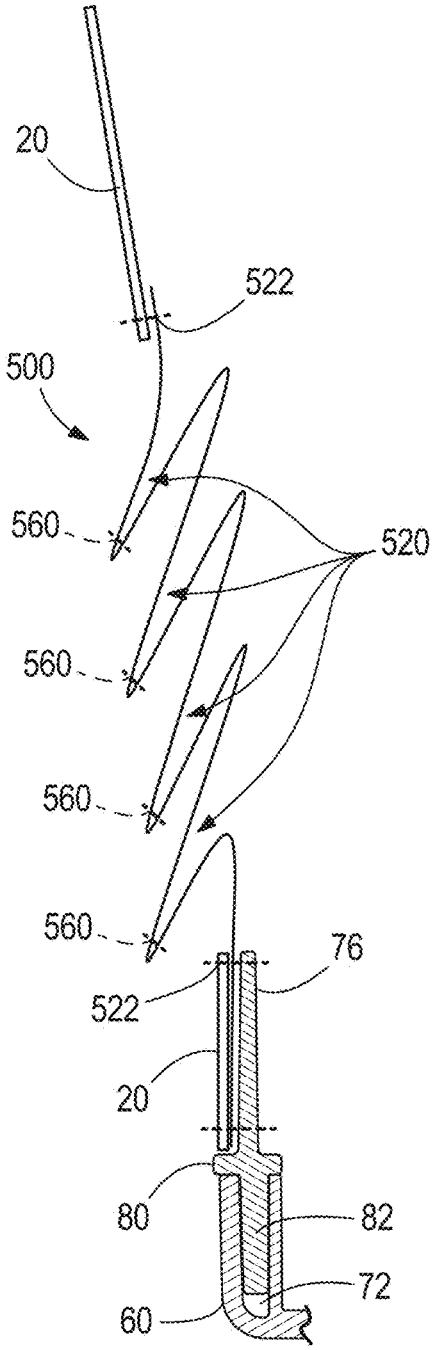
FIG. 39B illustrates a cross sectional view of a section of the golf bag in the deployed position, according to the fifth embodiment.
Figure 40:
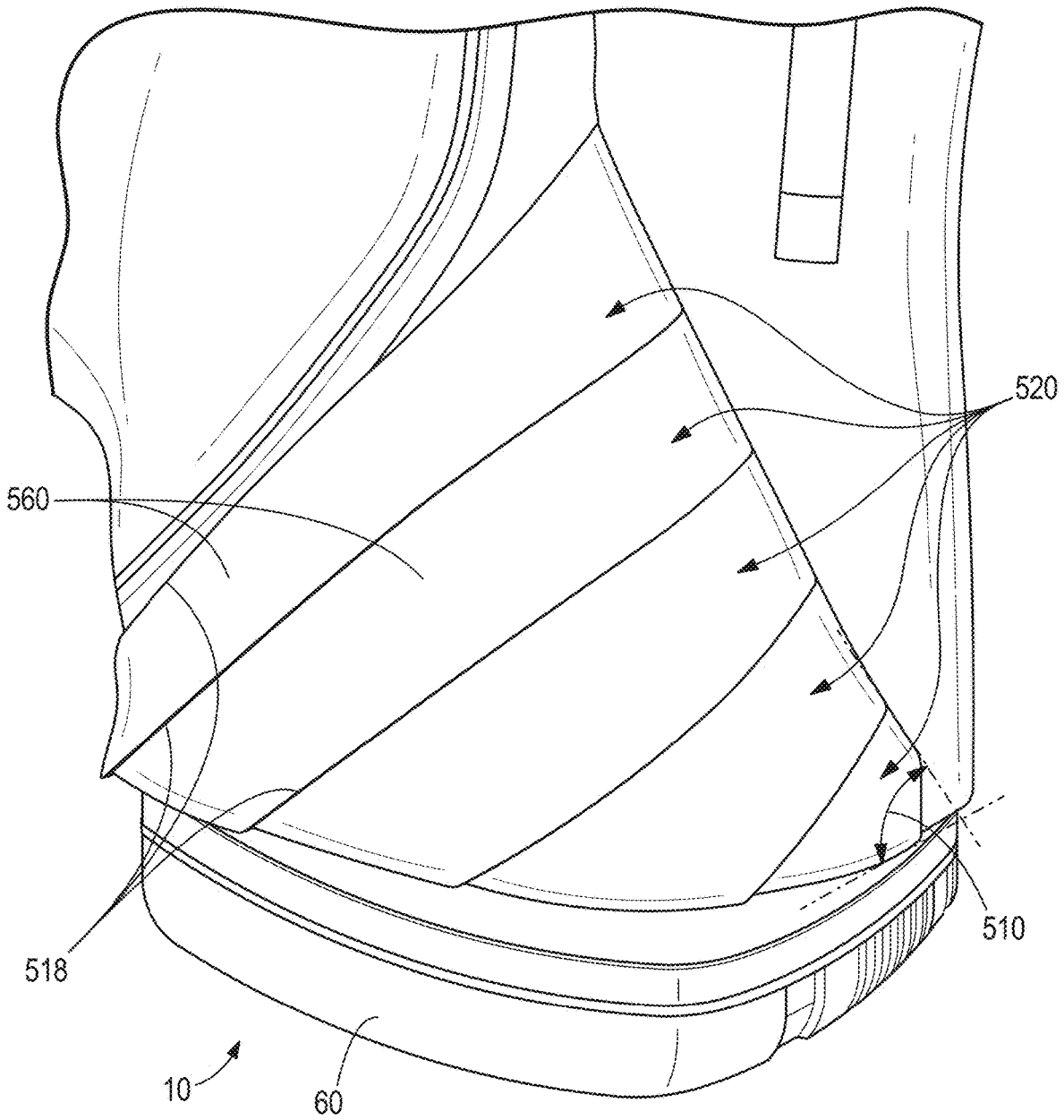
FIG. 40 illustrates a perspective view of a section of a golf bag in an upright position, according to an alternate embodiment.

In some embodiments, the accordion folding lines can be formed by one or more external seam ridges. Each external seam ridge can bias the adjacent fabric of the accordion panel to collapse, fold, or overlap outwards. The one or more external seam ridges extend slightly outwards from the flat. As shown in the cross section of FIG. 39, the external seam ridges can comprise a short overlap of flat material that is stitched to itself. The one or more external seam ridges can be stitched into a single fabric pattern piece (accordion panel) to form multiple accordion folding lines across the crush zone.

Each accordion folding line can be parallel or nearly parallel to at least one adjacent accordion folding line. The accordion folding lines can be oriented in any direction that facilitates proper folding of the crush zone 500. For example, the accordion folding lines can be oriented roughly linear and roughly horizontal across the front 12 of the golf bag 10, when viewed from a front view. Alternately, as shown in FIGS. 33-38, the accordion folding lines can be oriented at an angle across the sides 16, 18 of the golf bag 10, similar to the folding seam 260 between the upper and lower panels 220, 230 in the second crush zone 200.

Figure 37:
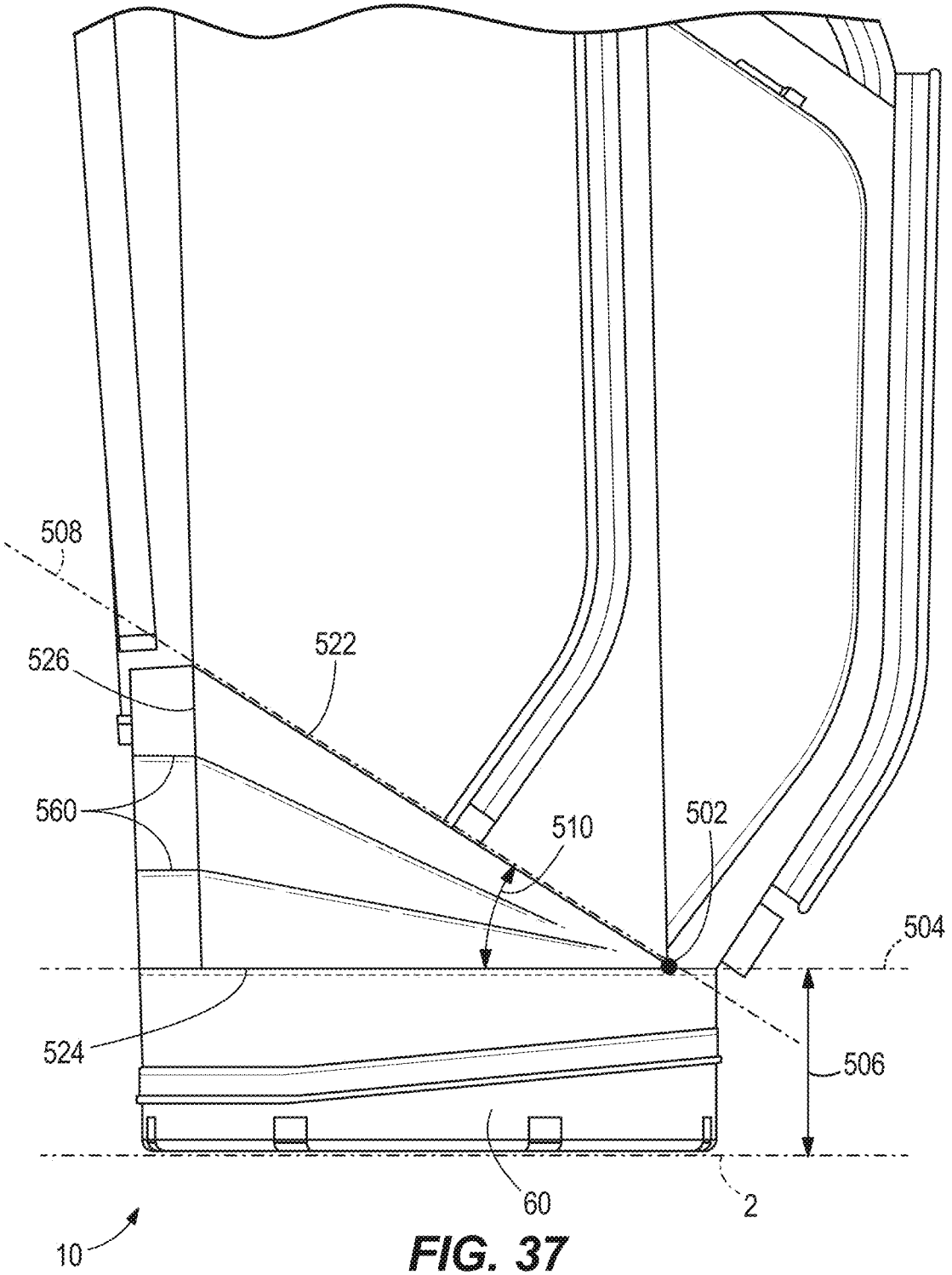
FIG. 37 illustrates a first side view of a section of a golf bag in the upright position, according to an alternate embodiment.
Figure 38:
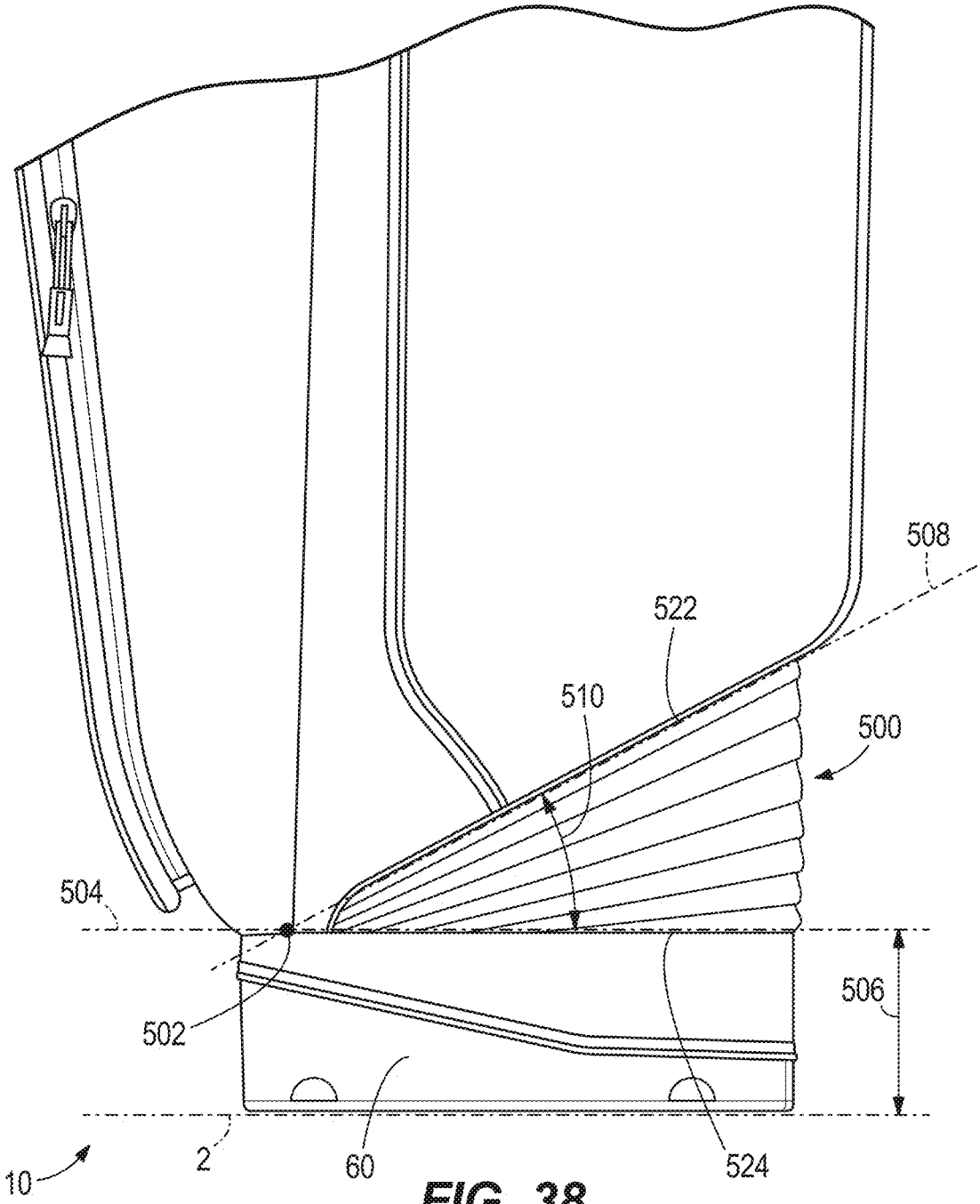
FIG. 38 illustrates a first side view of a section of a golf bag in the upright position, according to an alternate embodiment.

Referring to FIG. 37, the crush zone 500 can further comprise one or more vertical seams 526. The vertical seams 526 can extend between the top edge 522 and the bottom edge 524 and, in some embodiments, can connect with both the top edge 522 and the bottom edge 524. In some embodiments, the vertical seams can be oriented perpendicular to the accordion folding lines 560. In some embodiments, the vertical seams are located only on the center panel 520 of the crush zone 500. In these and other embodiments, the vertical seams can be oriented in a direction perpendicular to the accordion folding lines only on the center panel. The vertical seams 526 provide rigidity and support to the crush zone and, in some embodiments, can guide or alter the way the crush zone collapses.

Referring to FIG. 28, in many embodiments, the bottom edge 524 of the accordion panel 520 extends below the pivot plane 504. Referring to FIGS. 34-38, in some embodiments, the accordion crush zone 550 can be similar to the extended accordion crush zone described above, but can be shortened such that its bottom end does not extend below the pivot plane 504. In many of these embodiments, the shortened accordion crush zone 550 can terminate along the pivot plane 504 or near the pivot plane 504. In many of these embodiments, the shortened accordion crush zone 550 at the top edge 78 of the base ring 74.

The crush zones 500, 550, on its own or in combination with other anti-tangle features, can provide the golf bag with a greater base useful area. In some embodiments, the base useful area of the golf bag 10 comprising the crush zones 500, 550, as described above, can increase base useful area by 4 $in^2$ to 10 $in^2$. In some examples, the base useful area is increased by 4 $in^2$, 5 $in^2$, 6 $in^2$, 7 $in^2$, 8 $in^2$, 9 $in^2$, or 10 $in^2$.

VIII. BASE DIVIDING RIBS

Club tangle can also occur or be aggravated without constriction of the base 640 or mid-useful areas 644. Placing the golf bag 10 in a sideways position (where the tubular body is roughly horizontal) can cause unwanted shaft 6 and grip 8 movement, as gravity pulls the grips 8 downwards.

Golf bags are often carried in the sideways position and stowed sideways in the trunk of a vehicle. In a golf bag lacking the herein described anti-tangle features, the club heads are constrained within the divider top frame pockets 46, but the grips 8 are free to fall into a confined region of the base 60, causing club tangle.

As mentioned, club tangle can occur as a result of grip 8 or shaft 6 movement during bag use. Clubs may remain optimally untangled from each other when the shafts 6 and grips 8 remain parallel to their entry point 46 at the divider top 40. In this way, the club shafts 6 are relatively parallel to the sides of the golf bag flat 20 as well. The golf club head, shaft, and grip create a plane that remains relatively parallel to the golf bag flat in both the upright and deployed positions. This not only optimizes useful bag area 644, but also prevents shafts and grips from crossing over or tangling each other in a way that makes it difficult to remove a club from the golf bag 10. This may be accomplished by defining regions for the grips of each golf club 4 or clubs to remain situated in when the clubs are placed in the golf bag 10 and the bag is used for play.

Figure 41:
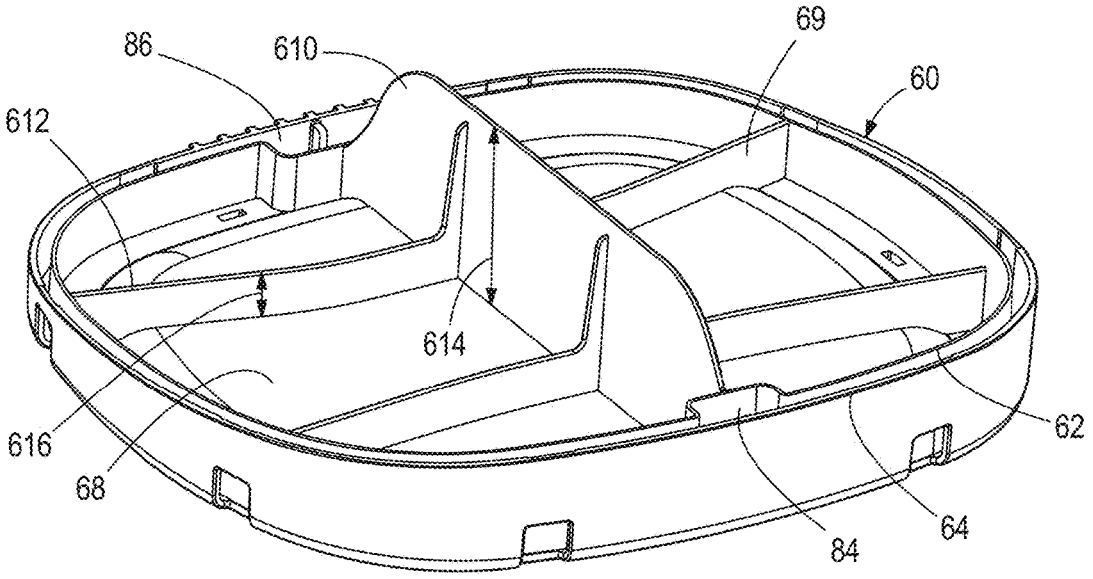
FIG. 41 illustrates a perspective view of a base with rib features, according to one embodiment.
Figure 42:
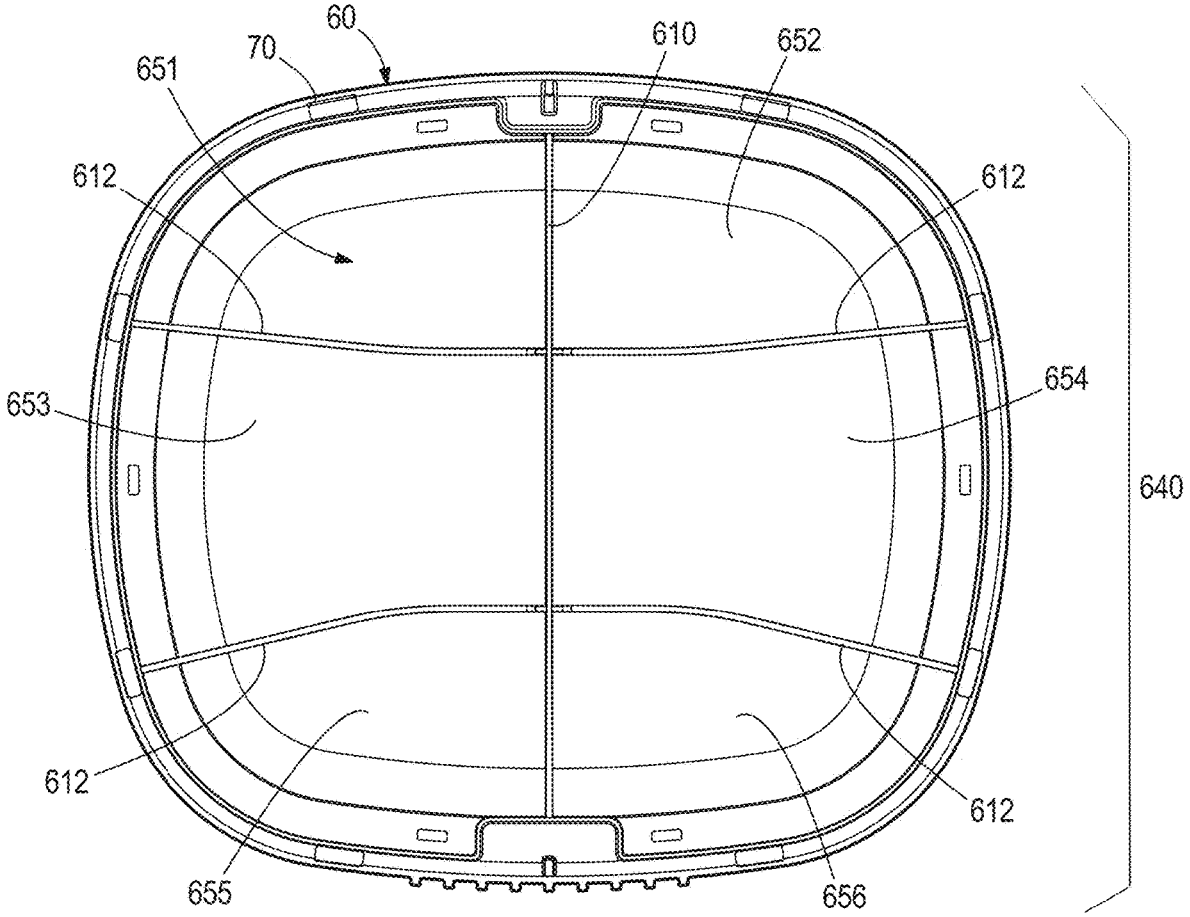
FIG. 42 illustrates a top view of a base with rib features, according to the embodiment of FIG. 39.
Figure 43:
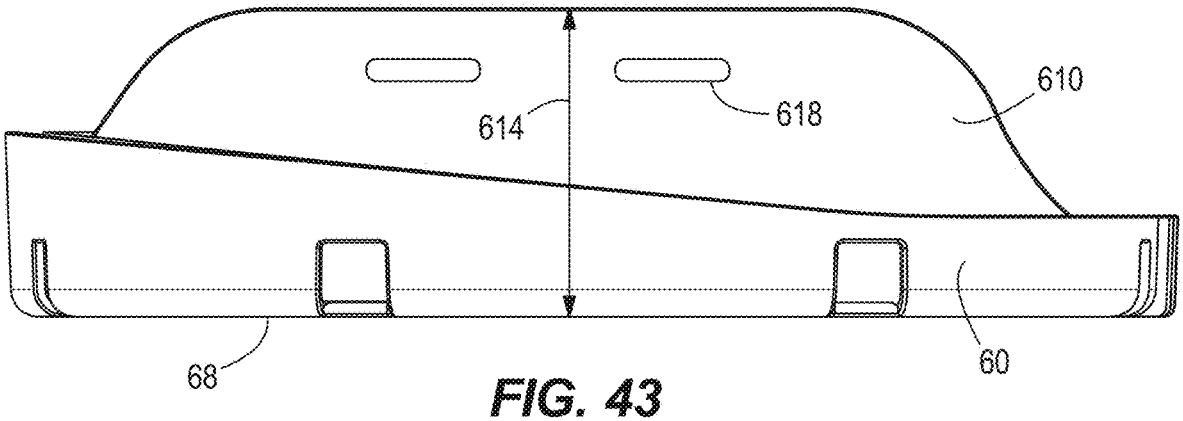
FIG. 43 illustrates a side view of a base with a middle rib comprising apertures, according to one embodiment.
Figure 44:
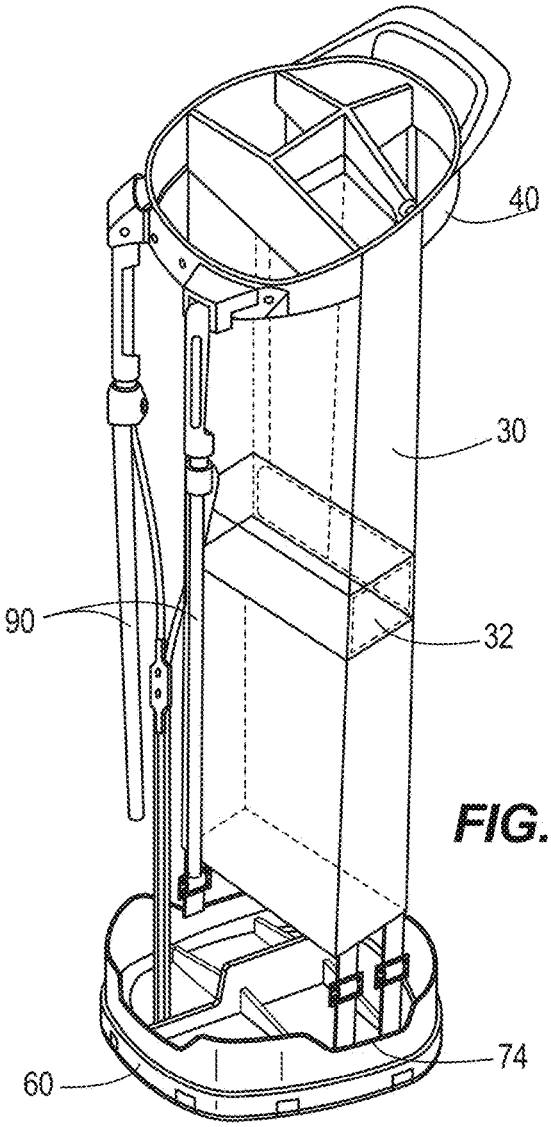
FIG. 44 illustrates a perspective view of a golf bag skeleton, according to one embodiment.
Figure 45:
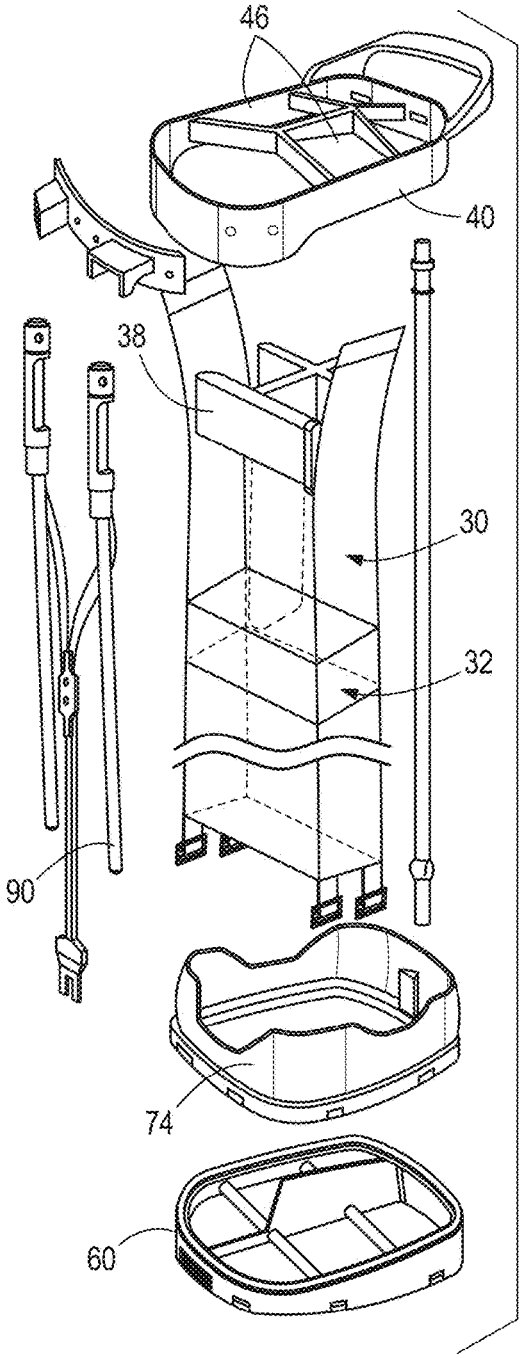
FIG. 45 illustrates an exploded view of a golf bag comprising reinforcing panels, according to one embodiment.
Figure 46:
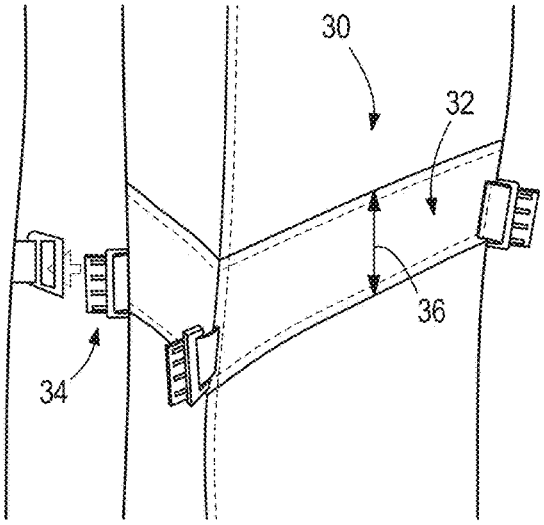
FIG. 46 illustrates a divider sleeve comprising reinforcing panels, according to one embodiment.

Referring to FIGS. 41-43, in some embodiments, the base 60 can further comprise one or more dividing ribs 69 located on the bottom panel 68. The one or more dividing ribs 69 can be formed integrally with the base 60 or attached with connection means such as adhesive, snaps, or other suitable means. These dividing ribs 69 can act as a wall to separate and organize club grips 8 during bag use. As mentioned, club tangle may be reduced by maintaining the position of each golf club 4 in a plane relatively parallel to the golf bag flat 20. The dividing ribs 69 define regions for the grips 8 to remain throughout removal, reentry, and bag use. When the golf bag 10 moves from the upright position to the deployed position, there is opportunity for the grips 8 to fall forward and tangle near the front 12 of the bag 10. Further, when the golf bag 10 is carried, the club grips 8 may shift to one side and tangle as the user moves. However, the dividing ribs 69 in this embodiment could create a barrier in order to prevent the grips 8 from all falling in one direction during bag use.

The dividing ribs 69 along the base bottom panel 68 can prevent club clutter as well as decrease the amount the club heads bump into each other, reducing any subsequent club damage that may occur as a result of tangled clubs. Of the one or more dividing ribs 69, there can be one middle rib 610 and one or more secondary ribs 612. Specifically, there can be one middle rib 610 spanning across the bottom panel 68 of the base in the front to back direction.

The base 60 can define one or more secondary ribs 612 that stretch between the base inner wall 62 and the middle rib 610, creating regions for separating the club grips 8. The ribs 69 may be formed with the base 60 in such a way that the regions of the base 60 formed by the dividing ribs 69 correspond with the regions formed by the divider top club pockets 46. Establishing the same or similar regions within the divider top 40 and base 60 allows each golf club 4 to sit within golf bag 10 in the plane relatively parallel to the golf bag flat 20 and keeps the grips 8 and shafts 6 of each golf club 4 distanced apart.

In this example, middle rib 610 is taller than the secondary ribs 612. The middle rib 610 can comprise a height with a range between 1.5 inches and 2.5 inches. In some embodiments, the middle rib 610 can comprise a height between 1.5 inches and 2.0 inches or 2.0 inches and 2.5 inches. In one example, the middle rib 610 can comprise a height of 1.97 inches. The secondary ribs 612 can comprise a height with a range between 0.25 inches and 0.75 inches. In some embodiments, the secondary ribs 612 can comprise a height between 0.25 and 0.50 inches or 0.50 inches and 0.75 inches. In one example, the secondary ribs 612 can comprise a height of 0.5 inches.

In some cases, the dividing ribs 69 can comprise a non-uniform height for ease of manufacture. In some embodiments, the height of the dividing ribs 69 can be determined by the ratio between the club grip diameter and the angle at which the golf bag 10 is being carried by the user. In one embodiment, the club grip diameter is 1 inch, the bag carry angle 28 is 30 degrees, and the height of the secondary ribs 612 is 0.55 inches. In some embodiments, the middle rib 610 can define one or more apertures 618, such as horizontal slots, as shown in FIG. 43. The one or more apertures 618 may be configured to receive divider sleeve straps in order to anchor the divider sleeve 30 to the center of the base 60. This allows the divider sleeve 30 to maintain its position within the center of the bag body 10, acting as a barrier between club regions and further reducing the potential for club tangle.

In a golf bag lacking a base comprising dividing ribs 69, the grips may migrate during bag use. This is may cause club tangle as the grips shift further from their starting region parallel to the club entry point at the divider top club pockets 46

IX. REINFORCED DIVIDER SLEEVE

Another anti-tangle feature, the reinforced divider sleeve, is as described below. In some embodiments, the golf bag 10 comprises a divider sleeve 30 with one or more reinforcement panels 32. The reinforcement panels 32 may prevent the divider sleeve 30 or flat 20 from caving inward and reducing the amount of useful bag mid-area 644. Causes for the flat 20 to cave inward can include overloading of the pockets 22, forces from user loading and unloading the bag, pressure against the bag while being carried, and other forces. As mentioned prior, when the divider sleeve 30 or flat 20 cave inwards, the mid-useful area 644 of the hollow interior of the bag 10 is reduced. This results in the shafts 6 of the clubs 4 within the bag 10 being pushed together and becoming tangled.

In many embodiments, the reinforcement panels 32 can be attached to the divider sleeve 30 in a parallel configuration and wrap horizontally around the divider sleeve 30. The reinforcement panels 32 can be attached at a point along the length of the divider sleeve 30. In some embodiments, this point occurs near the middle of the divider sleeve 30. In one example, the one or more reinforcement panel 32 is attached approximately 45 cm from the bottom of the bag 10. This is a point near the middle of the divider sleeve 30 and thus a point likely to collapse or cave. Reinforcement in this area is most likely to aid the divider sleeve 30 against collapsing inwards.

The golf bag 10 can comprise between 2 and 8 reinforcement panels 32. In some examples, the golf bag 10 can comprise 2, 3, 4, 5, 6, 7, or 8 reinforcement panels 32. The reinforcement panels 32 can attach to the divider sleeve 30 at different sides of the divider sleeve 30 in order to partially or fully surround it. In other embodiments, the one or more reinforcement panels 32 can attach to the same side of the divider sleeve 30 while one or more reinforcement panels 32 attach to a different side of the divider sleeve 30. In some embodiments, one or more reinforcement panels 32 all attach to the same side of the divider sleeve 30.

Each reinforcement panel 32 can comprise a first vertical edge 37*a* and a second vertical edge 37*b*, as well as a first horizontal edge 39*a* and a second horizontal edge 39*b*. When a given reinforcement panel 32 is attached to the divider sleeve 30, the first horizontal edge 39*a* lies on a plane directly above the second horizontal edge 39*b*. The reinforcement panels 32 can be attached to the circumference of the divider sleeve 30 such that the first vertical edge 37*a* of one reinforcement panel 32 abuts or is in close proximity to the second vertical edge 37*b* of an adjacent reinforcement panel 32. The reinforcement panels 32 attach to the divider sleeve 30 material independently from each other such that the panels 32 are allowed a range of motion relative to their attachment position. The reinforcement panels 32 can be sewn in place or attached using adhesive, clips, or other suitable means. Configuring the panels 32 to remain unattached at the divider sleeve 30 corners provide those corners freedom to hinge. In doing so, the individual panels 32 can be readily moved or flattened when the boxed divider 30 is collapsed during packaging. It is advantageous to attach the reinforcement panels 32 to the interior of the bag flat 21 individually in order to allow the bag 10 to flatten during shipping as this reduces the need for a larger box or shipping method to accommodate the full volume, approximately the circumference of the flat 20, of the reinforcement panels 32 when the bag is assembled.

The reinforcement panels 32 can comprise a height 36 measured vertically, when the golf bag 10 is in the upright position. The height of the reinforcement panel 36 may be determined by the height of the first vertical edge 37*a* or the second vertical edge 37*b*. In some embodiments, the first vertical edge 37*a* and second vertical edge 37*b* comprise the same height. In other embodiments, the first vertical edge 37*a* and second vertical edge 37*b* comprise different heights. In either embodiment, the height 36 of the reinforcement panel 32 is determined by the longer of the two vertical edges. The reinforcement panel height 36 can comprise a vertical height that is 5-10% the height of the full divider sleeve. The height 36 of the reinforcement panels 32 can range inclusively from 5-6%, 6-7%, 7-8%, 8-9%, or 9-10% of the divider sleeve height 31. In one embodiment, the reinforcement panel height 36 can comprise 6.5% the divider sleeve height 31.

In a horizontal direction, the one or more reinforcement panels 32 can extend either fully or partially around a given side of the divider sleeve 30. Each reinforcement panel 32 can comprise a total length 38, determined by the length of the first horizontal edge 39*a* or the second horizontal edge 39*b*. In some embodiments, the first horizontal edge 39*a* and the second horizontal edge 39*b* can comprise the same length. In another embodiment, the first horizontal edge 39*a* and the second horizontal edge 39*b* can comprise different lengths. In either embodiment, the total length of the reinforcement panel 32 is determined by the longer of the two horizontal edges. The reinforcement panel 32 can comprise a total length that is 50-100% the length of the divider sleeve side to which it attaches. For example, the total length 38 of the reinforcement panels 32 can range inclusively from 50-60%, 60-70%, 70-80%, 80-90%, or 90-100% the length of the divider sleeve side to which it attaches. The total length of the reinforcement panels can range inclusively from 5 to 25 cm. The total length of the reinforcement panels can be between 5 cm and 10 cm, 10 cm and 15 cm, 15 cm and 20 cm, or between 20 cm and 25 cm. For example, the total length of the reinforcement panels can be 5 cm, 10 cm, 15 cm, 20 cm, or 25 cm.

Figure 47:
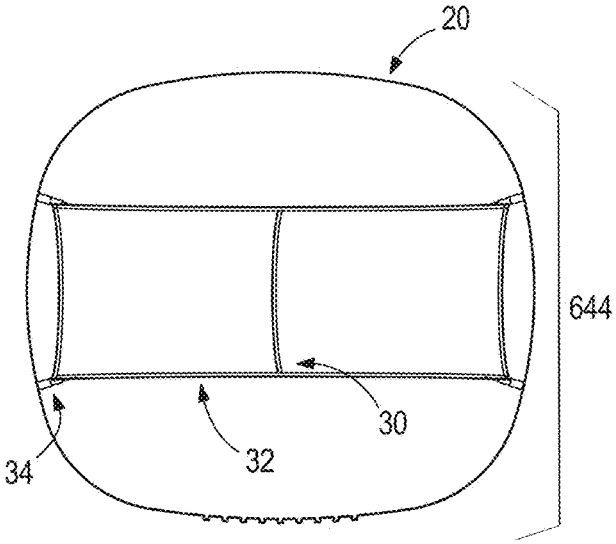
FIG. 47 illustrates a cross sectional view of a divider sleeve comprising reinforcing panels, according to the embodiment of FIG. 45.
Figure 48:
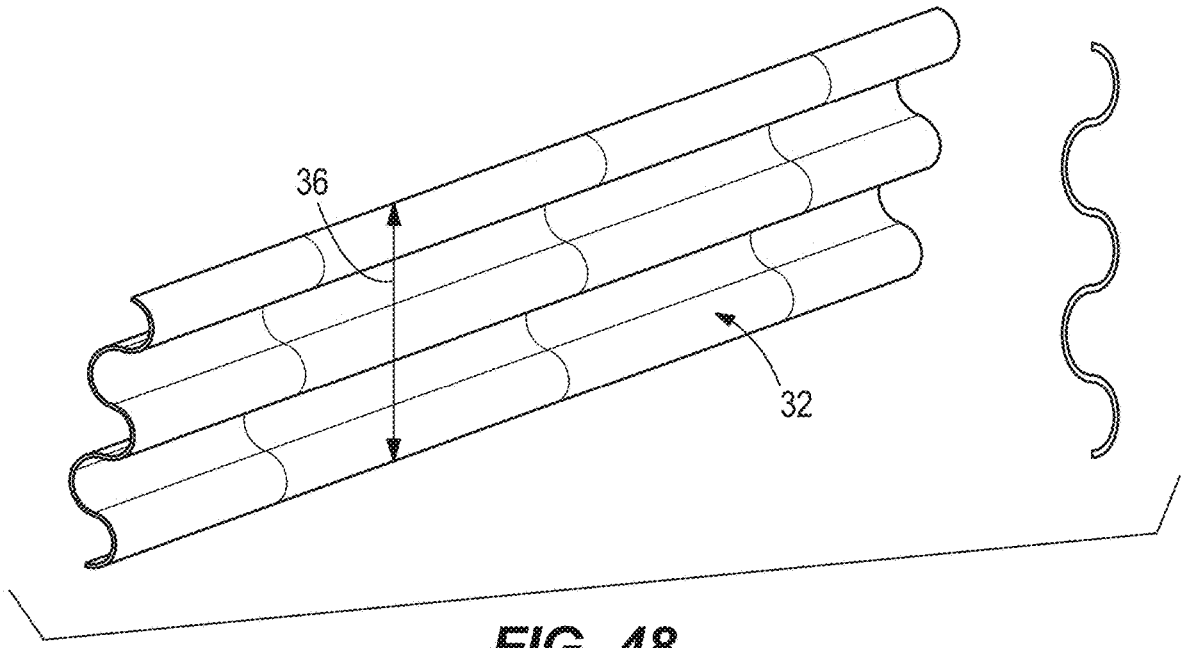
FIG. 48 illustrates a perspective view of a divider sleeve reinforcing panel, according to an embodiment.
Figure 49:
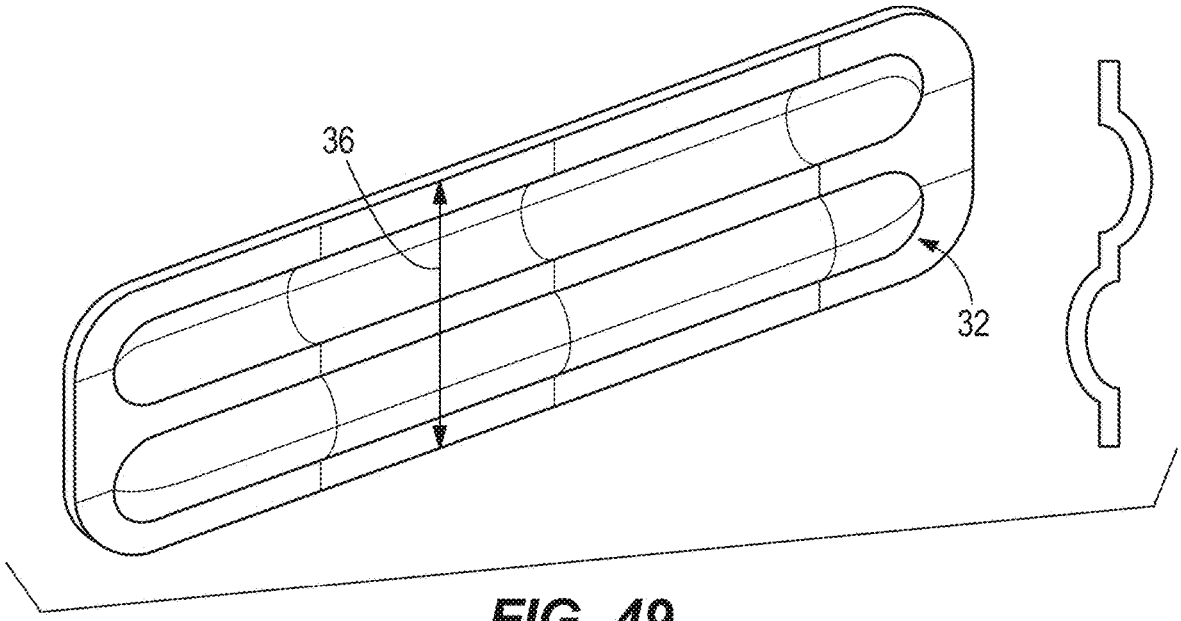
FIG. 49 illustrates a perspective view of a divider sleeve reinforcing panel, according to an alternate embodiment.

The panels 32 can comprise a flat, waved, arced, or other suitable configuration. In some embodiments, the panels may be flat, as shown in FIG. 47. In other embodiments, the panels can comprise a wave configuration as illustrated in FIGS. 48-49. In some embodiments, the panels can define a ribbed, corrugated, or non-flat structure. A reinforcement panel 32 with ribbing or corrugation, for example, is advantageous as it provides the reinforcement panel 32 greater rigidity relative to a flat panel configuration. Reinforcement panel configurations with greater rigidity are desirable as they are resistant to collapse, consequentially preventing the divider sleeve 30 or flat 20 from collapse as well.

The material of the one or more reinforcement panels 32 is preferably thin, relatively tough, and able to be sewn in place. For example, the one or more reinforcement panels 32 can comprise polyethylene (PE) board, fiberglass composite sheet, carbon fiber composite sheet, or any other suitable material. In some embodiments, the one or more reinforcement panel 32 is comprised of PE board. The yield tensile strength of the material of the reinforcement panels 32 is preferably within the inclusive range of 11 MPa to 43 MPa. The yield tensile strength of the reinforcement panel 32 material can be 11 MPa to 19 MPa, 19 MPa to 27 MPa, 27 MPa to 35 MPa, or between 35 MPa and 43 MPa.

In one embodiment, the reinforcement panels 32 are attached to the exterior of the divider sleeves 35 with divider material sewn above and below the total length of the panel 38, acting as a sheath to secure each panel 32 in place. The divider sleeve material can encompass the reinforcement panel 32 fully or partially in order to hold the reinforcement panel 32 in place. For example, the golf bag 10 can comprise four reinforcement panels 32 sewn to the exterior of the divider sleeve material 35 as described. The four reinforcement panels 32 can be sewn on each side of the divider sleeve 30 to wrap around the divider sleeve 30 and form a pseudo-rectangle shape. Although the panel attachment configuration wraps horizontally around the divider sleeve, each panel 32 lies upright, or vertical, in order to extend the length of reinforcement provided to the divider sleeve 30 and lie smoothly across the divider sleeve surface 35.

In an alternative embodiment, the one or more reinforcement panels 32 can be attached to the interior of the golf bag flat 21 rather than to the divider sleeve 30. The reinforcement panels 32 can attach to the interior of the flat 21 in order to prevent the flat 20 from caving inward during bag use, causing the club shafts 6 to shift inwards and tangle. The reinforcement panels 32 in one embodiment can attach to the bag flat 20 near the middle of the bag, where caving is most likely to occur. The panels 32 can attach to the interior of the flat 21 in a similar manner to the means in which they may attach to the divider sleeve 30. These attachment means include clips 34, stitching, adhesive, or other suitable means. In one example, the reinforcement panels 32 attach to the interior of the golf bag flat 21 at a location near the middle of the flat 20 via clips 34 connecting the panels 32 to the fabric of the flat 21. In this example, a first clip 34 attaches the first vertical edge 37*a* of a reinforcement panel to the flat while a second clip 34 attaches the second vertical edge 37*b* of the reinforcement panel to the flat 20.

In some embodiments, the reinforcement panels 32 can further comprise clips 34 located at the first vertical edge 37*a* and the second vertical edge 37*b* of the panel 32. The clips 34 may connect the reinforcement panels 32 to the divider sleeve 30, to each other, or, alternatively, to the interior of the bag flat 21. As shown in the cross section of the flat 20, the reinforcement panels 32 may further comprise complimentary clips 34 at the same height within the bag as the reinforcement panels 32. The clips 34 of the reinforcement panels 32 can connect to the complimentary clips of the flat 20 at each corner to secure their position within the bag 10 and further strengthen the divider sleeve 20 from collapse. The clips 34 can function as an attachment feature and can be configured to hold the reinforcement panels 32 taut.

Since the base useful area 640 designates a region in which the grips 8 can sit, a larger base useful area corresponds to more available space for the grips 8. A smaller base useful area corresponds to less space for the grips 8. A smaller base useful area 640 will result in more club tangle because the grips 8 are forced to be more densely packed. The mid-useful area 644 illustrates the space available for storage of golf club shafts 6.

The mid-useful area 644 can be reduced by sagging of the flat fabric caused by over-filling the pockets, lifting the bag into a sideways configuration, constricting the sides of the flat by tightening a cart strap around the bag, or other movements that press the flat inward. The divider sleeve structure 30, as described above, can help reduce constriction of the mid-useful area 644.

X. HIP PAD, RAIN HOOD POCKET

In some embodiments, the golf bag 10 may further comprise a rain hood pocket panel 23. Overloading of the rain hood pocket 22*f*, pressure from being carried, or other forces may cause the rain hood pocket 22*f* to partially collapse into the hollow interior of the bag 10. If the rain hood pocket 22*f* collapses into the hollow interior of the bag 10, the rain hood pocket 22*f* can impede the clubs 4 from being placed into the tubular body as well as press against clubs already within the bag 10, causing the clubs 4 to tangle. The rain hood pocket panel 23 can lie between the rain hood pocket 22*f* and the hollow interior of the golf bag 10 in order to prevent the rain hood pocket 22*f* from collapsing inwards and reducing useful bag area 644.

The rain hood pocket panel 23 can comprise a shape similar to that of the rain hood pocket 22*f*. Alternatively, the rain hood pocket panel 23 can comprise a shape smaller than that of the rain hood pocket 22*f*.

In many embodiments, the rain hood pocket panel 23 can attach to the interior of the rain hood pocket 22*f* or the interior of the flat 21 on the second side 18 of the bag 10. The rain hood pocket panel 23 can attach via stitching, adhesive, Velcro™ or other suitable means. In another embodiment, the rain hood pocket 22*f* can further comprise a sleeve (not pictured) configured to receive the rain hood pocket panel 23. For example, the interior of the rain hood pocket 22*f* can comprise an additional sheet of fabric between the bag flat 20 and the interior space of the rain hood pocket 22*f* to form a sleeve. The rain hood pocket panel 23 can slide into this sleeve and lie flat between the rain hood pocket 22*f* and bag body 10.

The rain hood pocket panel 23 can comprise a material with similar features as those of the reinforcement panels 32, although preferably stronger. The material of the rain hood pocket panel 23 is preferably thin and tough. For example, the rain hood pocket panel 23 can comprise polyethylene polypropylene, fiberglass composite sheet, carbon fiber composite sheet, or any other suitable material. In some embodiments, the rain hood pocket panel 23 is comprised of polypropylene. The yield tensile strength of the rain hood pocket panel material can range inclusively between 30 MPa and 45 MPa. For example, the yield tensile strength of the rain hood pocket panel material can be between 30 MPa and 35 MPa, 35 MPa and 40 MPa, 40 MPa and 45 MPa, or 45 MPa and 50 MPa.

In a bag lacking a rain hood pocket panel 23, the rain hood pocket 22*f* or any other miscellaneous item within the rain hood pocket can press against the flat 20 of the golf bag 10. This results in the flat 20 caving into the hollow interior of the bag 10, causing a reduction in mid-useful area 644. Reduction in mid-useful area 644 can cause club shafts within the bag to push against each other due to the reduced space, causing club tangle and making it difficult to place or remove clubs from the bag 10. A rain hood pocket panel 23 prevents the rain hood pocket 22*f* or any miscellaneous item in that area from pushing against the flat, thus maintaining a greater mid-useful area 644 than a golf bag lacking any such anti-tangle feature.

XI. METHOD

The flat of the golf bag comprises a durable fabric. During the manufacturing of the golf bag, the various panels of the flat are cut from a sheet of fabric. Cutting large panels or pattern pieces from the sheet of fabric can result in unusable waste fabric. Designing the flat pattern with smaller panels, such as the upper panel and lower panel, allows the panels to be cut more efficiently from the sheet, resulting in less fabric waste. Therefore, the golf bag design described above not only comprises an improved function over the prior art, but also reduces waste and lowers manufacturing cost.

XII. EXAMPLES

Example 1

The instances in which a golf club showed resistance upon removal from an exemplary golf bag after use was compared to the instances in which a golf club showed resistance upon removal from a standard golf bag after use. The exemplary golf bag in this example comprised a crush zone design similar to crush zone 100 and a base ring 74. The standard golf bag in this example lacked any crush zone or anti-leg tangle features as described here within. The remaining dimensions as well as structures of the standard golf bag and the exemplary were the same throughout the two bags.

Each bag was filled with a full set of fourteen clubs throughout the divider top pockets when the bags were in the deployed position. The bags were then moved into the upright position, picked up by the straps, and carried 20 feet. The bags were then placed in the deployed position, and each club was removed and recorded for whether or not the club showed resistance upon removal from each bag. Resistance in this instance can be equated with club tangle, seeing as tangling of the clubs is a direct cause of resistance against club removal.

The standard golf bag lacking any crush zone feature showed larger quantities of club resistance upon removal from the bag. Of the fourteen clubs tested from the standard bag, eight of the clubs from the standard bag resisted removal from the bag after use. The exemplary golf bag with a crush zone 100 showed lower quantities of club resistance upon removal from the bag. Of the fourteen clubs tested from the exemplary example bag, five of the clubs from the exemplary example bag resisted removal from the bag after use. This illustrates the standard bag created 21.43% more club tangle than the exemplary golf bag. This improvement in preventing golf club tangle was due to an increase in base useful area.

Specifically, it was determined through computer analysis that the base useful area of the standard bag was 42 $in^2$ in the deployed position. The base useful area of the exemplary example bag was 49 $in^2$ in the deployed position. This additional base useful area is indicative of the cause for the lower quantities of club resistance upon removal. Furthermore, the base ring further contributed to the over 21% improvement in preventing club tangle.

TABLE 1

Standard Bag Club Resistance vs. Exemplary Bag Club Resistance

| | Base useful area (in the deployed position) | Number of clubs resistant upon removal | Percent clubs resistant upon removal |
|---|---|---|---|
| Standard bag lacking crush zone | 42 $in^2$ | 8 | 57.14% |
| Exemplary example bag with crush zone | 49 $in^2$ | 5 | 35.71% |

As shown in Table 1, use of the standard bag resulted in higher amounts of resistance from the clubs upon removal. As discussed thoroughly above, club tangle can result in difficulty, or resistance, upon attempt to remove clubs. Because the clubs showed higher levels of resistance in the standard bag, the standard bag reflects higher occurrence of club tangle. Conversely, because the clubs in the exemplary example bag showed lower levels of resistance upon removal, the exemplary example bag reflects lower occurrence of club tangle. Such is indicative that the introduction of the crush zone 100 or similar anti-tangle feature can reduce club tangle.

Example 2

Figure 50A:
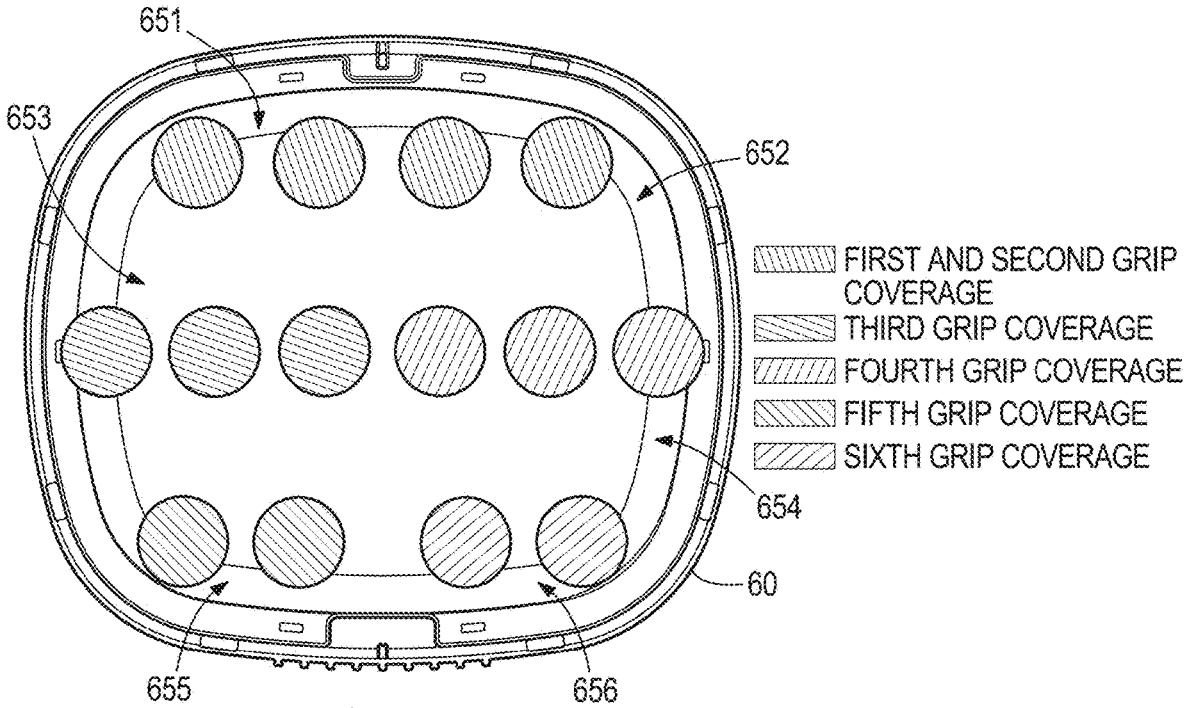
FIG. 50A illustrates a top view of a base lacking dividing ribs depicting the starting position of 14 club grips.
Figure 50B:
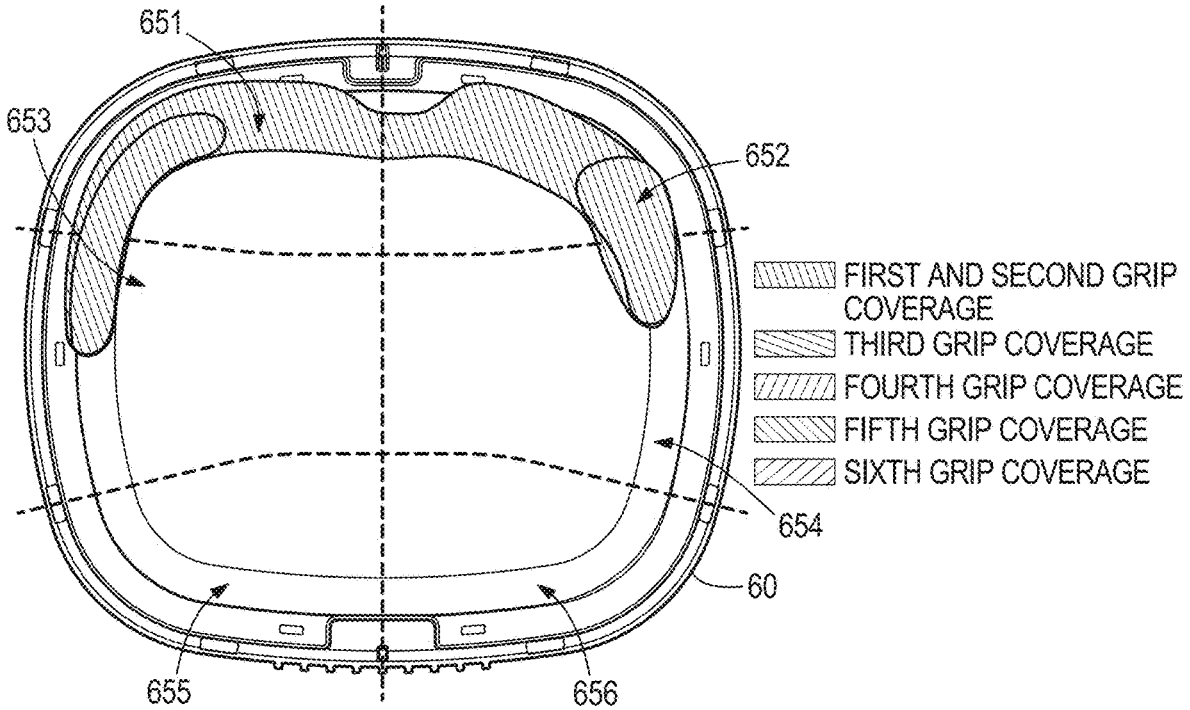
FIG. 50B illustrates a top view of the base of FIG. 50A depicting the movement of the club grips from the back left and back right starting regions of the base.
Figure 50C:
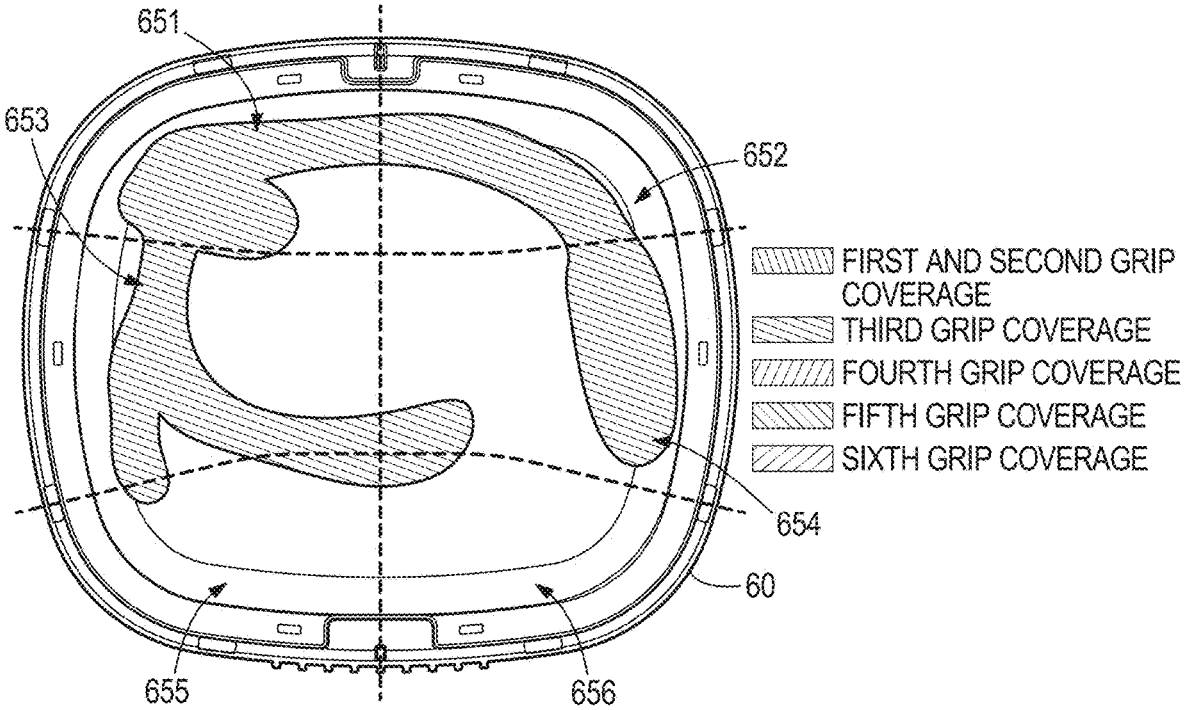
FIG. 50C illustrates a top view of the base of FIG. 50A depicting the movement of the club grips from the center left starting region.
Figure 50D:
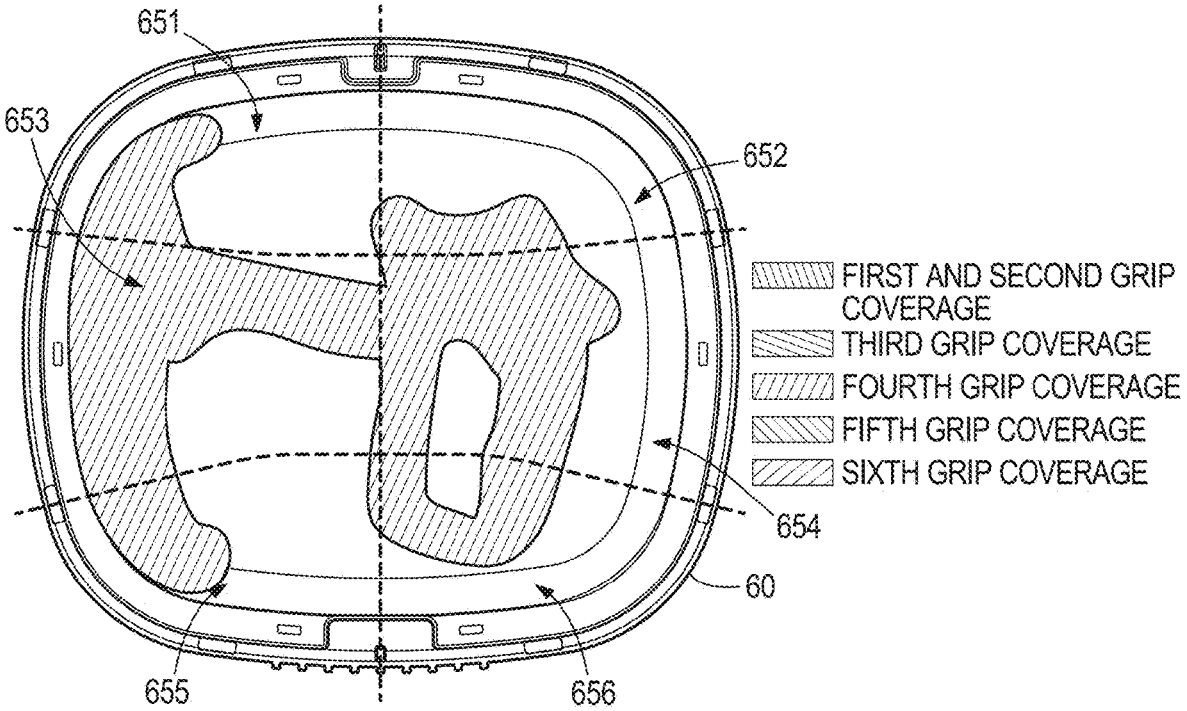
FIG. 50D illustrates a top view of the base of FIG. 50A depicting the movement of the club grips from the center right starting region.
Figure 50E:
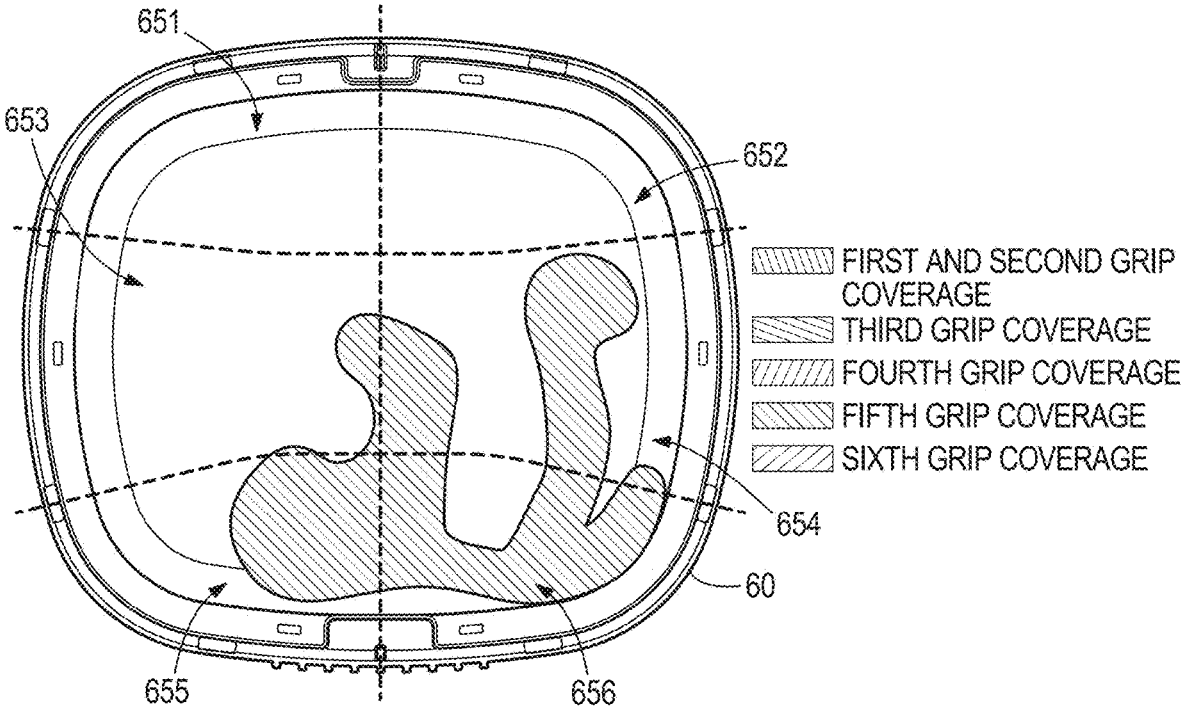
FIG. 50E illustrates a top view of the base of FIG. 50A depicting the movement of the club grips from the front left starting region.
Figure 50F:
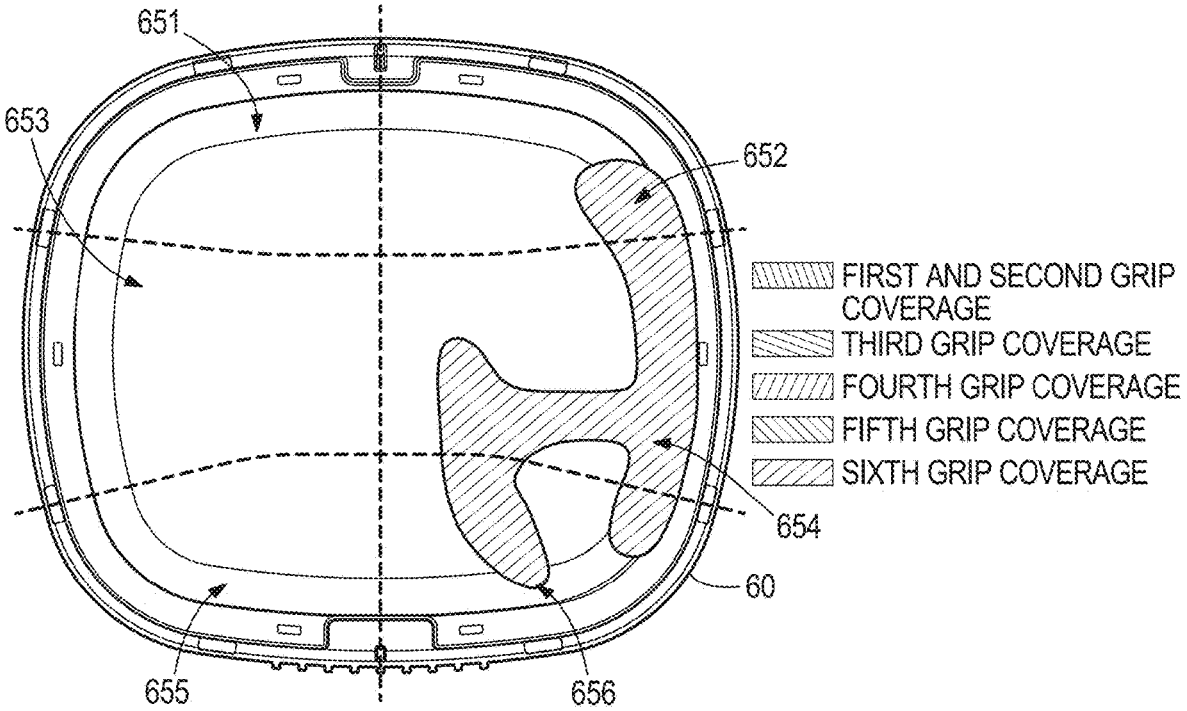
FIG. 50F illustrates a top view of the base of FIG. 50A depicting the movement of the club grips from the front right starting region.
Figure 51A:
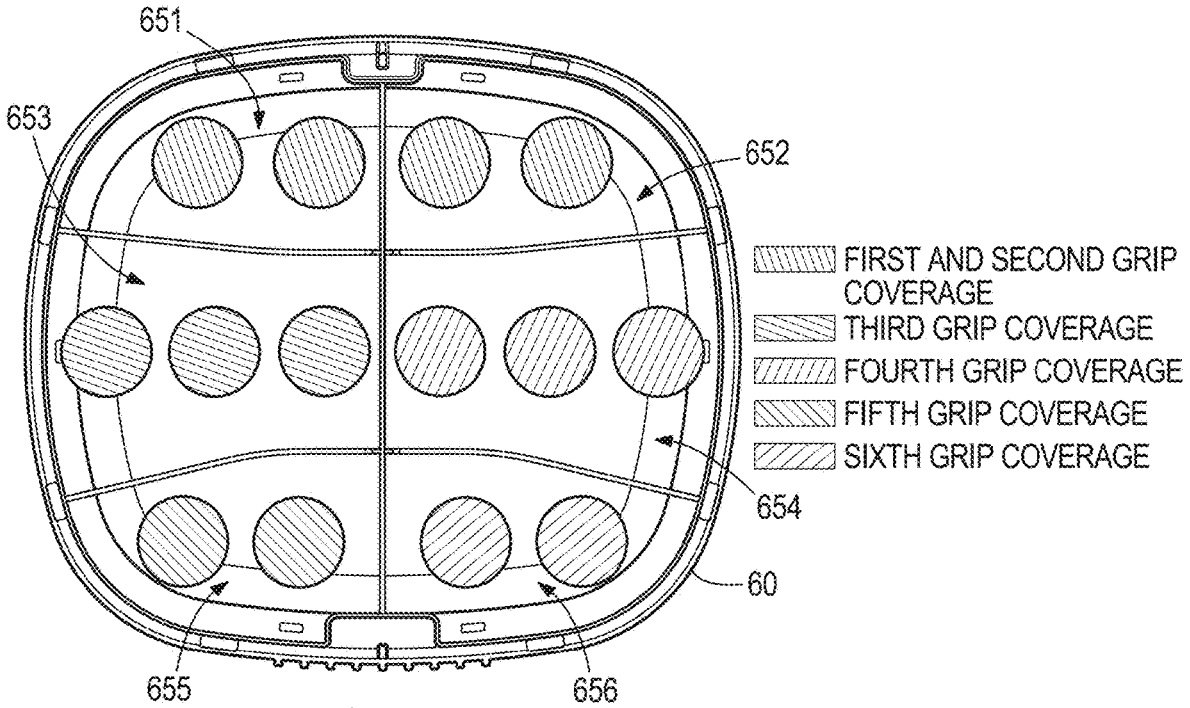
FIG. 51A illustrates a top view of a base comprising dividing ribs depicting the starting position of 14 club grips.
Figure 51B:
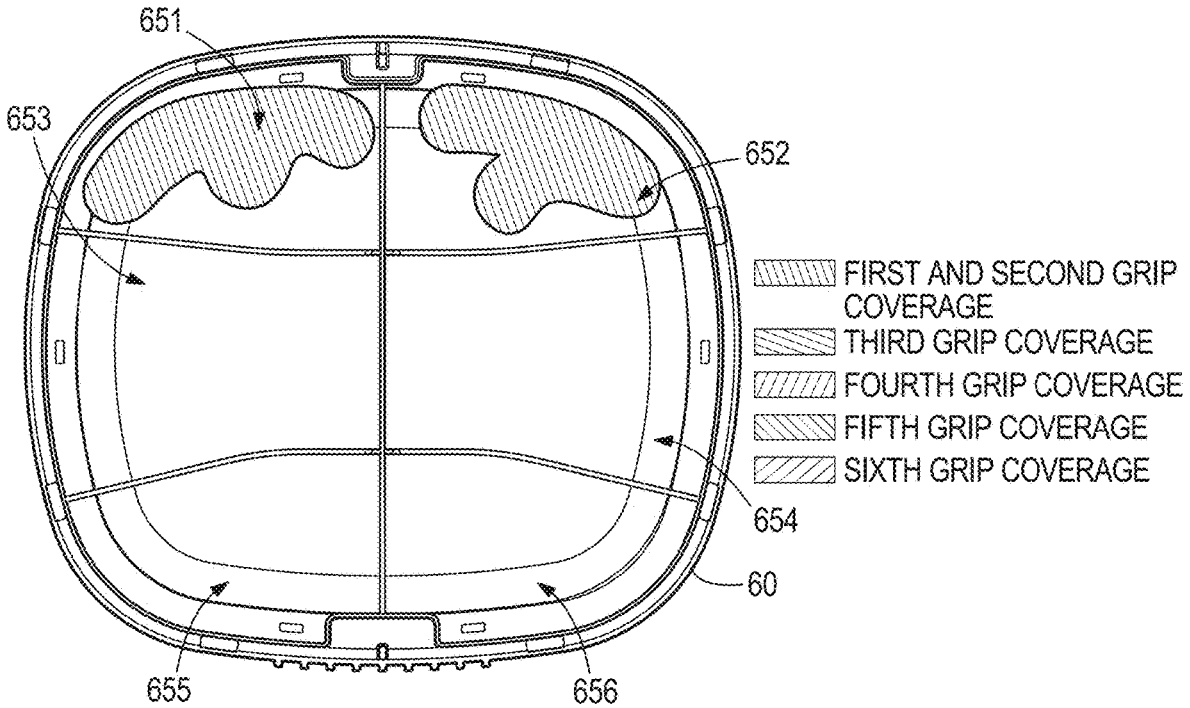
FIG. 51B illustrates a top view of the base of FIG. 51A depicting the movement of the club grips from the back left and back right starting regions of the base.
Figure 51C:
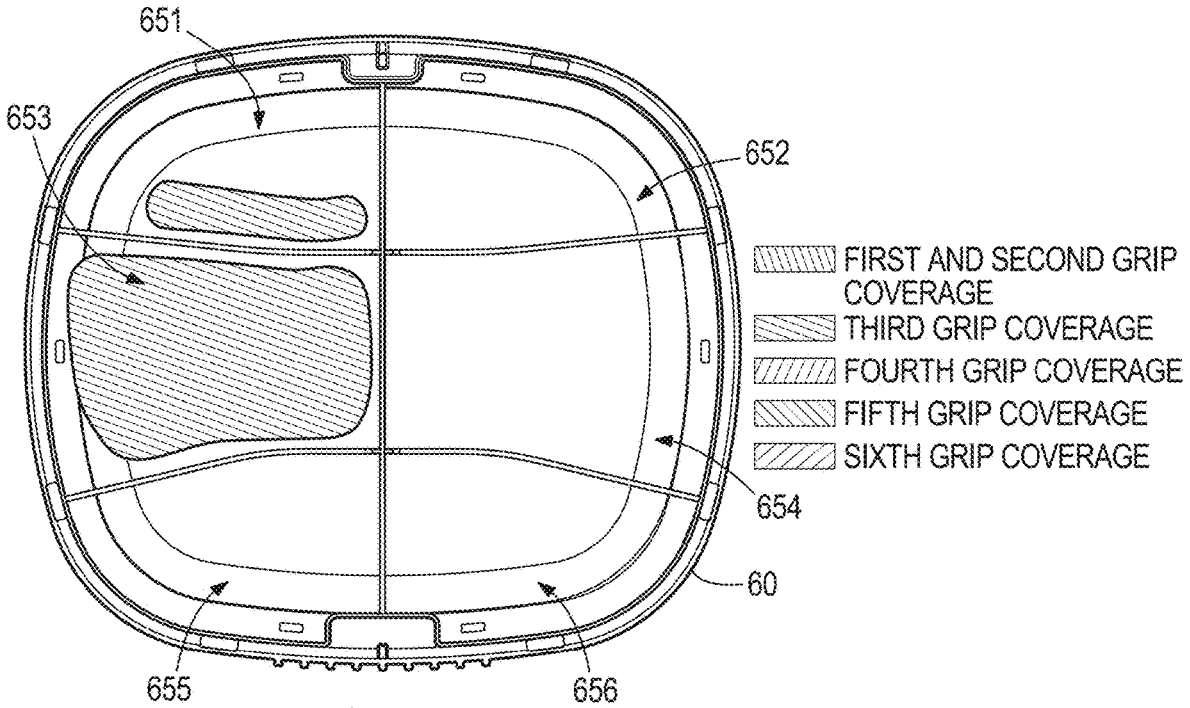
FIG. 51C the base of FIG. 51A depicting the movement of the club grips from the center left starting region.
Figure 51D:
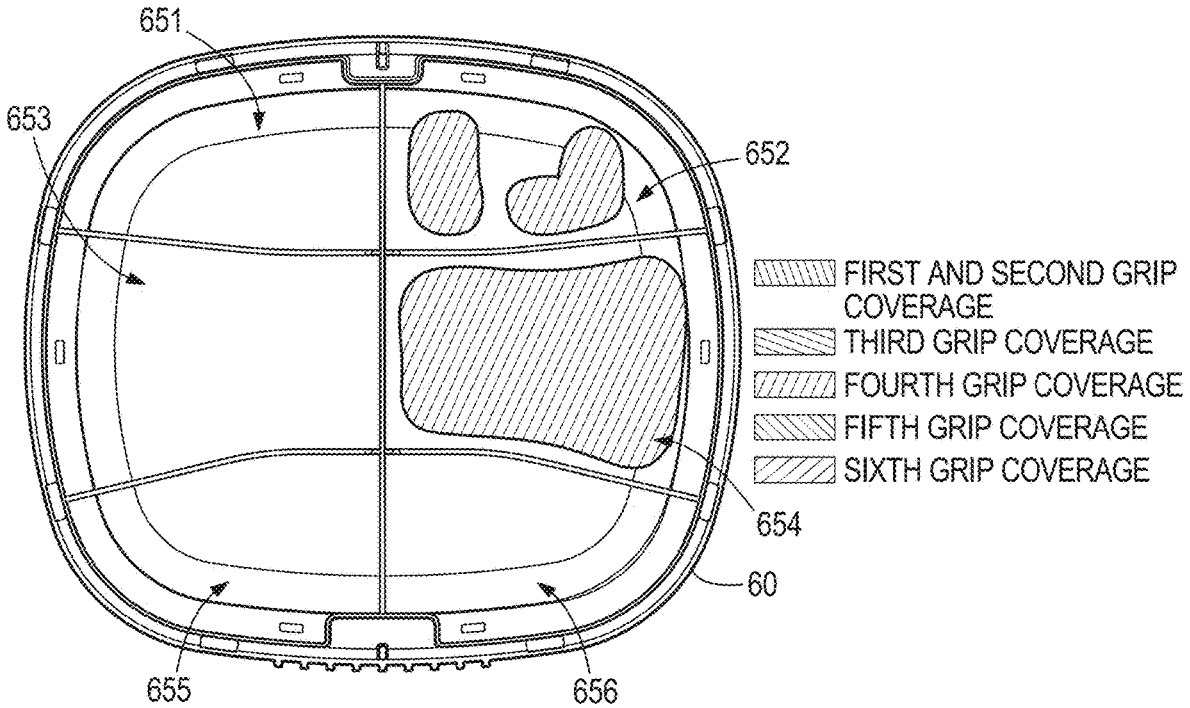
FIG. 51D illustrates a top view of the base of FIG. 51A depicting the movement of the club grips from the center right starting region.
Figure 51E:
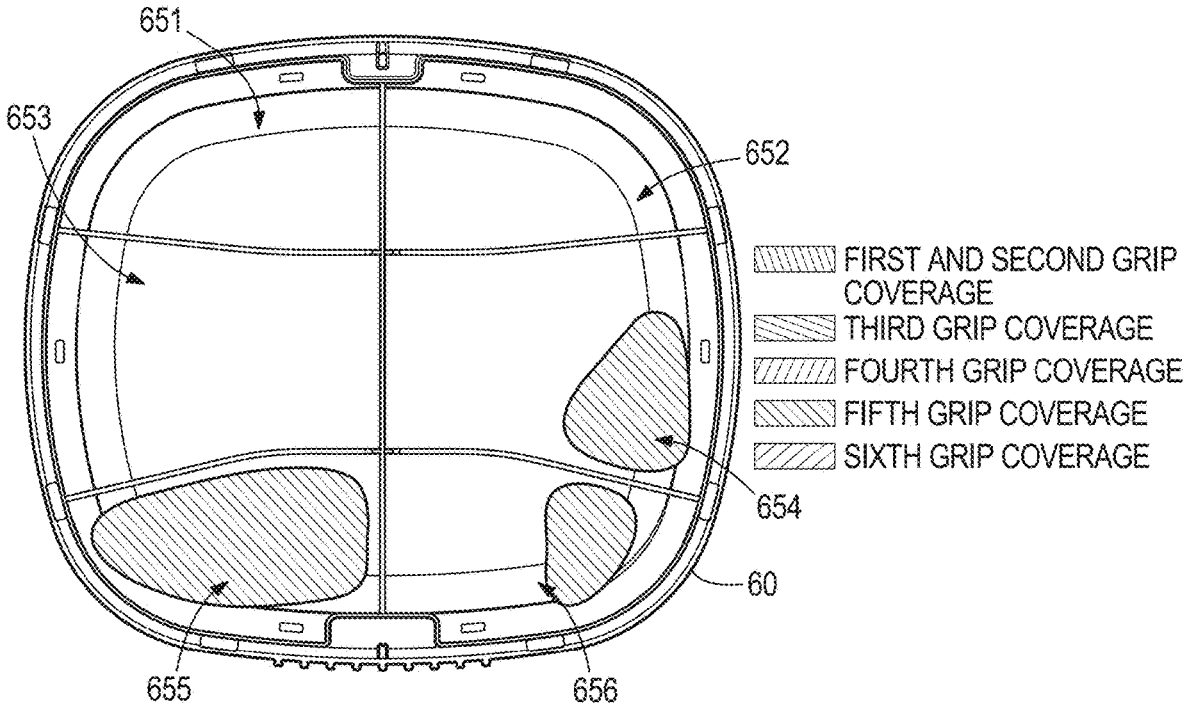
FIG. 51E illustrates a top view of the base of FIG. 51A depicting the movement of the club grips from the front left starting region.
Figure 51F:
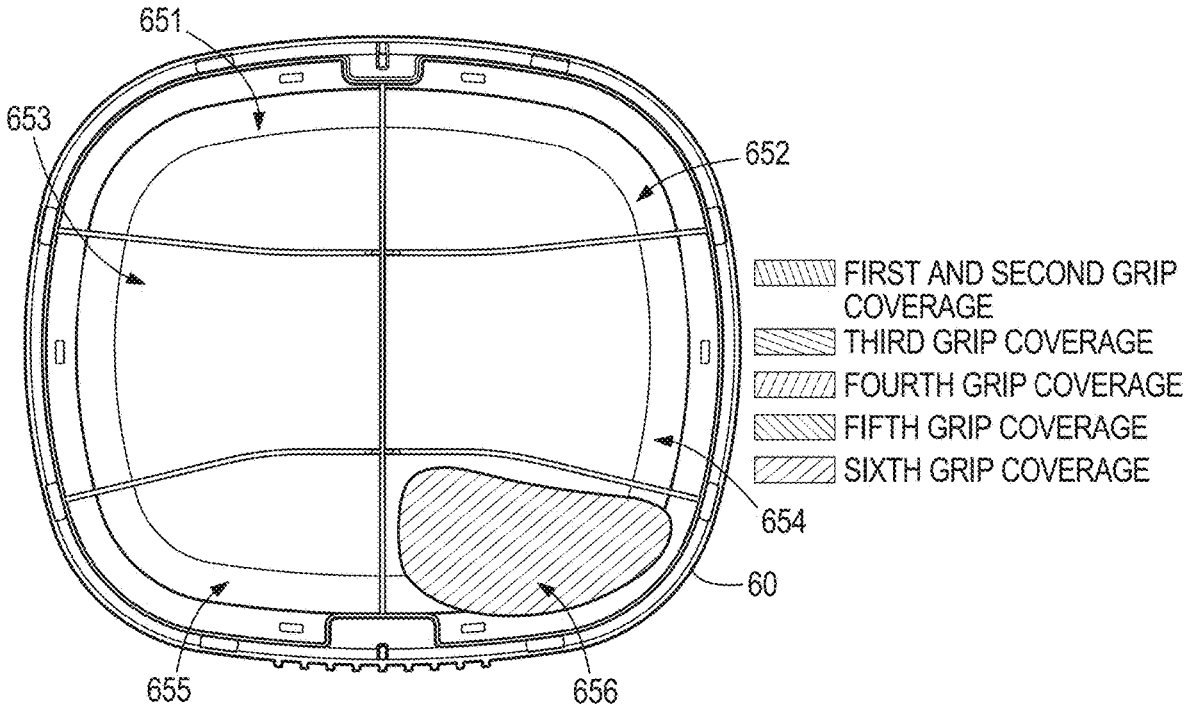
FIG. 51F illustrates a top view of the base of FIG. 51A depicting the movement of the club grips from the front right starting region.

The region in which the grips fell during bag handling in an exemplary golf bag was compared to the region in which the grips fell for a standard golf bag. The exemplary bag in this example comprised a base with dividing rib features as described above. The standard bag in this example lacked any such anti-tangle features. Many dimensions as well as structures of the golf bags' other features were the same throughout the two bags. Six regions were identified according to the rib placement of the base within the exemplary golf bag. Fourteen golf clubs were placed in each bag such that the grips rested in the regions of either base. FIG. 50A illustrates the starting positions of the grips in a standard bag, while FIG. 51A illustrates the starting positions of the grips in the exemplary example bag. Each grip end was covered in paint in order to track grip shifting or movement within the bag. Both golf bags were then lifted and carried a short distance, deployed, and picked back up approximately ten times to mimic use during play. The bases were then removed from the bags and the paint tracks examined in order to determine the amount of grip shifting that occurred during bag use.

The base of the standard golf bag showed higher amounts of grip travel as indicated by the remaining paint along the base, as shown in FIGS. 50AB-50F and 51B-51F. The area of paint outside the starting region was calculated for each of the regions. Specifically, the area of paint that moved beyond the starting point of the back left region, back right region, center left region, center right region, front left region, and front right region was calculated for each bag. FIGS. 50A-50F depict the amount of grip travel that occurred outside each group of clubs' starting positions within the standard bag. FIGS. 51A-51F depict the amount of grip travel that occurred outside each group of clubs' starting positions within the exemplary example bag.

As mentioned, the starting regions of the club grips were identified according to the rib placement within the base of the exemplary golf bag. Six groups were defined based on the starting positions of the grips within the six base regions. The groups were determined as follows: first grip group 661 began in the back left region 651, second grip group 662 began in the back right region 652, third grip group 663 began in the center left region 653, fourth grip group 664 began in the center right region 654, fifth grip group 665 began in the front left region 655, and sixth grip group 666 began in the front right region 656. FIG. 1 also shows the grip group starting regions and area coverage post bag-movement.

The back left region 651 and back right 652 region were analyzed as one region in both bag analyses. The assumption was made that the grips travelled side to side between both of these regions, although such travel is not included in the figure or analysis below. The area of first and second grip coverage 661, 662 outside the back left starting region 651 and the back right starting region 652 in the standard bag was 1.86 $in^2$, while the area of first and second grip coverage outside the back left starting region 651 and the back right 652 starting region in the exemplary bag was 0.0 $in^2$.

The area of the third grip coverage 663 outside the center left starting region 653 in the standard bag was 10.04 $in^2$, while the area of third grip coverage 663 outside the center left starting region 653 in the exemplary example bag was 1.29 $in^2$. The area of fourth grip coverage 664 outside the center right 654 starting region in the standard bag was 10.04 $in^2$, while the area of fourth grip coverage 664 outside the center right starting region 654 in the exemplary example bag was 1.29 $in^2$.

The area of fifth grip coverage 665 outside the front left starting region 655 in the standard bag was 8.69 $in^2$, while the area of fifth grip coverage 665 outside the front left starting region 655 in the exemplary example bag was 3.65 $in^2$. The area of sixth grip coverage 666 outside the front right starting region 656 in the standard bag was 5.96 $in^2$, while the area of sixth grip coverage 666 outside the front right starting region 656 in the exemplary example bag was 0.0 $in^2$.

These values were taken in reference to the total base area and the percent of the total base area taken up by the paint outside the starting region is displayed below in Table 1. As shown, the grips fell during bag handling in an exemplary golf bag was compared to the region in which the grips fell for a standard golf bag. The exemplary golf bag in this example comprised a base with dividing ribs. The standard bag in this example comprised a base lacking any such dividing ribs. Six regions were identified according to the rib placement of the base within the exemplary golf bag. Fourteen golf clubs were placed in each bag such that the grips rested in the regions of either base. FIG. 50A illustrates the starting positions of the grips in a standard bag, while FIG. 51A illustrates the starting positions of the grips in the exemplary example bag. Each grip end was covered in paint in order to track grip shifting or movement within the bag. Both golf bags were then lifted and carried a short distance, deployed, and picked back up approximately ten times to mimic use during play. The bases were then removed from the bags and the paint tracks examined in order to determine the amount of grip shifting that occurred during bag use.

TABLE 2

Standard Bag vs. Exemplary Bag Total Grip Movement

| Grip Group Coverage | Starting Region | Percent Total Base Area Shifted—standard bag | Percent Total Base Area Shifted—exemplary bag |
|---|---|---|---|
| First and Second | Back of Bag | 3.2% | 0.0% |
| Third | Center left | 17.4% | 2.2% |
| Fourth | Center right | 22.5% | 4.1% |
| Fifth | Front left | 15.1% | 6.3% |
| Sixth | Front right | 10.3% | 0.0% |

As mentioned prior, the regions defined by the dividing ribs in the exemplary golf bag may align with the divider top club pockets. This allows the golf clubs to extend through the bag body parallel to the flat. By reducing movement of the grips from their respective regions, that parallel configuration is better maintained, and the clubs tangle less.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

CLAUSES

Clause 1: A golf bag comprising: a front, a back, a first side, and a second side; a divider top, the divider top comprising a leg connection bracket; a base, the base comprising a bottom panel and a receiving wall; a flat, the flat comprising a crush zone extending across portions of the front, the first side, and the second side of the golf bag, adjacent the base; a stay, the stay comprising a stay top end, a stay bottom end, a top hinge, and a bottom hinge; a stand assembly, the stand assembly comprising: a first leg and a second leg; wherein the first leg comprises a first upper end and a first lower end; and wherein the second leg comprises a second upper end and a second lower end; a first leg end cap and a second leg end cap, wherein the first leg end cap is configured to attach to the first upper end, and the second leg end cap is configured to attach to the second upper end; a spring; two spring brackets, wherein the spring brackets are configured to couple the spring to the two legs at a point between the upper ends and the lower ends of the two legs; wherein: the divider top and the base attach to opposite ends of the flat to form a hollow interior for receiving golf clubs; the stay top end flexibly attaches to the divider top by way of the top hinge; the stay bottom end flexibly attaches to the base by way of the bottom hinge; the leg end caps of the stand assembly pivotably attach to the leg connection bracket of the divider top; the spring of the stand assembly attaches to the base; the golf bag can be placed in an upright position or a deployed position; in the upright position, the legs of the stand assembly are retracted and flush with the flat; in the deployed position, the stand assembly is deployed with the legs extended away from the flat; the crush zone of the flat comprises an upper gusset and a lower gusset connected by a folding seam; the upper gusset and the lower gusset are configured to fold such that the folding seam moves outwards when crush zone is compressed; and wherein the crush zone is compressed when the golf bag is in the deployed position.

Clause 2: The golf bag of clause 1, further comprising a base ring; wherein, the base ring is configured to act as a barrier between the crush zone and hollow interior of the bag.

Clause 3: The golf bag of clause 2, wherein the base ring comprises a height; wherein the height varies along a perimeter of the base ring.

Clause 4: The golf bag of clause 2, wherein the base further comprises dividing ribs.

Clause 5: The golf bag of clause 4, wherein the golf bag further comprises a divider sleeve.

Clause 6: The golf bag of clause 5, wherein the divider sleeve further comprises one or more reinforcement panels.

Clause 7: The golf bag of clause 6, wherein the golf bag further comprises a rain hood pocket panel.

Clause 8: The golf bag of clause 1, further comprising: a ground plane; a pivot point defined by the bottom hinge of the stay; a pivot reference plane is parallel to the ground plane and coincident with the pivot point; and wherein from a side view, the golf bag bends about the pivot point when moved between the upright position and the deployed position.

Clause 9: The golf bag of clause 1, wherein: when the bag is in the upright position, the stay is oriented perpendicular to the divider top and the base; and when the base is in the deployed position, the stay is oriented at a first non-perpendicular angle to the divider top and a second non-perpendicular angle to the base.

Clause 10: The golf bag of clause 1, wherein: the stand assembly can be placed in a legs-extended position or a legs-retracted position; when the golf bag is in the upright position, the stand assembly is in the legs-retracted position; and when the golf bag is in the deployed position, the stand assembly is in the legs-extended position.

Clause 11: The golf bag of clause 1, wherein the entire crush zone is located between 0.5 inch and 12 inches above the ground plane.

Clause 12: The golf bag of clause 1, wherein the crush zone defines a convex front edge when viewing the crush zone from a side view.

Clause 13: The golf bag of clause 9, wherein: the convex front edge comprises an outermost point; the crush zone comprises a bulge point defined by the outermost point of the convex front edge; the bulge point defines a horizontal bulge distance parallel to the ground plane defined by the distance between the front of the base and the bulge point; and the horizontal bulge distance increases when the golf bag is in the deployed position.

Clause 14: The golf bag of clause 10, further comprising an extension plane, the extension plane extending between the top edge and the bottom edge of the crush zone, being parallel to the crush zone when the golf bag is in an upright configuration; wherein an extension distance is measured perpendicular to the extension plane, between the bulge point and the extension plane; wherein the extension distance in the deployed configuration is greater than the extension distance in the upright configuration.

Clause 15: The golf bag of clause 1, wherein the divider sleeve further comprises one or more reinforcement panels; wherein the reinforcement panels comprise a stronger material than the material of the rest of the divider sleeve.

Clause 16: A golf bag comprising: a front, a back, a first side, and a second side; a divider top, the divider top comprising a leg connection bracket; a base, the base comprising a bottom panel and a receiving wall; a flat, the flat comprising a crush zone extending across portions of the front, the first side, and the second side of the golf bag, adjacent the base; a stay, the stay comprising a stay top end, a stay bottom end, a top hinge, and a bottom hinge; a stand assembly, the stand assembly comprising: a first leg and a second leg; wherein the first leg comprises a first upper end and a first lower end; and wherein the second leg comprises a second upper end and a second lower end; a first leg end cap and a second leg end cap, wherein the first leg end cap is configured to attach to the first upper end, and the second leg end cap is configured to attach to the second upper end; a spring; two spring brackets, configured to couple the spring to the two legs at a point between the upper ends and the lower ends of the two legs; wherein: the divider top and the base attach to opposite ends of the flat to form a hollow interior for receiving golf clubs; the stay top end flexibly attaches to the divider top by way of the top hinge; the stay bottom end flexibly attaches to the base by way of the bottom hinge; the leg end caps of the stand assembly pivotably attach to the leg connection bracket of the divider top; the spring of the stand assembly attaches to the base; the golf bag can be placed in an upright position or a deployed position; in the upright position, the legs of the stand assembly are retracted and flush with the flat; in the deployed position, the stand assembly is deployed with the legs extended away from the flat; the crush zone of the flat comprises a center panel, first side panel, and a second side panel; wherein the crush zone is compressed when the golf bag is in the deployed position.

Clause 17: The golf bag of clause 16, wherein the first side panel and the second side panel each comprise a curved seam and wherein the curved seam of the first side panel and the curved seam of the second side panel comprise a similar radius of curvature.

Clause 18: The golf bag of clause 16, wherein both the first side panel and the second side panel comprise a triangular shape; and wherein the center panel comprises a rectangular shape.

Clause 19: The golf bag of clause 16, wherein: the center panel comprises a first edge and a second edge; the first side panel comprises a first side edge; and the second side panel comprises a second side edge; wherein the center panel first edge attaches to the first side panel first side edge, and the center panel second edge attaches to the second side panel second side edge.

Clause 20: The golf bag of clause 19, wherein the first edge, second edge, first side edge, and second side edge comprise a similar radius of curvature.

Clause 21: The golf bag of clause 16, wherein the crush zone defines a convex front edge when viewing the crush zone from a side view.

Clause 22: The golf bag of clause 16, further comprising a base ring; wherein, the base ring is configured to act as a barrier between the crush zone and hollow interior of the bag.

Clause 23: The golf bag of clause 22, wherein the base ring comprises a height; wherein the height varies along a perimeter of the base ring.

Clause 24: The golf bag of clause 16, wherein the base further comprises dividing ribs.

Clause 25: The golf bag of clause 16, wherein the golf bag further comprises a divider sleeve.

Clause 26: The golf bag of clause 16, wherein the divider sleeve further comprises one or more reinforcement panels.

Clause 27: The golf bag of clause 16, wherein the golf bag further comprises a rain hood pocket panel.

Clause 28: The golf bag of clause 16, further comprising: a ground plane; a pivot point defined by the bottom hinge of the stay; a pivot reference plane is parallel to the ground plane and coincident with the pivot point; and wherein from a side view, the golf bag bends about the pivot point when moved between the upright position and the deployed position.

Clause 29: The golf bag of clause 16, wherein: when the bag is in the upright position, the stay is oriented perpendicular to the divider top and the base; and when the base is in the deployed position, the stay is oriented at a first non-perpendicular angle to the divider top and a second non-perpendicular angle to the base.

Clause 30: The golf bag of clause 16, wherein: the stand assembly can be placed in a legs-extended position or a legs-retracted position; when the golf bag is in the upright position, the stand assembly is in the legs-retracted position; and when the golf bag is in the deployed position, the stand assembly is in the legs-extended position.

Clause 31: The golf bag of clause 16, wherein the entire crush zone is located between 0.5 inch and 12 inches above the ground plane.

Clause 32: The golf bag of clause 16, wherein the crush zone defines a convex front edge when viewing the crush zone from a side view.

Clause 33: The golf bag of clause 32, wherein: the convex front edge comprises an outermost point; the crush zone comprises a bulge point defined by the outermost point of the convex front edge; the bulge point defines a horizontal bulge distance parallel to the ground plane defined by the distance between the front of the base and the bulge point; and the horizontal bulge distance increases when the golf bag is in the deployed position.

Clause 34: The golf bag of clause 133, further comprising an extension plane, the extension plane extending between the top edge and the bottom edge of the crush zone, being parallel to the crush zone when the golf bag is in an upright configuration; wherein an extension distance is measured perpendicular to the extension plane, between the bulge point and the extension plane; wherein the extension distance in the deployed configuration is greater than the extension distance in the upright configuration.

Clause 35: The golf bag of clause 16, wherein the divider sleeve further comprises one or more reinforcement panels; wherein the reinforcement panels comprise a stronger material than the material of the rest of the divider sleeve.

The invention claimed is:

1. A golf bag comprising:

a front, a back, a first side, and a second side;

a divider top, the divider top comprising a leg connection bracket;

a base, the base comprising a bottom panel and a receiving wall;

a flat, the flat comprising a crush zone extending across portions of the front, the first side, and the second side of the golf bag, adjacent the base;

the crush zone comprises a center panel, a first side panel, a second side panel, and a circumscribing panel;

the center panel comprises a center panel height that is greater than a first side panel height and a second side panel height;

the center panel comprises a first side edge comprising a radius of curvature between 70 cm and 90 cm and a second side edge comprising a radius of curvature between 70 cm and 90 cm;

the circumscribing panel comprises a top edge and a bottom edge, wherein the bottom edge is secured to the base and the top edge is not secured to the base;

a stay, the stay comprising a stay top end, a stay bottom end, a top hinge, and a bottom hinge;

a stand assembly, the stand assembly comprising:

a first leg and a second leg;

wherein the first leg comprises a first upper end and a first lower end; and wherein the second leg comprises a second upper end and a second lower end;

a first leg end cap and a second leg end cap, wherein the first leg end cap is configured to attach to the first upper end, and the second leg end cap is configured to attach to the second upper end;

a spring;

two spring brackets, wherein the spring brackets are configured to couple the spring to the first leg at a point between the first upper end and the first lower end, and the second leg at a point between the second upper end and the second lower end;

wherein:

the divider top and the base attach to opposite ends of the flat to form a hollow interior for receiving golf clubs;

the stay top end flexibly attaches to the divider top by way of the top hinge;

the stay bottom end flexibly attaches to the base by way of the bottom hinge;

the first leg end cap and the second leg end cap of the stand assembly pivotably attach to the leg connection bracket of the divider top;

the spring of the stand assembly attaches to the base;

the golf bag can be placed in an upright position or a deployed position;

in the upright position, the first leg and the second leg of the stand assembly are retracted and flush with the flat;

in the deployed position, the stand assembly is deployed with the first leg and the second leg extended away from the flat;

the crush zone of the flat comprises an upper gusset and a lower gusset connected by a folding seam;

the upper gusset comprises an upper gusset top edge and an upper gusset folding edge, and the lower gusset comprises a lower gusset bottom edge and a lower gusset folding edge;

wherein the upper gusset top edge defines a top edge of the crush zone, and the lower gusset bottom edge defines a bottom edge of the crush zone;

wherein the upper gusset folding edge and the lower gusset folding edge abut along the folding seam;

the upper gusset and the lower gusset are configured to fold such that the folding seam moves outwards when crush zone is compressed;

wherein the crush zone is compressed when the golf bag is in the deployed position, and;

wherein an entirety of a front edge of the crush zone has a convex shape when viewing the crush zone from a side view;

wherein:

the front edge is defined by an outermost edge of a crush zone surface when viewed from a side view and extends across an entirety of the crush zone, from the upper gusset top edge to the lower gusset bottom edge;

the front edge comprises a single outermost point positioned on the folding seam;

the crush zone comprises a bulge point defined by the single outermost point of the front edge;

the bulge point defines a horizontal bulge distance parallel to a ground plane defined by the distance between a front of the base and the bulge point;

the horizontal bulge distance increases when the golf bag is in the deployed position;

a pivot point defined by the bottom hinge of the stay;

a pivot reference plane parallel to the ground plane and coincident with the pivot point;

wherein from a side view, the golf bag bends about the pivot point when moved between the upright position and the deployed position and;

the crush zone extends to the pivot point.

2. The golf bag of claim 1, further comprising a base ring; wherein, the base ring is configured to act as a barrier between the crush zone and hollow interior of the bag.

3. The golf bag of claim 2, wherein the base ring comprises a height; wherein the height varies along a perimeter of the base ring.

4. The golf bag of claim 1, wherein the base further comprises dividing ribs.

5. The golf bag of claim 1, wherein the golf bag further comprises a divider sleeve.

6. The golf bag of claim 5, wherein the divider sleeve further comprises one or more reinforcement panels.

7. The golf bag of claim 6, wherein the golf bag further comprises a rain hood pocket panel.

8. The golf bag of claim 5, wherein the divider sleeve further comprises one or more reinforcement panels; wherein the reinforcement panels comprise a stronger material than a remainder of the divider sleeve.

9. The golf bag of claim 1, wherein:

when the bag is in the upright position, the stay is oriented perpendicular to the divider top and the base; and when the base is in the deployed position, the stay is oriented at a first non-perpendicular angle to the divider top and a second non-perpendicular angle to the base.

10. The golf bag of claim 1, wherein:

the stand assembly can be placed in a legs-extended position or a legs-retracted position;

when the golf bag is in the upright position, the stand assembly is in the legs-retracted position; and when the golf bag is in the deployed position, the stand assembly is in the legs-extended position.

11. The golf bag of claim 1, wherein the entirety of the crush zone is located between 0.5 inch and 12 inches above the ground plane.

12. The golf bag of claim 1, further comprising an extension plane, the extension plane extending between the top edge and the bottom edge of the crush zone, being parallel to the crush zone when the golf bag is in an upright position; wherein an extension distance is measured perpendicular to the extension plane, between the bulge point and the extension plane; wherein the extension distance in the deployed position is greater than the extension distance in the upright position.

13. The golf bag of claim 1, wherein the top edge of the of the crush zone and the bottom edge of the crush zone define an upper reference angle between 20 degrees and 60 degrees.

* * * * *